US005687239A

United States Patent [19]

Inanaga et al.

[11] Patent Number: 5,687,239

[45] **Date of Patent: *Nov. 11, 1997**

[54] AUDIO REPRODUCTION APPARATUS

[75] Inventors: Kiyofumi Inanaga, Kanagawa; Yuji Yamada, Tokyo, both of Japan

[73] Assignee: Sony Corporation, Tokyo, Japan

[ * ] Notice: The term of this patent shall not extend beyond the expiration date of Pat. No. 5,526,429.

[21] Appl. No.: 424,508

[22] PCT Filed: Oct. 4, 1994

[86] PCT No.: PCT/JP94/01661

§ 371 Date: May 23, 1995

§ 102(e) Date: May 23, 1995

[87] PCT Pub. No.: WO95/10167

PCT Pub. Date: Apr. 13, 1995

[30] Foreign Application Priority Data

| | | | |
|---|---|---|---|
| Oct. 4, 1993 | [JP] | Japan | 5-248187 |
| Oct. 28, 1993 | [JP] | Japan | 5-270890 |
| Nov. 4, 1993 | [JP] | Japan | 5-275697 |
| Nov. 11, 1993 | [JP] | Japan | 5-282742 |
| Jan. 27, 1994 | [JP] | Japan | 6-007901 |
| Mar. 11, 1994 | [JP] | Japan | 6-041223 |

[51] Int. Cl.[6] ..... H04R 5/00

[52] U.S. Cl. ..... 381/25; 381/74

[58] Field of Search ..... 381/1, 24, 25, 381/74

[56] References Cited

U.S. PATENT DOCUMENTS

| | | | |
|---|---|---|---|
| 3,962,543 | 6/1976 | Blanert et al. | 381/74 |
| 5,181,248 | 1/1993 | Inanaga et al. | 381/25 |
| 5,452,359 | 9/1995 | Inanaga et al. | 381/74 |
| 5,495,534 | 2/1996 | Inanaga et al. | 381/74 |
| 5,526,429 | 6/1996 | Inanaga et al. | 381/74 |

FOREIGN PATENT DOCUMENTS

| | | | |
|---|---|---|---|
| 1121000 | 5/1989 | Japan | 381/74 |
| 2200000 | 8/1990 | Japan | 381/74 |
| 0444500 | 2/1992 | Japan | 381/74 |
| 5183998 | 7/1993 | Japan | 381/74 |

*Primary Examiner*—Curtis Kuntz
*Assistant Examiner*—Xu Mei
*Attorney, Agent, or Firm*—Jay H. Maioli

[57] ABSTRACT

To provide an audio reproduction apparatus can save the capacity of a memory, can process audio signals quickly depending on the movement of the head of a listener, and is not affected by conditions in which sounds are picked up, digital audio signals in respective channels from a multichannel digital stereophonic signal source 1, or digital audio signals in respective channels which are converted by A/D converters 3 from analog signals that are inputted to an analog stereophonic signal source 2, and a set of impulse responses digitally recorded in a memory 35 based on an angle of the head of a listener 23 with respect to a reference position, the impulse responses containing corrective characteristics of sound sources and headphones used to measure the impulse responses, are subjected to convolutional integration on a real-time basis by convolutional integrators 5, 7, 9, 11.

45 Claims, 32 Drawing Sheets

FIG. 4

| $\theta$ | Table Address | Impulse Response $h_{m,n}(t,\theta)$ | | | |
|---|---|---|---|---|---|
| | | $h_{LL}(t,\theta)$ | $h_{LR}(t,\theta)$ | $h_{RL}(t,\theta)$ | $h_{RR}(t,\theta)$ |
| 0° | 0 | $h_{LL}(t,0)$ | $h_{LR}(t,0)$ | $h_{RL}(t,0)$ | $h_{RR}(t,0)$ |
| 2° | 1 | $h_{LL}(t,1)$ | $h_{LR}(t,1)$ | $h_{RL}(t,1)$ | $h_{RR}(t,1)$ |
| 4° | 2 | $h_{LL}(t,2)$ | $h_{LR}(t,2)$ | $h_{RL}(t,2)$ | $h_{RR}(t,2)$ |
| 6° | 3 | $h_{LL}(t,3)$ | $h_{LR}(t,3)$ | $h_{RL}(t,3)$ | $h_{RR}(t,3)$ |
| ⋮ | 4 | ⋮ | ⋮ | ⋮ | ⋮ |
| 358° | 179 | $h_{LL}(t,358)$ | $h_{LR}(t,358)$ | $h_{RL}(t,358)$ | $h_{RR}(t,358)$ |

If Corrctive Characteristics Inherent in Sound Sources Are Included:

$$f_{IJ}(t,\theta) = h_{IJ}(t,\theta) * h_{SIJ}(t,\theta)^{-1}$$

If Corective Characteristics Inherent in Headphones Are Included:

$$f_{IJ}(t,\theta) = h_{IJ}(t,\theta) * h_h(t)^{-1}$$

If Both Corrective Characteristics are Included:

$$f_{IJ}(t,\theta) = h_{IJ}(t,\theta) * h_{SIJ}(t,\theta)^{-1} * h_h(t)^{-1}$$

FIG. 7

| θ | Table Address | Control Data $\Delta T_{IJ}(\theta)$, $\Delta L_{IJ}(\theta)$ | | | |
|---|---|---|---|---|---|
| | | $\Delta T_{LL}(\theta), \Delta L_{LL}(\theta)$ | $\Delta T_{LR}(\theta), \Delta L_{LR}(\theta)$ | $\Delta T_{RL}(\theta), \Delta L_{RL}(\theta)$ | $\Delta T_{RR}(\theta), \Delta L_{RR}(\theta)$ |
| 0° | 0 | $\Delta T_{LL}(0), \Delta L_{LL}(0)$ | $\Delta T_{LR}(0), \Delta L_{LR}(0)$ | $\Delta T_{RL}(0), \Delta L_{RL}(0)$ | $\Delta T_{RR}(0), \Delta L_{RR}(0)$ |
| 2° | 1 | $\Delta T_{LL}(1), \Delta L_{LL}(1)$ | $\Delta T_{LR}(1), \Delta L_{LR}(1)$ | $\Delta T_{RL}(1), \Delta L_{RL}(1)$ | $\Delta T_{RR}(1), \Delta L_{RR}(1)$ |
| 4° | 2 | $\Delta T_{LL}(2), \Delta L_{LL}(2)$ | $\Delta T_{LR}(2), \Delta L_{LR}(2)$ | $\Delta T_{RL}(2), \Delta L_{RL}(2)$ | $\Delta T_{RR}(2), \Delta L_{RR}(2)$ |
| 6° | 3 | $\Delta T_{LL}(3), \Delta L_{LL}(3)$ | $\Delta T_{LR}(3), \Delta L_{LR}(3)$ | $\Delta T_{RL}(3), \Delta L_{RL}(3)$ | $\Delta T_{RR}(3), \Delta L_{RR}(3)$ |
| ⋮ | 4 ⋮ | ⋮ | ⋮ | ⋮ | ⋮ |
| 358° | 179 | $\Delta T_{LL}(179), \Delta L_{LL}(179)$ | $\Delta T_{LR}(179), \Delta L_{LR}(179)$ | $\Delta T_{RL}(179), \Delta L_{RL}(179)$ | $\Delta T_{RR}(179), \Delta L_{RR}(179)$ |

$\Delta T_{IJ}(\theta)$ : Time Difference Between Ears $\Delta L_{IJ}(\theta)$ : Level Difference Between Ears

AUDIO REPRODUCTION APPARATUS

TECHNICAL FIELD

The present invention relates to an audio reproduction apparatus suitable for use in reproducing audio signals through headphones.

BACKGROUND ART

There has conventionally been known a process of reproducing audio signals through headphones which are placed on the head of a listener in covering relation to the ears of the listener to allow the listener to listen to the audio signals with the headphones. The process of reproducing audio signals through headphones creates a phenomenon referred to as "lateralization" in which a reproduced sound image is perceived inside the head of the listener even when the signal from a signal source is of a stereophonic nature.

Another process of reproducing audio signals through headphones is known as a binaural process of picking up and reproducing sound waves. The binaural process of picking up and reproducing sound waves will be described in detail below. Microphones called "dummy head microphones" are put into the respective ears of a dummy head which simulates the head of a listener, and an audio signal from a signal source is picked up by the dummy head microphones. The audio signal thus picked up are reproduced by headphones that are actually worn by a listener, who is capable of listening to the reproduced sound with presence or intimacy. The binaural process allows the listener to listen to the reproduced sound image with improved directivity, localization, and presence. However, binaural sound reproduction requires a special sound source signal picked up by dummy head microphones which is different from a sound source signal used for sound reproduction by loudspeakers.

It has been proposed, in an application of the binaural process of picking up and reproducing sound waves, to reproduce a general stereophonic signal with headphones in order to bring about a phenomenon called "localization" in which a reproduced sound image is perceived outside the head of the listener, in the same manner as sounds reproduced by loudspeakers. In a stereophonic sound reproduction mode using loudspeakers, when the listener changes the direction of his head (face), the absolute direction and position of the sound image remain unchanged, but the relative direction and position of the sound image as it is perceived by the listener change. In a binaural sound reproduction mode using headphones, the relative direction and position of the sound image remain unchanged when the orientation of the head (face) of the listener is changed. In the binaural sound reproduction mode, therefore, when the listener changes the orientation of the head (face), the sound field is perceived by the listener as being located inside the head, and it is difficult to localize the sound image in front of the listener. When the listener changes the orientation of the head (face) in the binaural sound reproduction mode, the perceived sound image tends to be elevated inside the head.

Japanese patent publication No. 42-227 discloses a binaural sound reproduction system using headphones as follows: The directivity and localization of a sound image as perceived by a listener are determined by the difference between the intensities of sounds perceived by the respective ears of the listener, the difference between the times of arrival of the sounds at the respective ears of the listener, and the phase difference between the sounds. The disclosed system has a level control circuit and a variable delay circuit in the audio signal line of each of the left and right channels. The level control circuit and the variable delay circuit for controlling audio signals in each of the left and right channels are controlled based on a signal indicative of the detected orientation of the head of the listener.

In the binaural sound reproduction system disclosed in Japanese patent publication No. 42-227, the signal indicative of the detected orientation of the head of the listener is used to directly energize motors to mechanically control a variable resistor and a variable capacitor in the level control circuit and the variable delay circuit with analog signals. Therefore, after the listener has changed the orientation of his head, there is developed a certain time lag before the intensity and time differences between the audio signals supplied through the respective channels to the headphone are actually varied. The developed time delay makes it impossible for the disclosed system to respond quickly to movements of the head of the listener.

According to the binaural sound reproduction system disclosed in Japanese patent publication No. 42-227, furthermore, the characteristics with which the intensity and time differences between the audio signals supplied through the respective channels are varied have to be determined based on the relative positional relationship between the sound sources and the listener, the shape of the head of the listener, and the shape of the auricle of the listener. Specifically, if certain characteristics are established, then the relative positional relationship between the sound sources and the listener is fixed, failing to vary the distance perspective and the distance between the sound sources. The effectiveness of the binaural sound reproduction system vary from listener to listener as different listeners have different head shapes and different auricle shapes. Japanese patent publication No. 42-227 fails to show means for correcting characteristics inherent in sound sources for measuring transfer functions from virtual sound source positions to the ears of the listener and characteristics inherent in the headphones used.

Japanese patent publication No. 54-19242 discloses a stereophonic reproduction system in which the orientation of the head of a listener and the relationship between variations of the intensity and time differences between audio signals in the channels which are supplied to headphones is continuously determined.

However, it is very difficult to realize the stereophonic reproduction system disclosed in Japanese patent publication No. 54-19242 because a memory of vast capacity is required to continuously determine and store the relationship between variations of the intensity and time differences between audio signals. Furthermore, Japanese patent publication No. 54-19242 fails to show means for correcting characteristics inherent in sound sources for measuring transfer functions from virtual sound source positions to the ears of a listener and characteristics inherent in headphones used.

An audio reproduction apparatus disclosed in Japanese laid-open patent publication No. 01-112900 filed by the same applicant as that of the present invention has a device for discretely, rather than continuously, determining data on the relationship between variations of the intensity and time differences between audio signals, and processing the audio signals.

However, Japanese laid-open patent publication No. 01-112900 only shows the principles of a concept that can be applied to both analog and digital signal processing, and does not disclose a specific arrangement for effecting analog or digital signal processing which can be incorporated in an actual article of merchandise. In addition, Japanese laid-open patent publication No. 01-112900 fails to show means for correcting characteristics inherent in sound sources for measuring transfer functions from virtual sound source positions to the ears of a listener and characteristics inherent in headphones used.

According to an audio signal reproduction apparatus disclosed in Japanese laid-open patent publication No. 03-214897 filed by the same applicant as that of the present invention, the arrangement is simplified and a large memory capacity saving is achieved by fixing transfer functions from respective virtual sound source positions to the ears of a listener, and after signal processing, controlling the levels and delay times of signals supplied to the ears depending on the angle through which the head of the listener rotates.

The above conventional headphone reproduction system, stereophonic reproduction system, and audio reproduction apparatus cannot be realized unless digital signal processing were carried out for quickly processing audio signals depending on the movement of the head of the listener. Since no means and process for digital signal processing are disclosed in the above publications, it is difficult to realize the conventional headphone reproduction system, stereophonic reproduction system, and audio reproduction apparatus.

A memory of vast capacity has to be provided for storing the relationship between variations of the intensity and time differences between audio signals. Such a memory cannot be realized unless digital signal processing were carried out. Since no means and process for digital signal processing are disclosed in the above publications, it is difficult to realize such a memory.

Though sounds reproduced by headphones are affected by characteristics inherent in sound sources for measuring transfer functions from virtual sound source positions to the ears of a listener and characteristics inherent in the headphones used, nothing is disclosed in the above publications with respect to means for correcting those sounds, and thus sounds reproduced by the headphones are affected by those characteristics.

While any of the above conventional headphone reproduction system, stereophonic reproduction system, audio reproduction apparatus, and audio signal reproduction apparatus cannot be realized unless digital signal processing were carried out for quickly processing audio signals depending on the movement of the head of the listener, no means and process for digital signal processing are disclosed in the above publications, and no specific arrangement for allowing a plurality of listeners to listen simultaneously is disclosed in the above publications. Therefore, it is difficult to realize the above conventional headphone reproduction system, stereophonic reproduction system, audio reproduction apparatus, and audio signal reproduction apparatus.

A memory of vast capacity has to be provided for storing the relationship between variations of the intensity and time differences between audio signals. Such a memory cannot be realized unless digital signal processing were carried out. Since no means and process for digital signal processing are disclosed in the above publications, it is difficult to realize such a memory.

Though sounds reproduced by headphones are affected by characteristics inherent in sound sources for measuring transfer functions from virtual sound source positions to the ears of a listener and characteristics inherent in the headphones used, nothing is disclosed in the above publications with respect to means for correcting those sounds, and thus sounds reproduced by the headphones are affected by those characteristics.

In any of the above conventional headphone reproduction system, stereophonic reproduction system, audio reproduction apparatus, and audio signal reproduction apparatus, sounds reproduced by headphones are affected by characteristics inherent in the headphones used. Inasmuch as no means for correcting those sounds is disclosed in the above publications, sounds reproduced by the headphones are affected by those characteristics.

When the head of a listener is moved with reference to a reference direction while the listener is wearing headphones during reproduction of sounds, since the positions of reproduced sound sources remain unchanged, the positions of reproduced sound sources are fixed even if the listener wants to change the positions of reproduced sound sources, and hence the reproduced condition is felt as unnatural.

The above publications disclose no specific arrangement for adjusting means to be used when the listener wants to select a hall mode or the like for a reproduced sound field, determine whether reverberation is to occur or not and select a degree of reverberation, vary the intensity and balance of reproduced sounds, change the signal source to a digital signal source or an analog signal source, and change the number of channels of the signal source. Therefore, it is difficult to realize such adjusting means.

Because any specific arrangement is disclosed in the above publications as to where such adjusting means is to be located in the entire apparatus, it is difficult to realize such adjusting means.

DISCLOSURE OF THE INVENTION

The present invention has been made in view of the above conventional shortcomings, and it is a first object of the present invention to provide an audio reproduction apparatus which can save the capacity of a memory, can process audio signals quickly depending on the movement of the head of a listener, and is not affected by conditions in which sounds are picked up.

The present invention has been made in view of the above conventional shortcomings, and it is a second object of the present invention to provide an audio reproduction apparatus which allows a plurality of listeners to listen to reproduced sounds simultaneously as if from loudspeakers placed in virtual sound source positions.

The present invention has been made in view of the above conventional shortcomings, and it is a third object of the present invention to provide an audio reproduction apparatus which can conveniently be used by a listener and allows the listener to listen to reproduced sounds as if from loudspeakers placed in virtual sound source positions.

An audio reproduction apparatus according to a first invention comprises a digital signal source for supplying digital audio signals in a plurality of channels, audio reproducing means disposed in the vicinity of the ears of a listener, for converting digital audio signals from the digital signal source with digital/analog converting means and reproducing the signals, angle detecting means for detecting a movement of the head of the listener with respect to a reference direction through each predetermined angle, address converting means for converting an angle detected by the angle detecting means into a digital address signal, storage means for storing corrective characteristics of at least one of headphones and sound sources which are used to measure impulse responses from virtual sound source positions with respect to a reference direction of the head of the listener to the ears of the listener through each angle which can be recognized by the listener, the corrective characteristics being convoluted with the impulse responses, and integrating means for effecting convolutional integration on the digital audio signals from the digital signal source and the impulse responses stored by the storage means, the arrangement being such that the storage means is addressed by the digital address signal produced by the address converting means to correct the digital audio signals with respect to the movement of the head of the listener on a real-time basis based on the impulse responses which are digitally recorded by the storage means and contain the convoluted corrective characteristics of at least one of headphones and sound sources. Since the storage means is addressed by the digital address signal produced by the address converting means to read the digitally recorded impulse responses containing convoluted corrective characteristics of at least one of the headphones and sound sources, the signals can be corrected with respect to at least one of the headphones and sound sources used to measure the impulse responses, without delaying the signal processing.

An audio reproduction apparatus according to a second invention further comprises a headphone device for being mounted on the head of the listener, the headphone device having at least the audio reproducing means and the angle detecting means, an main apparatus section having at least the address converting means, the storage means, and the integrating means, and transmission means for transmitting signals between the main apparatus section and the headphone device. Therefore, signals processed in a main apparatus section can be reproduced by the headphones.

An audio reproduction apparatus according to a third invention comprises a digital signal source for supplying digital audio signals in a plurality of channels, audio reproducing means disposed in the vicinity of the ears of a listener, for converting digital audio signals from the digital signal source with digital/analog converting means and reproducing the signals, angle detecting means for detecting a movement of the head of the listener with respect to a reference direction through each predetermined angle, address signal converting means for converting an angle detected by the angle detecting means into a digital address signal, first storage means for storing impulse responses measured from virtual sound source positions with respect to a reference direction of the head of the listener to the ears of the listener which are fixed, integrating means for effecting convolutional integration on the digital audio signals in the respective channels from the digital signal source and the impulse responses stored by the first storage means, second storage means for storing control signals representative of measured time differences and level differences of the audio signals from the virtual sound source positions with respect to the reference direction of the head of the listener to the ears of the listener through each angle which can be recognized by the listener, and control means for correcting the digital audio signals in the respective channels which have been subjected with the impulse responses to convolutional integration by the integrating means, with the control signals stored by the second storage means, and supplying the corrected digital audio signals to the audio reproducing means, the arrangement being such that the second storage means is addressed by the digital address signal produced by the address signal converting means to read the control signals stored by the second storage means to correct the digital audio signals which have been subjected with the impulse responses to convolutional integration by the integrating means, with the control signals in the control means, for thereby correcting the digital audio signals in the respective channels with respect to the movement of the head of the listener on a real-time basis based on the control signals. Since the second storage means is addressed by the digital address signal produced by the address signal converting means to read the control signals stored by the second storage means to correct the digital audio signals which have been subjected with the impulse responses to convolutional integration by the integrating means, with the control signals in the control means, the signals can be corrected without delaying the signal processing to allow the listener to listen to reproduced sounds as if they were radiated from loud speakers placed in the virtual sound source positions.

An audio reproduction apparatus according to a fourth invention further comprises adding means for adding the digital audio signals in the respective channels which have been subjected with the impulse responses to convolutional integration by the integrating means, as right and left digital audio signals in respective two channels, the arrangement being such that the right and left digital audio signals in respective two channels which are added by the adding means are corrected with the control signals stored by the second storage means by the control means, and supplied to the audio reproducing means. Inasmuch as the second storage means is addressed by the digital address signal produced by the address signal converting means to read the control signals stored by the second storage means, and the right and left digital audio signals in respective two channels which are added by the adding means are corrected with the control signals stored by the second storage means by the control means, the signals can be corrected without delaying the signal processing to allow the listener to listen to reproduced sounds based on the right and left digital audio signals in respective two channels as if they were radiated from loudspeakers placed in the virtual sound source positions.

An audio reproduction apparatus according to a fifth invention further comprises a headphone device for being mounted on the head of the listener, the headphone device having at least the audio reproducing means and the angle detecting means, an main apparatus section having at least the address converting means, the storage means, and the integrating means, and transmission means for transmitting signals between the main apparatus section and the headphone device. Signals processed by the main apparatus section can be reproduced by the headphone device.

In an audio reproduction apparatus according to a sixth invention, the transmission means comprises transmitting means for transmitting as radio signals the right and left digital audio signals in respective two channels which are added by the adding means, and receiving means for receiving the right and left digital audio signals in respective two channels which are transmitted by the transmitting means, the arrangement being such that the digital audio signals outputted from the receiving means are corrected by the control means. Since the digital audio signals in respective two channels which are transmitted by the transmitting means are received by the receiving means, and corrected with respect to the movement of the head of the listener on a real-time basis based on the control signals by way of wireless communication, the signals can be corrected by way of wireless communication without delaying the signal processing to allow the listener to listen to reproduced sounds as if they were radiated from loudspeakers placed in the virtual sound source positions.

In an audio reproduction apparatus according to a seventh invention, the transmission means comprises digital/analog converting means for converting the right and left digital audio signals in respective two channels which are added by the adding means into analog audio signals, transmitting means for being supplied with the analog audio signals from the digital/analog converting means and transmitting the supplied analog audio signals as radio signals, receiving means for receiving the analog audio signals transmitted by the transmitting means, the arrangement being such that digital audio signals outputted from the receiving means are corrected by the control means. Since the analog audio signals in respective two channels which are transmitted by the transmitting means are received by the receiving means, and corrected with respect to the movement of the head of the listener on a real-time basis based on the control signals by way of wireless communication, the signals can be corrected by way of wireless communication without delaying the signal processing to allow the listener to listen to reproduced sounds as if they were radiated from loudspeakers placed in the virtual sound source positions.

In an audio reproduction apparatus according to an eighth invention, the transmission means comprises first radio means having a first transmitting device for transmitting as radio signals the right and left digital audio signals in respective two channels which are added by the adding means, and a first receiving device for receiving other signals, and second radio means having a second receiving device for receiving the right and left digital audio signals in respective two channels which are transmitted by the first transmitting device of the first radio means, and a second transmitting device for transmitting other signals, the arrangement being such that the right and left digital audio signals in respective two channels which are received by the second radio means are corrected by the control means, and the content of signal processing of the digital audio signals in the two channels which are transmitted by the first transmitting device of the first radio means is modified. Since a signal processing varying signal is transmitted from the second transmitting device of the second radio means to the first receiving device of the first radio means to modify the content of signal processing of the digital audio signals in the two channels which are transmitted by the first transmitting device of the first radio means, the digital audio signals in respective two channels are corrected with respect to the movement of the head of the listener on a real-time basis based on the control signals by way of bi-directional wireless communication, the signals can be corrected by way of bi-directional wireless communication without delaying the signal processing to allow the listener to listen to reproduced sounds as if they were radiated from loudspeakers placed in the virtual sound source positions.

An audio reproduction apparatus according to a ninth invention further comprises correcting means disposed in or out of the main apparatus section as at least a stage subsequent to the control means, for correcting characteristics inherent in the audio reproducing means, the arrangement being such that the characteristics inherent in the audio reproducing means are corrected by the correcting means to correct the audio signals with respect to a movement of the head of the listener on a real-time basis. The listener can correct, with the correcting means and in the vicinity of the audio reproducing means, the characteristics inherent in the audio reproducing means, so that the audio signals can be corrected with respect to a movement of the head of the listener on a real-time basis.

An audio reproduction apparatus according to a tenth invention further comprises resetting means disposed in or out of the main apparatus section as at least a stage subsequent to the control means, for resetting a signal representative of a movement of the head of the listener with respect to a reference direction which movement is detected through each predetermined angle by the angle detecting means, to a signal in a forward direction with respect to the reference direction. The listener can reset, with the resetting means and in the vicinity of the audio reproducing means, a signal representative of a movement of the head of the listener with respect to the reference direction which movement is detected through each predetermined angle by the angle detecting means, so that the audio signals can be corrected with respect to a movement of the head of the listener on a real-time basis.

An audio reproduction apparatus according to an eleventh invention further comprises adding means disposed in or out of the main apparatus section as at least a stage subsequent to the control means, for selecting a sound field and/or a reverberation in which to reproduce the audio signals and adding the selected sound field and/or reverberation to the audio signals. The listener can select, with the adding means and in the vicinity of the audio reproducing means, a sound field and/or a reverberation in which to reproduce the audio signals and add the selected sound field and/or reverberation to the audio signals, so that the audio signals can be corrected with respect to a movement of the head of the listener on a real-time basis.

An audio reproduction apparatus according to a twelfth invention further comprises adjusting means disposed in or out of the main apparatus section as at least a stage subsequent to the control means, for adjusting a sound intensity and/or a balance at the time the audio signals are reproduced. The listener can adjust, with the adjusting means and in the vicinity of the audio reproducing means, a sound intensity and/or a balance at the time the audio signals are reproduced, so that the audio signals can be corrected with respect to a movement of the head of the listener on a real-time basis.

An audio reproduction apparatus according to a thirteenth invention comprises a digital signal source for supplying digital audio signals in a plurality of channels, audio reproducing means disposed in the vicinity of the ears of a listener, for converting digital audio signals from the digital signal source with digital/analog converting means and reproducing the signals, angle detecting means for detecting a movement of the head of the listener with respect to a reference direction through each predetermined angle, address signal converting means for converting an angle detected by the angle detecting means into a digital address signal, first storage means for storing impulse responses measured from virtual sound source positions with respect to a reference direction of the head of the listener to the ears of the listener which are fixed, integrating means for effecting convolutional integration on the digital audio signals in the respective channels from the digital signal source and the impulse responses stored by the first storage means, second storage means for storing control signals representative of measured time differences and level differences of the audio signals from the virtual sound source positions with respect to the reference direction of the heads of a plurality of listeners to the ears of the listeners through each angle which can be recognized by the listeners, a plurality of control means for correcting the digital audio signals with the control signals stored by the second storage means, and supplying the corrected digital audio signals to the audio reproducing means, and a plurality of adding means for adding the digital audio signals in the respective channels which have been subjected with the impulse responses to convolutional integration by the integrating means, as right and left digital audio signals in respective two channels, the arrangement being such that the second storage means is addressed by the digital address signal produced by the address signal converting means to read the control signals stored by the second storage means to correct the digital audio signals which have been subjected with the impulse responses to convolutional integration by the integrating means, with the control signals in the plurality of control means, and add the corrected digital audio signals as right and left digital audio signals in respective two channels with the plurality of adding means, for thereby correcting the right and left digital audio signals in respective two channels with respect to the movement of the head of each of the listeners on a real-time basis based on the control signals. Because the second storage means is addressed by the digital address signal produced by the address signal converting means to read the control signals stored by the second storage means to correct the digital audio signals with the control signals in the plurality of control means, and add the corrected digital audio signals as right and left digital audio signals in respective two channels with the plurality of adding means, the signals can be corrected without delaying the signal processing to allow the listener to listen to reproduced sounds based on the right and left digital audio signals in respective two channels as if they were radiated from loudspeakers placed in the virtual sound source positions.

An audio reproduction apparatus according to a fourteenth invention comprises a digital signal source for supplying digital audio signals in a plurality of channels, audio reproducing means disposed in the vicinity of the ears of a listener, for converting digital audio signals from the digital signal source with digital/analog converting means and reproducing the signals, angle detecting means for detecting a movement of the head of the listener with respect to a reference direction through each predetermined angle, address signal converting means for converting an angle detected by the angle detecting means into a digital address signal, first storage means for storing impulse responses measured from virtual sound source positions with respect to a reference direction of the head of the listener to the ears of the listener which are fixed, integrating means for effecting convolutional integration on the digital audio signals in the respective channels from the digital signal source and the impulse responses stored by the first storage means, adding means for adding the digital audio signals in the respective channels which have been subjected with the impulse responses to convolutional integration by the integrating means, as right and left digital audio signals in respective two channels, second storage means for storing control signals representative of measured time differences and level differences of the audio signals from the virtual sound source positions with respect to the reference direction of the heads of a plurality of listeners to the ears of the listeners through each angle which can be recognized by the listeners, and a plurality of control means for correcting the right and left digital audio signals in respective two channels which have been added by the adding means, with the control signals stored by the second storage means, and supplying the corrected digital audio signals to the audio reproducing means, the arrangement being such that the second storage means is addressed by the digital address signal produced by the address signal converting means to read the control signals stored by the second storage means to correct the right and left digital audio signals in respective two channels which have been added by the adding means, with the control signals in the plurality of control means, for thereby correcting the right and left digital audio signals in respective two channels with respect to the movement of the head of each of the listeners on a real-time basis based on the control signals. Since the second storage means is addressed by the digital address signal produced by the address signal converting means to read the control signals stored by the second storage means to correct the right and left digital audio signals in respective two channels which are added by the adding means, with the control signals in the plurality of control means, the signals can be corrected without delaying the signal processing to allow the listeners to listen to reproduced sounds based on the right and left digital audio signals in respective two channels as if they were radiated from loudspeakers placed in the virtual sound source positions.

An audio reproduction apparatus according to a fifteenth invention comprises a signal source for supplying audio signals in a plurality of channels, storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener, angle detecting means for detecting a movement of the head of the listener with respect to the reference direction through each predetermined angle, address signal converting means for converting an angle detected by the angle detecting means into an address signal, control means for correcting the audio signals in the respective channels from the signal source based on the impulse responses or control signals stored by the storage means, audio reproducing means for reproducing the audio signals corrected by the control means, and setting means disposed as at least a stage subsequent to the control means, for setting playback characteristics at the time the corrected audio signals are reproduced by the audio reproducing means, the arrangement being such that the storage means is addressed by the address signal produced by the address signal converting means to read the impulse responses or control signals stored by the storage means to correct the audio signals with the impulse responses or control signals in the control means, and the corrected audio signals are reproduced with the playback characteristics set by the setting means and are corrected with respect to the movement of the head of the listener on a real-time basis. Since the setting means is disposed as at least a stage subsequent to the control means, for setting playback characteristics at the time the corrected audio signals are reproduced by the audio reproducing means, the listener can correct playback characteristics at the time the corrected audio signals are reproduced, with the setting means and in the vicinity of the audio reproducing means, for correcting the audio signals with respect to a movement of the head of the listener on a real-time basis.

In an audio reproduction apparatus according to a sixteenth invention, the setting means comprises correcting means disposed in or out of the main apparatus section, for correcting characteristics inherent in the audio reproducing means, the arrangement being such that the corrected audio signals are corrected with respect to the characteristics inherent in the audio reproducing means by the correcting means. Since the setting means comprises correcting means disposed in or out of the main apparatus section, for correcting characteristics inherent in the audio reproducing means, the listener can correct playback characteristics at the time the corrected audio signals are reproduced, with the correcting means and in the vicinity of the audio reproducing means, for correcting the audio signals with respect to a movement of the head of the listener on a real-time basis.

In an audio reproduction apparatus according to a seventeenth invention, the setting means comprises resetting means disposed in or out of the main apparatus section, for resetting a signal representative of a movement of the head of the listener with respect to the reference direction which movement is detected through each predetermined angle by the angle detecting means, to a signal in a forward direction with respect to the reference direction, the arrangement being such that a signal representative of a movement of the head of the listener with respect to the reference direction which movement is detected through each predetermined angle by the angle detecting means is reset to a signal in the forward direction with respect to the reference direction. The listener can reset, in the vicinity of the audio reproducing means, a signal representative of a movement of the head of the listener with respect to the reference direction which movement is detected through each predetermined angle by the angle detecting means to a signal in the forward direction with respect to the reference direction, for correcting the audio signals with respect to a movement of the head of the listener on a real-time basis.

In an audio reproduction apparatus according to an eighteenth invention, the setting means comprises adding means disposed in or out of the main apparatus section, for selecting a sound field and/or a reverberation in which to reproduce the audio signals and adding the selected sound field and/or reverberation to the audio signals, the arrangement being such that a sound field and/or a reverberation in which to reproduce the audio signals is selected and added to the audio signals by the adding means. The listener can select, with the adding means and in the vicinity of the audio reproducing means, a sound field and/or a reverberation in which to reproduce the audio signals and add the selected sound field and/or reverberation to the audio signals, for correcting the audio signals with respect to a movement of the head of the listener on a real-time basis.

In an audio reproduction apparatus according to a nineteenth invention, the setting means comprises adjusting means disposed in or out of the main apparatus section, for adjusting a sound intensity and/or a balance at the time the audio signals are reproduced, the arrangement being such that a sound intensity and/or a balance at the time the audio signals are reproduced is adjusted by the adjusting means. The listener can adjust, with the adjusting means and in the vicinity of the audio reproducing means, a sound intensity and/or a balance at the time the audio signals are reproduced, for correcting the audio signals with respect to a movement of the head of the listener on a real-time basis.

An audio reproduction apparatus according to a twentieth invention comprises a signal source for supplying audio signals in a plurality of channels, first radio means for transmitting the audio signals as radio signals and receiving other signals, storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener, angle detecting means for detecting a movement of the head of the listener with respect to the reference direction through each predetermined angle, address signal converting means for converting an angle detected by the angle detecting means into an address signal, second radio means for receiving the audio signals from the first radio means and transmitting other signals, control means for correcting the audio signals in the respective channels from the second radio means based on the impulse responses or control signals stored by the storage means, and audio reproducing means for reproducing the audio signals corrected by the control means, the arrangement being such that the storage means is addressed by the address signal produced by the address signal converting means to read the impulse responses or control signals stored by the storage means to correct the audio signals with the impulse responses or control signals in the control means, and the audio signals are corrected with respect to the movement of the head of the listener on a real-time basis by way of bi-directional wireless communication. The audio signals can thus be corrected with respect to the movement of the head of the listener on a real-time basis by way of bi-directional wireless communication.

An audio reproduction apparatus according to a twenty-first invention further comprises correcting means disposed in or out of the main apparatus section, for correcting characteristics inherent in the audio reproducing means, the arrangement being such that the corrected audio signals are corrected with respect to the characteristics inherent in the audio reproducing means by the correcting means. Since the correcting means is disposed in or out of the main apparatus section, for correcting characteristics inherent in the audio reproducing means, the listener can correct, with the correcting means and in the vicinity of the audio reproducing means, the characteristics inherent in the audio reproducing means, for correcting the audio signals with respect to a movement of the head of the listener on a real-time basis.

An audio reproduction apparatus according to a twenty-second invention further comprises resetting means disposed in or out of the main apparatus section, for resetting a signal representative of a movement of the head of the listener with respect to the reference direction which movement is detected through each predetermined angle by the angle detecting means, to a signal in a forward direction with respect to the reference direction, the arrangement being such that a signal representative of a movement of the head of the listener with respect to the reference direction which movement is detected through each predetermined angle by the angle detecting means is reset to a signal in the forward direction with respect to the reference direction. The listener can reset, with the resetting means and in the vicinity of the audio reproducing means, a signal representative of a movement of the head of the listener with respect to the reference direction which movement is detected through each predetermined angle by the angle detecting means to a signal in the forward direction with respect to the reference direction, for correcting the audio signals with respect to a movement of the head of the listener on a real-time basis.

An audio reproduction apparatus according to a twenty-third invention further comprises adding means disposed in or out of the main apparatus section, for selecting a sound field and/or a reverberation in which to reproduce the audio signals and adding the selected sound field and/or reverberation to the audio signals, the arrangement being such that a sound field and/or a reverberation in which to reproduce the audio signals is selected and added to the audio signals by the adding means. The listener can select, with the adding means and in the vicinity of the audio reproducing means, a sound field and/or a reverberation in which to reproduce the audio signals and add the selected sound field and/or reverberation to the audio signals, for correcting the audio signals with respect to a movement of the head of the listener on a real-time basis.

An audio reproduction apparatus according to a twenty-fourth invention further comprises adjusting means disposed in or out of the main apparatus section, for adjusting a sound intensity and/or a balance at the time the audio signals are reproduced, the arrangement being such that a sound intensity and/or a balance at the time the audio signals are reproduced is adjusted by the adjusting means. The listener can adjust, with the adjusting means and in the vicinity of the audio reproducing means, a sound intensity and/or a balance at the time the audio signals are reproduced, for correcting the audio signals with respect to a movement of the head of the listener on a real-time basis.

An audio reproduction apparatus according to a twenty-fifth invention further comprises correcting means disposed in or out of the main apparatus section as at least a stage subsequent to the control means, for correcting characteristics inherent in the audio reproducing means, resetting means disposed in or out of the main apparatus section as at least a stage subsequent to the control means, for resetting a signal representative of a movement of the head of the listener with respect to the reference direction which movement is detected through each predetermined angle by the angle detecting means, to a signal in a forward direction with respect to the reference direction, adding means disposed in or out of the main apparatus section as at least a stage subsequent to the control means, for selecting a sound field and/or a reverberation in which to reproduce the audio signals and adding the selected sound field and/or reverberation to the audio signals, and adjusting means disposed in or out of the main apparatus section as at least a stage subsequent to the control means, for adjusting a sound intensity and/or a balance at the time the audio signals are reproduced, the arrangement being such that the corrected audio signals are corrected with respect to the characteristics inherent in the audio reproducing means by the correcting means, a signal representative of a movement of the head of the listener with respect to the reference direction which movement is detected through each predetermined angle by the angle detecting means is reset to a signal in the forward direction with respect to the reference direction, a sound field and/or a reverberation in which to reproduce the audio signals is selected and added to the audio signals by the adding means, and a sound intensity and/or a balance at the time the audio signals are reproduced is adjusted by the adjusting means. Inasmuch as the correcting means, the resetting means, the adding means, and the adjusting means are disposed in or out of the main apparatus section as at least a stage subsequent to the control means, the listener can correct, with the correcting means and in the vicinity of the audio reproducing means, the characteristics inherent in the audio reproducing means, reset, with the resetting means and in the vicinity of the audio reproducing means, a signal representative of a movement of the head of the listener with respect to the reference direction which movement is detected through each predetermined angle by the angle detecting means to a signal in the forward direction with respect to the reference direction, select, with the adding means and in the vicinity of the audio reproducing means, a sound field and/or a reverberation in which to reproduce the audio signals and add the selected sound field and/or reverberation to the audio signals, and adjust, with the adjusting means and in the vicinity of the audio reproducing means, a sound intensity and/or a balance at the time the audio signals are reproduced. The audio signals can thus be corrected with respect to the movement of the head of the listener on a real-time basis by way of bi-directional wireless communication.

An audio reproduction apparatus according to a twenty-sixth invention further comprises signal switching means disposed in or out of the main apparatus section as at least a stage subsequent to the control means, for switching the signal source between a digital signal source and an analog signal source and selecting an optional number of channels, the arrangement being such that the signal source is switched between the digital signal source and the analog signal source and an optional number of channels is selected by the switching means. The listener can switch, in the vicinity of the audio reproducing means, the signal source between a digital signal source and an analog signal source and select an optional number of channels, for correcting the audio signals with respect to a movement of the head of the listener on a real-time basis.

In an audio reproduction apparatus according to a twenty-seventh invention, the signal source comprises an analog signal source and first converting means for converting the audio signals outputted from the analog signal source into digital audio signals, wherein the angle detecting means comprises analog angle detecting means and second converting means for converting a detected angle signal outputted from the analog angle detecting means into a detected digital angle signal, and wherein the storage means stores the impulse responses or control signals which have been converted into digital signals, and the audio reproducing means comprises third converting means for converting the digital audio signals into analog audio signals. This arrangement for signal processing is effective to save the capacity of the storage means for increasing the speed of signal processing, for correcting the audio signals with respect to a movement of the head of the listener on a real-time basis.

In an audio reproduction apparatus according to a twenty-eighth invention, the signal source comprises a digital signal source, and the angle detecting means comprises digital angle detecting means, and wherein the storage means digitally stores the impulse responses or control signals which have been converted into digital signals. This arrangement for digital signal processing is effective to save the capacity of the storage means for increasing the speed of signal processing, for correcting the audio signals with respect to a movement of the head of the listener on a real-time basis.

An audio reproduction apparatus according to a twenty-ninth invention comprises a digital signal source for supplying digital audio signals in a plurality of channels, first storage means for storing impulse responses measured from virtual sound source positions with respect to a reference direction of the head of the listener to the ears of the listener which are fixed, integrating means for effecting convolutional integration on the digital audio signals in the respective channels from the digital signal source and the impulse responses stored by the first storage means, adding means for adding the digital audio signals in the respective channels which have been subjected with the impulse responses to convolutional integration by the integrating means, as right and left digital audio signals in respective two channels, transmitting means for transmitting as radio signals the right and left digital audio signals in respective two channels which have been added by the adding means, receiving means for receiving the digital audio signals in respective two channels which are transmitted by the transmitting means, audio reproducing means disposed in the vicinity of the ears of the listener, for converting digital audio signals from the digital signal source into analog audio signals with digital/analog converting means and reproducing the signals, angle detecting means for detecting a movement of the head of the listener with respect to the reference direction through each predetermined angle, address signal converting means for converting an angle detected by the angle detecting means into a digital address signal, second storage means for storing control signals representative of measured time differences and level differences of the audio signals from the virtual sound source positions with respect to the reference direction of the head of the listener to the ears of the listener through each angle which can be recognized by the listener, and control means for correcting the digital audio signals in respective two channels which are received by the receiving means, with the control signals stored by the second storage means, and supplying the corrected digital audio signals to the audio reproducing means, the arrangement being such that the digital audio signals in respective two channels which are transmitted by the transmitting means are received by the receiving means thereby to address the second storage means with the digital address signal produced by the address signal converting means to read the control signals stored by the second storage means to correct the digital audio signals in respective two channels which are received by the receiving means, with the control signals in the control means, for thereby correcting the digital audio signals in respective two channels with respect to the movement of the head of the listener on a real-time basis based on the control signals by way of wireless communication. Since the digital audio signals in respective two channels which are transmitted by the transmitting means are received by the receiving means, and corrected with respect to the movement of the head of the listener on a real-time basis based on the control signals by way of wireless communication, the signals can be corrected by way of wireless communication without delaying the signal processing to allow the listener to listen to reproduced sounds as if they were radiated from loudspeakers placed in the virtual sound source positions.

An audio reproduction apparatus according to a thirtieth invention further comprises digital/analog converting means for converting the digital audio signals in respective two channels which are added by the adding means into analog audio signals, the arrangement being such that the analog audio signals outputted by the digital/analog converting means are supplied to the transmitting means, the analog audio signals transmitted by the transmitting means are received by the receiving means, and the analog audio signals received by the receiving means are corrected by the control means. Since the analog audio signals in respective two channels which are transmitted by the transmitting means are received by the receiving means, and corrected with respect to the movement of the head of the listener on a real-time basis based on the control signals by way of wireless communication, the signals can be corrected by way of wireless communication without delaying the signal processing to allow the listener to listen to reproduced sounds as if they were radiated from loudspeakers placed in the virtual sound source positions.

An audio reproduction apparatus according to thirty-first invention comprises a digital signal source for supplying digital audio signals in a plurality of channels, first storage means for storing impulse responses measured from virtual sound source positions with respect to a reference direction of the head of the listener to the ears of the listener which are fixed, integrating means for effecting convolutional integration on the digital audio signals in the respective channels from the digital signal source and the impulse responses stored by the first storage means, adding means for adding the digital audio signals in the respective channels which have been subjected with the impulse responses to convolutional integration by the integrating means, as right and left digital audio signals in respective two channels, first radio means having a transmitting device for transmitting the as radio signals the right and left digital audio signals in respective two channels which have been added by the adding means, and a receiving device for other signals, second radio means having a second receiving device for receiving the digital audio signals in respective two channels which are transmitted by the first transmitting device of the first radio means, and a second transmitting device for transmitting other signals, audio reproducing means disposed in the vicinity of the ears of the listener, for converting digital audio signals from the digital signal source into analog audio signals with digital/analog converting means and reproducing the signals, angle detecting means for detecting a movement of the head of the listener with respect to the reference direction through each predetermined angle, address signal converting means for converting an angle detected by the angle detecting means into a digital address signal, second storage means for storing control signals representative of measured time differences and level differences of the audio signals from the virtual sound source positions with respect to the reference direction of the head of the listener to the ears of the listener through each angle which can be recognized by the listener, and control means for correcting the digital audio signals in respective two channels which are received by the receiving device of the second radio means, with the control signals stored by the second storage means, and supplying the corrected digital audio signals to the audio reproducing means, the arrangement being such that the digital audio signals in respective two channels which are transmitted by the transmitting device of the first radio means are received by the receiving device of the second radio means thereby to address the second storage means with the digital address signal produced by the address signal converting means to read the control signals stored by the second storage means to correct the digital audio signals in respective two channels which are received by the receiving device of the second radio means, with the control signals in the control means, and a signal processing varying signal is transmitted from the transmitting device of the first radio means to the receiving device of the second radio means to vary the content of signal processing relative to the digital audio signals in respective two channels which are transmitted by the transmitting device of the first radio means, for thereby correcting the digital audio signals in respective two channels with respect to the movement of the head of the listener on a real-time basis based on the control signals by way of bi-directional wireless communication. Since a signal processing varying signal is transmitted from the second transmitting device of the second radio means to the first receiving device of the first radio means to modify the content of signal processing of the digital audio signals in the two channels which are transmitted by the first transmitting device of the first radio means, the digital audio signals in respective two channels are corrected with respect to the movement of the head of the listener oh a real-time basis based on the control signals by way of bi-directional wireless communication, the signals can be corrected by way of bi-directional wireless communication without delaying the signal processing to allow the listener to listen to reproduced sounds as if they were radiated from loudspeakers placed in the virtual sound source positions.

An audio reproduction apparatus according to a thirty-second invention comprises a signal source for supplying audio signals in a plurality of channels, storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener, one or plural angle detecting means for detecting a movement of the head of the listener or the heads of plural listeners with respect to the reference direction through each predetermined angle, address signal converting means for converting an angle detected by the angle detecting means into an address signal, control means for correcting the audio signals in the respective channels from the signal source based on the impulse responses or control signals stored by the storage means, and audio reproducing means disposed in the vicinity of the head of the listener or each of the listeners and directed to the head, for reproducing the audio signals corrected by the control means, the arrangement being such that the storage means is addressed by the address signal produced by the address signal converting means based on a signal depending on the angle from the angle detecting means to read the impulse responses or control signals stored by the storage means to correct the audio signals with the impulse responses or control signals in the control means, the audio signals are corrected with respect to the movement of the head of the listener or each of the listeners on a real-time basis, and the corrected audio signals are reproduced by the audio reproducing means. Since the storage means is addressed by the address signal produced by the address signal converting means based on a signal depending on an angular velocity from the angle detecting means to read the impulse responses or control signals stored by the storage means to correct the audio signals with the impulse responses or control signals in the control means, the audio signals are corrected with respect to the movement of the head of the listener or each of the listeners on a real-time basis, and the corrected audio signals are reproduced by the audio reproducing means, the audio reproducing means can reproduce audio signals that have been corrected depending on the rotation of the head of the listener.

In an audio reproduction apparatus according to a thirty-third invention, the audio reproducing means comprises a plurality of loudspeakers disposed in confronting relation to the ears of the listener. Since the audio reproducing means comprises a plurality of loudspeakers disposed in confronting relation to the ears of the listener, the corrected audio signals can be reproduced by the loud-speakers on a straight line interconnecting the ears of the listener, depending on the rotation of the head of the listener.

In an audio reproduction apparatus according to a thirty-fourth invention, the audio reproducing means comprises a plurality of loudspeakers disposed forward of a straight line interconnecting the ears of the listener. Since the audio reproducing means comprises a plurality of loudspeakers disposed forward of a straight line interconnecting the ears of the listener, the corrected audio signals can be reproduced by the loudspeakers forward of the straight line interconnecting the ears of the listener, depending on the rotation of the head of the listener.

In an audio reproduction apparatus according to a thirty-fifth invention, the audio reproducing means comprises a plurality of loudspeakers disposed rearward of a straight line interconnecting the ears of the listener. Since the audio reproducing means comprises a plurality of loudspeakers disposed rearward of a straight line interconnecting the ears of the listener, the corrected audio signals can be reproduced by the loudspeakers rearward of the straight line interconnecting the ears of the listener, depending on the rotation of the head of the listener.

In an audio reproduction apparatus according to a thirty-sixth invention, the angle detecting means comprises a vibratory gyro mounted on the head of the listener. Inasmuch as the angle detecting means comprises a vibratory gyro mounted on the head of the listener, a detected rotation signal is generated by the vibratory gyro, and the audio signals corrected depending on the rotation of the head of the listener can be reproduced by the audio reproducing means.

In an audio reproduction apparatus according to a thirty-seventh invention, the angle detecting means comprises an ultrasonic transmission/reception device disposed in the vicinity of the head of the listener. Because the angle detecting means comprises an ultrasonic transmission/reception device disposed in the vicinity of the head of the listener, the audio signals corrected depending on the rotation of the head of the listener based on a reflected ultrasonic wave can be reproduced by the audio reproducing means.

In an audio reproduction apparatus according to a thirty-eighth invention, the angle detecting means comprises a non-contact rotation sensor disposed in the vicinity of the head of the listener. Since the angle detecting means comprises a non-contact rotation sensor disposed in the vicinity of the head of the listener, the audio signals corrected depending on the rotation of the head of the listener based on a reflected infrared radiation can be reproduced by the audio reproducing means.

In an audio reproduction apparatus according to a thirty-ninth invention, the angle detecting means comprises a camera disposed in the vicinity of the head of the listener. Because the angle detecting means comprises a camera disposed in the vicinity of the head of the listener, the audio signals corrected depending on the rotation of the head of the listener based on image recognition by the camera can be reproduced by the audio reproducing means.

An audio reproduction apparatus according to a fortieth invention comprises a signal source for supplying audio signals in a plurality of channels, channel number converting means for converting the number of channels into another number of channel different from the number of channels depending on the number of channels for the audio signals, storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener, one or plural angle detecting means for detecting a movement of the head of the listener or the heads of plural listeners with respect to the reference direction through each predetermined angle, address signal converting means for converting an angle detected by the angle detecting means into an address signal, control means for correcting the audio signals in the respective channels from the signal source based on the impulse responses or control signals stored by the storage means, and audio reproducing means mountable on the head of the listener or each of the listeners for reproducing the audio signals corrected by the control means, the arrangement being such that the storage means is addressed by the address signal produced by the address signal converting means based on a signal depending on the angle from the angle detecting means to read the impulse responses or control signals stored by the storage means to correct the audio signals in the other number of channel different from the number of channels which has been converted by the channel number converting means, with the impulse responses or control signals in the control means, the audio signals are corrected with respect to the movement of the head of the listener or each of the listeners on a real-time basis, and the corrected audio signals are reproduced by the audio reproducing means. In this arrangement, the storage means is addressed by the address signal produced by the address signal converting means based on a signal depending on the angle from the angle detecting means to read the impulse responses or control signals stored by the storage means to correct the audio signals in the other number of channel different from the number of channels which has been converted by the channel number converting means, with the impulse responses or control signals in the control means, the audio signals are corrected with respect to the movement of the head of the listener or each of the listeners on a real-time basis, and the corrected audio signals are reproduced by the audio reproducing means such that a reproduced sound image is localized.

In an audio reproduction apparatus according to a forty-first invention, the channel number converting means comprises a decoder for converting the number of channels into another number of channels smaller than the number of channels depending on the number of channels for the audio signals. Since the channel number converting means comprises a decoder for converting the number of channels into another number of channels smaller than the number of channels depending on the number of channels for the audio signals, a reproduced sound image can be localized in a smaller number of channels.

In an audio reproduction apparatus according to a forth-second invention, the channel number converting means comprises a decoder for converting the number of channels into another number of channels smaller than the number of channels depending on the number of channels for the audio signals to modify a simulation of the type of loudspeakers for reproducing the audio signals, depending on the other number of channels. Since the channel number converting means comprises a decoder for converting the number of channels into another number of channels smaller than the number of channels depending on the number of channels for the audio signals to modify a simulation of the type of loudspeakers for reproducing the audio signals, depending on the other number of channels, the simulation of the type of loudspeakers can be varied to localize a reproduced sound image as if it were reproduced by different loudspeakers.

In an audio reproduction apparatus according to a forty-third invention, the channel number converting means comprises a decoder for converting the number of channels into another number of channels smaller than the number of channels depending on the number of channels for the audio signals to modify a simulation of the distance of loudspeakers for reproducing the audio signals, depending on the other number of channels. Because, the channel number converting means comprises a decoder for converting the number of channels into another number of channels smaller than the number of channels depending on the number of channels for the audio signals to modify a simulation of the distance of loudspeakers for reproducing the audio signals, depending on the other number of channels, the simulation of the distance of loudspeakers can be varied to localize a reproduced sound image as if it were reproduced at a different distance.

In an audio reproduction apparatus according to a forty-fourth invention, the channel number converting means comprises an encoder for converting the number of channels into another number of channels greater than the number of channels depending on the number of channels for the audio signals. Since the channel number converting means comprises an encoder for converting the number of channels into another number of channels greater than the number of channels depending on the number of channels for the audio signals, the number of channels can be increased to localize a reproduced sound image.

In an audio reproduction apparatus according to a forth-fifth invention, the channel number converting means comprises an encoder for converting the number of channels into another number of channels greater than the number of channels depending on the number of channels for the audio signals, the encoder having positional information corresponding to the other number of channels for modifying a simulation of the type of loudspeakers for reproducing the audio signals. Since the channel number converting means comprises an encoder for converting the number of channels into another number of channels greater than the number of channels depending on the number of channels for the audio signals, the encoder having positional information corresponding to the other number of channels for modifying a simulation of the type of loudspeakers for reproducing the audio signals, a reproduced sound image can be localized in order to simulate an arrangement of loudspeakers with the positional information possessed by the encoder.

BRIEF DESCRIPTION OF THE DRAWINGS

FIG. 4 is a table of impulse responses in the audio reproduction apparatus according to the embodiment of the present invention;

FIG. 7 is a table of control signals in the audio reproduction apparatus according to the other embodiment of the present invention;

BEST MODE FOR CARRYING OUT THE INVENTION

An audio reproduction apparatus according to an embodiment of the present invention will hereinafter be described in detail with reference to FIGS. 1 through 5.

The audio reproduction apparatus according to the present embodiment allows a listener to perceive sound images with the same localization, sound field, etc. when audio signals are reproduced with headphones, as if they were reproduced by loudspeakers located in a predetermined positional relationship.

Specifically, the audio reproduction apparatus according to the present embodiment is used in a system for reproducing, with headphones, a multichannel audio signal that has been recorded in a stereophonic mode or the like. Particularly, the audio reproduction apparatus is used for reproducing, with headphones, digital audio signals recorded or transmitted in respective channels with a view to localizing respective sound images in a predetermined positional relationship (e.g., at right, left, and central positions in front of the listener, and other positions).

First, a movement of the head of the listener with respect to a reference direction is detected through each constant angle or predetermined angle, and converted into a digital address signal representing a magnitude of the movement including its direction. The address signal is used to read, from a memory, digitally recorded impulse responses from virtual sound source positions with respect to the reference direction to the ears of the listener. The digital audio signal of each channel and the impulse signal thereof are subjected to convolutional integration for real-time correction and modification. In this manner, the audio reproduction apparatus can produce such a reproducing effect as if reproduced sounds were radiated from loudspeakers located in the virtual sound source positions.

Figure 1:
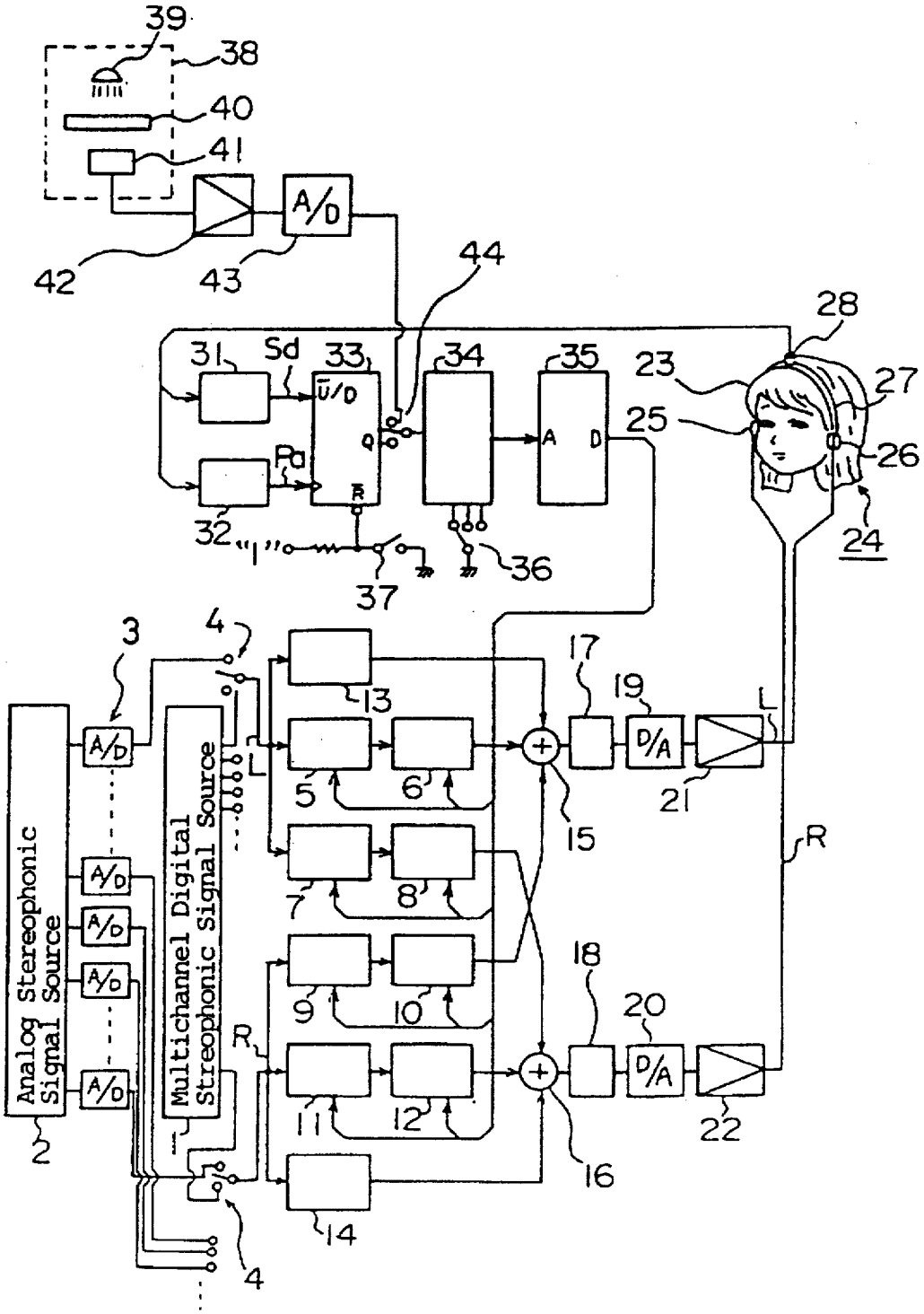
FIG. 1 is a block diagram of an audio reproduction apparatus according to an embodiment of the present invention.

As shown in FIG. 1, a multichannel digital stereophonic signal source 1 may be a digital audio disc (e.g., a compact disc), a digital satellite broadcasting system, and so on. An analog stereophonic signal source 2 may be an analog record, an analog broadcasting system, and so on. Analog signals from the analog stereophonic signal source 2 are converted into digital signals by as many A/D converters 3 as the number of channels if the analog signals are multi-channel analog signals. Selectors 4 select either signals which have been inputted as digital signals or signals which have been inputted as analog signals, as digital signals represented by a constant sampling frequency and a constant number of quantizing bits. While two-channel selectors 4 are shown in FIG. 1, as many selectors 4 may be provided as the number of channels if the supplied signals are multi-channel signals.

A left digital signal L of the digital signal series is supplied to a convolutional integrator 5. In the convolutional integrator 5, the left digital signal L is subjected to convolutional integration together with a set of digitally recorded impulse responses, called to a memory 6 associated with the convolutional integrator 5, from a virtual sound source position to the ears of a listener 23 in the direction in which the head of the listener 23 presently faces with respect to a reference direction of the head, the impulse responses being represented by a constant sampling frequency and a constant number of quantizing bits. A convolutional integrator 7 and a memory 8 supply a crosstalk component of a right digital signal R.

The right digital signal R is supplied to a convolutional integrator 11. In the convolutional integrator 11, the right digital signal R is subjected to convolutional integration together with a set of digitally recorded impulse responses, called to a memory 12 associated with the convolutional integrator 11, from a virtual sound source position to the ears of the listener 23 in the direction in which the head of the listener 23 presently faces with respect to the reference direction of the head, the impulse responses being represented by a constant sampling frequency and a constant number of quantizing bits. A convolutional integrator 9 and a memory 10 supply a crosstalk component of the left digital signal L.

The results of the convolutional integration effected on the audio signals and the impulse responses on a real-time basis by the convolutional integrator 5 and the memory 6 and the convolutional integrator 9 and the memory 10 are supplied to an adder 15 and added to each other. The results of the convolutional integration effected on the impulse responses on a real-time basis by the convolutional integrator 7 and the memory 8 and the convolutional integrator 11 and the memory 12 are supplied to an adder 16 and added to each other. At this time, reverberation signals produced by reverberation circuits 13, 14 are applied to the adders 15, 16.

The results produced by the convolutional integration and added by the adders 15, 16 are corrected by correcting circuits 17, 18 to remove therefrom characteristics inherent in sound sources and headphones which are used, and then converted by respective D/A converters 19, 20 into analog signals, which are amplified by power amplifiers 21, 22 and supplied to headphones 24 worn by the listener 23. The listener 23 is allowed to listen to reproduced sounds from right and left sound generators 25, 26 of the headphones 24.

The impulse responses which are convoluted by the convolutional integrator 5 contain convoluted corrective characteristics inherent in the sound sources and convoluted corrective characteristics inherent in the headphones which sound sources and headphones have been used to measure the impulse responses from the virtual sound source positions to the ears of the listener 23. Therefore, after the impulse responses are convoluted by the convolutional integrator 5, it is not necessary to correct them for the sound sources and headphones used to measure the impulse responses. Since the impulse responses containing the above corrective characteristics are convoluted at one time, the signals can be processed on a real-time basis.

When the audio signals and the set of digitally recorded impulse responses from the virtual sound source positions to the ears of the listener 23 with respect to the reference direction are subjected to convolutional integration in the convolutional integrators 5, 7, 9, 11 and the memories 6, 8, 10, 12, as described above, the impulses responses contain convoluted impulses responses of either one or both of the convoluted corrective characteristics inherent in the sound sources and the headphones that have been used to measure the impulse responses. Consequently, a real-time convolutional process including simultaneous correction can be carried out.

Figure 2:
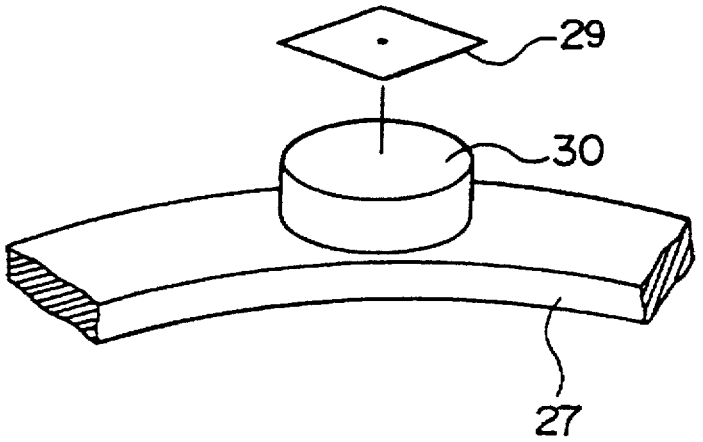
FIG. 2 is a view of a digital angle detecting means of the audio reproduction apparatus according to the embodiment of the present invention.

The movement of the head of the listener 23 is detected by a digital angle detector 28. Details of the digital angle detector 28 are shown in FIG. 2. In FIG. 2, the digital angle detector 28 detects an angle using a horizontal component of geomagnetism, and produces a detected angle signal as a digital signal.

A movement of the head of the listener 23 with respect to the reference direction is picked up as discrete information through each constant angle or predetermined angle. In an example of detecting such a movement of the head of the listener 23 as discrete information, a rotary encoder 30 with a vertical input shaft is mounted in a central position on the head, and a magnetic needle 29 is coupled to the vertical input shaft thereof. The rotary encoder 30 produces an output signal representative of a movement of the head including the direction of the listener 23, with reference to the meridional direction pointed by the magnetic needle 29. The rotary encoder 30 is mounted on a head band 27 of the headphones 24. However, the rotary encoder 30 may be mounted on an attachment device independent of the head band 27.

An output signal from the encoder of the digital angle detector 28 is supplied to detecting circuits 31, 32. The detecting circuit 31 outputs a directional signal Sd which changes to "0" when the listener 23 turns the head clockwise and to "1" when the listener 23 turns the head counterclockwise. The detecting circuit 32 outputs a number of pulses Pa proportional to the angle through which the listener 23 varies the direction of the head, e.g., outputs a pulse Pa each time the listener 23 varies the direction of the head by 2°.

At the time the signal Sd is supplied to a count direction input terminal U/D of an up/down counter 33, the pulses Pa are supplied to a clock input terminal (count input) CK of the up/down counter 33. The up/down counter 33 produces a count output signal that is converted into a digital address signal representative of the direction and the magnitude of turning movement of the head of the listener 23. The digital address signal is supplied through an address control circuit 34 as an address signal to a memory 35.

In response to the supplied address signal, the memory 35 reads, from corresponding addresses of a table therein, digitally recorded impulse responses from the virtual sound source positions with respect to the reference direction to the ears of the listener 23. At the same time, digital audio signals in the respective channels which are loaded into the memories 6, 8, 10, 12 associated respectively with the convolutional integrators 5, 7, 9, 11 and the impulse responses are subjected to convolutional integration, thus correcting the signals with respect to the direction in which the head of the listener 23 is now oriented, on a real-time basis. The impulse responses recorded in the memory 35 include convoluted corrective characteristics inherent in the sound sources and convoluted corrective characteristics inherent in the headphones which sound sources and headphones have been used to measure the impulse responses from the virtual sound source positions to the ears of the listener 23.

Figure 3:
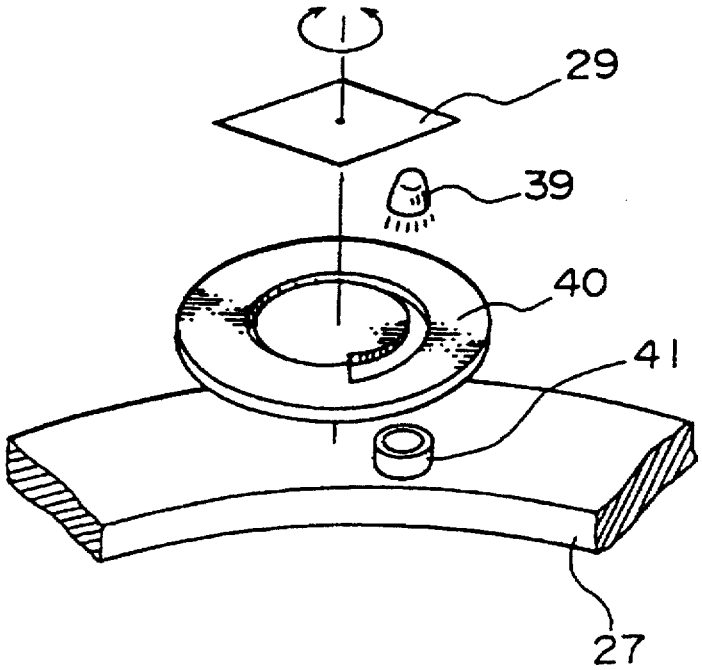
FIG. 3 is a view of an analog angle detecting means of the audio reproduction apparatus according to the embodiment of the present invention.

An analog angle detector 38 is shown in detail in FIG. 3. In FIG. 3, the analog angle detector 38 produces a detected angle output signal as an analog signal. The analog angle detector 38 includes a light detector 41 positioned on the center of the head of the listener 23, the light detector 41 comprising a light-detecting element, such as a CDS, a photodiode, or the like, whose resistance is varied by the intensity of light applied. The analog angle detector 38 also has a light emitter 39 such as a lamp, a light-emitting diode, or the like disposed in confronting relation to the light detector 41. The light emitter 39 emits light having a constant intensity toward the light detector 41.

A movable shutter 40 which varies its transmittance capability with respect to applied light depending on the angle by which it rotates is disposed in the path of light emitted from the light emitter 39. The movable shutter 40 is rotatable with a magnetic needle 29. Therefore, when a constant current is supplied to the light detector 41, the light detector 41 produces a voltage across the light-detecting element as an analog output signal that represents a movement of the head including the direction of the listener 23, with reference to the meridional direction pointed by the magnetic needle 29. The analog angle detector 38 is mounted on the head band 27 of the headphones 24. However, the analog angle detector 38 may be mounted on an attachment device independent of the head band 27.

An analog output signal from the analog angle detector 38 is amplified by an amplifier 42 and then applied to an A/D converter 43. The A/D converter 43 supplies a digital output signal through a switch 44 to the address control circuit 34. The address control circuit 34 generates a digital address signal representing the magnitude of the movement of the head of the listener 23 including the direction through each constant angle or predetermined angle, with respect to the reference direction, and supplies the digital address signal as an address signal to the memory 35.

In response to the supplied address signal, the memory 35 reads, from corresponding addresses of the table therein, digitally recorded impulse responses from the virtual sound source positions with respect to the reference direction to the ears of the listener 23, including one or both of convoluted corrective characteristics inherent in the sound sources and convoluted corrective characteristics inherent in the headphones which sound source and headphones have been used to measure the impulse responses. The read impulse responses are simultaneously loaded into the memories 6, 8, 10, 12 associated respectively with the convolutional integrators 5, 7, 9, 11. These impulse responses and the digital audio signals in the channels are subjected to convolutional integration, thus correcting the signals with respect to the direction in which the head of the listener 23 is now oriented, on a real-time basis.

Figure 5:
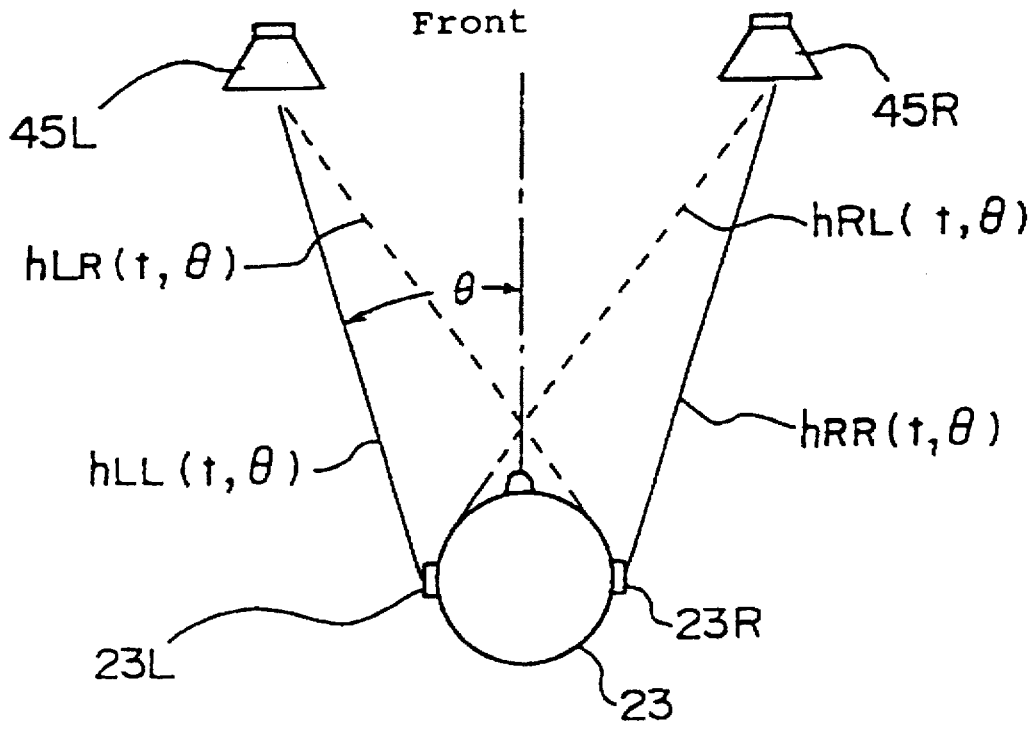
FIG. 5 is a diagram showing the manner in which impulse responses in the audio reproduction apparatus according to the embodiment of the present invention are measured.

FIG. 4 shows by way of example data stored in the table in the memory 35. If front left and right loudspeakers 45L, 45R are positioned in front of the listener 23, as shown in FIG. 5, impulse responses from the positions of the loudspeakers 45L, 45R to the ears of the listener 23 are assumed to be indicated respectively by:

$$h_{LL}(t,\theta) = 1/(2\pi)\int_{-\infty}^{\infty} H_{LL}(\omega,\theta)\cdot\exp(j\omega,t)d\omega \quad (1)$$

$$h_{LR}(t,\theta) = 1/(2\pi)\int_{-\infty}^{\infty} H_{LR}(\omega,\theta)\cdot\exp(j\omega,t)d\omega \quad (2)$$

$$h_{RL}(t,\theta) = 1/(2\pi)\int_{-\infty}^{\infty} H_{RL}(\omega,\theta)\cdot\exp(j\omega,t)d\omega \quad (3)$$

$$h_{RR}(t,\theta) = 1/(2\pi)\int_{-\infty}^{\infty} H_{RR}(\omega,\theta)\cdot\exp(j\omega,t)d\omega \quad (4)$$

Since the sound sources are loudspeakers having inherent characteristics, the impulse response h(t, θ) in view of the directivity of the sound sources used are represented by:

$$h(t,\theta)=h_s(t,\theta) \quad (5).$$

The impulse response h(t) inherent in the headphones that are used which has been measured by the dummy head microphones that have measured the impulse responses from virtual sound source positions with respect to the reference direction to the ears of the listener, is represented by:

$$h(t)=h_h(t) \quad (6).$$

Therefore, the table of impulse responses stored in the memory 35 have recorded therein impulse responses $f_{IJ}(t,\theta)$ in which inverted characteristics of one or both of the above impulse responses, $h_s(t,\theta)^{-1}$, $h_h(t)^{-1}$ are subjected to convolutional integration and corrected (where IJ=LL, LR, RL, RR, . . . ).

Consequently, when sound sources having inherent characteristics (impulse responses) $h_{sIJ}(t,\theta)$ in view of the directivity are used to measure the impulse responses from virtual sound source positions with respect to the reference direction to the ears of the listener, the impulse responses $f_{IJ}(t,\theta)$ recorded in the table of impulse responses stored in the memory 35 are represented by:

$$f_{IJ}(t,\theta)=h_{IJ}(t,\theta)*h_{sIJ}(t,\theta)^{-1} \quad (7).$$

When headphones having inherent characteristics $h_h(t)$ are used, the impulse responses $f_{IJ}(t,\theta)$ recorded in the table of impulse responses stored in the memory 35 are represented by:

$$f_{IJ}(t,\theta)=h_{IJ}(t,\theta)*h_h(t)^{-1} \quad (8).$$

When sound sources having inherent characteristics (impulse responses) $h_{sIJ}(t,\theta)$ and headphones having inherent characteristics $h_h(t)$ are used, the impulse responses $f_{IJ}(t,\theta)$ recorded in the table of impulse responses stored in the memory 35 are represented by:

$$f_{IJ}(t,\theta)=h_{IJ}(t,\theta)*h_{sIJ}(t,\theta)^{-1}*h_h(t)^{-1} \quad (9).$$

Simultaneously, these impulse responses are corrected.

In the above equations, $h_{IJ}(t,\theta)$: the impulse response from a sound source position I to an ear J;

θ: the angle formed between the sound source position I and the head;

$H_{IJ}(\omega, \theta)$: the transfer function from the sound source position I to the ear J;

$\omega$: the angular frequency ($2\pi f$, f: the frequency).

The sound sources for measuring the impulse responses may be loudspeakers.

Positions where sounds are picked up in the ears of the listener 23 may be anywhere from the inlets of the external canals thereof to the ear drums thereof.

However, the positions for picking up sounds are required to be equal to the positions for determining corrective characteristics, described later, to cancel out the inherent characteristics of the headphones 24.

The above impulse responses that are digitally recorded when the angle $\theta$ is varied by a unit angle, e.g., 2°, are rewritten at respective addresses in the memory 35. The unit angle is selected to be large enough to recognize, with the ears, the angle through which the listener 23 turns the head. The memory 23 stores three such tables which contain data corresponding to different head and auricle shapes of listeners 23 and characteristics of headphones 24 that are to be used. One of the three tables is selected by a selector 36 of the address control circuit 34.

In FIG. 1, when a reset switch 37 is turned on, the count of the up/down counter 33 is reset to "all 0", and the address $\theta=0$ is selected in the table of the memory 35.

The audio reproduction apparatus according to this embodiment is arranged as described above, and operates as follows: Digital audio signals in the respective channels from the multichannel digital stereophonic signal source 1, or digital audio signals in the respective channels which are converted by the A/D converters 3 from analog signals that are inputted to the analog stereophonic signal source 2 are selected by the selectors 4, and converted into digital signals for the respective ears which bear spatial information representative of a sound field by the convolutional integrators 5, 7, 9, 11, the memories 6, 8, 10, 12, and the adders 15, 16. The signals are amplified by the power amplifiers 21, 22 and then supplied to the headphones 24.

When the listener 23 moves the head, if the digital angle detector 28 is used, the digital angle detector 28 produces signals Sd, Pa depending on the orientation of the head of the listener 23, and the up/down counter 33 produces a count depending on the orientation of the head of the listener 23. The count is supplied through the address control circuit 34 as an address signal to the memory 35. From the memory 35 are read digitally recorded impulse responses from the virtual sound source positions with respect to the reference direction of the head of the listener 23 corresponding to the orientation of the head to the ears of the listener 23, among the data in the table shown in FIG. 4. The data thus read from the memory 35 are supplied to the convolutional integrators 5, 7, 9, 11 and the memories 6, 8, 10, 12.

If the analog angle detector 38 for detecting the rotation of the head is used, then an output signal from the analog angle detector 38 is amplified by the amplifier 42 and then converted into a digital signal depending on the orientation of the head of the listener 23 by the A/D converter 43. The digital signal is supplied through the through the address control circuit 34 as an address signal to the memory 35. From the memory 35 are read digitally recorded impulse responses from the virtual sound source positions with respect to the reference direction of the head of the listener 23 corresponding to the orientation of the head to the ears of the listener 23, among the data in the table shown in FIG. 4. The data thus read from the memory 35 are supplied to the convolutional integrators 5, 7, 9, 11 and the memories 6, 8, 10, 12. The impulse responses contain convoluted impulses responses of either one or both of the convoluted corrective characteristics inherent in the sound sources and the headphones that have been used to measure the impulse responses. Consequently, the signals can be processed on a real-time basis because the convolution of the impulse responses containing these corrective data is carried out at one time.

Since the audio signals L, R thus supplied to the headphones 24 have been subjected to convolutional integration with the digitally recorded impulse responses from the virtual sound source positions with respect to the reference direction of the head of the listener 23 corresponding to the orientation of the head to the ears of the listener 23, the audio signals L, R are capable of generating a sound field as if it were reproduced by a plurality of loudspeakers placed in the virtual sound source positions.

Inasmuch as the table of the memory 35 is used when the characteristics of the audio signals supplied to the headphones 24 are varied depending on the orientation of the head of-the listener 23, the characteristics of the audio signals can be varied at small intervals depending on the orientation of the head of the listener 23 to achieve optimum characteristics.

Because impulse responses digitally recorded in the table of the memory 35 are read and supplied purely electronically to the convolutional integrators 5, 7, 9, 11 and the memories 6, 8, 10, 12, no time delay is introduced in varying the characteristics of the audio signals depending on the orientation of the head of the listener 23, and hence no unnatural sound reproduction will result.

At this time, reverberation signals produced by the reverberation circuits 13, 14 are applied to the head phones 24. Consequently, a spatial impression as in a listening room or a concert hall is added to give an excellent stereophonic sound field.

The memory 35 has a plurality of tables for the listener 23 to choose from with the selector 36 to achieve optimum characteristics irrespective of different head and auricle configurations of a different listener 23 and different characteristics of different headphones 24 used. Changes that occur in the digitally recorded impulse responses from the virtual sound source positions with respect to the reference direction of the head of the listener 23 corresponding to the orientation of the head to the ears of the listener 23 when the angle $\theta$ varies may be set so as to be greater or smaller than standard values by a table. Therefore, since changes in the position of the sound image with respect to the orientation of the head of the listener 23 differ from each other, the perception of the distance from the listener 23 to the sound image can be varied based on those greater or smaller changes.

The added reverberation signals produced by the reverberation circuits 13, 14 produce sounds which the listener 23 hears as if reflected or reverberated from hall walls. Therefore, the listener 23 can listen to the reproduced sounds with such a presence as attained if the listener 23 were listening to music sounds in a famous concert hall.

The data shown in FIG. 4 can be obtained as follows: As many impulse sound sources as the number of channels and dummy head microphones are set in given positions in a suitable room so that a preferable sound field will be reproduced by the headphones 24. The sound sources for measuring impulses may be loudspeakers.

While positions where sounds are picked up in the ears of the listener 23 may be anywhere from the inlets of the external canals thereof to the ear drums thereof, the positions for picking up sounds are required to be equal to the positions for determining corrective characteristics, described later, to cancel out the inherent characteristics of the headphones 24.

Impulse responses can be measured by radiating impulse sounds from the loudspeakers in the respective channels and picking up the radiated impulse sounds with microphones on the ears of the dummy head at each of constant angles $\Delta\theta$. since one set of impulse responses is obtained per channel at a certain angle $\theta 1$, if the signal source has five channels, then five sets of impulse responses and hence ten impulse responses are obtained per angle.

A method of determining corrective characteristics for canceling out inherent characteristics of the headphones is as follows: The same dummy head microphones as used to pick up impulse responses of a sound field are mounted on a dummy head, and impulse responses between the microphones on the ears of the dummy head and impulse responses of their inverted characteristics are calculated from input signals from the headphones.

Alternatively, the corrective characteristics may be directly determined according to an adaptive process such as an LMS algorithm or the like. The inherent characteristics of the headphones are specifically corrected by either effecting convolutional integration on impulse responses representative of the determined corrective characteristics in a time domain or passing data after converted into analog data through an analog filter of inverted characteristics, anywhere from the time when the audio input signals are applied to the time when the signals are supplied to the headphones.

Though only the orientation of the head of the listener 23 in a horizontal plane has been described above, signals may be processed in the same manner as described above for the orientation of the head of the listener 23 in a vertical plane and a plane perpendicular to the vertical plane.

The data stored in the table may be limited to a general range of orientations of the head of the listener 23. The angle $\theta$ may be varied through different unit angles depending on the orientation of the head of the listener 23. For example, each unit angle may be 0.5° in the vicinity of $\theta=0°$, and 3° in the range of $|\theta>45°|$. As described above, the unit angle may be large enough for the listener to recognize the angle through which the listener 23 turns the head. The headphones 24 may be replaced with loudspeakers that are positioned near the respective ears of the listener 23.

The audio reproduction apparatus according to the above embodiment is capable of processing both digitally recorded or transmitted signals and signals recorded or transmitted in an analog manner that are picked up in a multichannel stereophonic mode. The angular detecting means for detecting the movement of the head of the listener 23 may be either an angle detector for outputting a digital signal or an angle detector for outputting an analog signal.

In the above embodiment, when the characteristics of audio signals supplied to the headphones 24 are varied in synchronism with the movement of the head of the listener 23, the characteristics are varied not continuously with the movement of the head of the listener 23, but by reading data from the table of the memory 35 in each unit angle sufficient and required for human beings to recognize or in each predetermined angle based on the auditory characteristics of human beings. Therefore, only calculations effected to produce changes that are sufficient and required with respect to the movement of the head of the listener 23 are as effective as calculations for varying the characteristics continuously. Thus, the storage capacity of the memory 35 can be saved, and no high-speed calculations more than necessary are required for processing data.

Inasmuch as binaural characteristics from fixed sound sources are obtained in a fixed direction at all times regardless of the rotation of the head of the listener 23, the listener 23 is given a highly natural sense of localization.

Furthermore, the characteristics represented by digitally recorded impulse responses are controlled by purely electronic convolutional integration in the convolutional integrators 5, 7, 9, 11 and the memories 6, 8, 10, 12 according to the table of the memory 35. Therefore, the characteristics suffer less degradation, and the characteristics of the audio signals upon movement of the head of the listener 23 are varied with no time delay. Accordingly, the listener 23 is prevented from feeling the reproduced sounds as unnatural unlike the conventional systems.

The memory 35 has a plurality of tables for the listener 23 to choose from with the selector 36 to achieve optimum characteristics irrespective of different head and auricle configurations of a different listener 23 and different characteristics of different headphones 24 used.

Changes that occur in the digitally recorded impulse responses from the virtual sound source positions with respect to the reference direction of the head of the listener 23 corresponding to the orientation of the head to the ears of the listener 23 when the angle $\theta$ varies may be set so as to be greater or smaller than standard values by a table. Therefore, since changes in the position of the sound image with respect to the orientation of the head of the listener 23 differ from each other, the perception of the distance from the listener 23 to the sound image can be varied based on those greater or smaller changes.

Since suitable reverberation signals are added by the reverberation circuits 13, 14, the listener 23 can listen to the reproduced sounds with such a presence as attained if the listener 23 were listening to music sounds in a famous concert hall.

According to the present invention, addresses of storage means are indicated by digital address signals from address signal converting means to read digitally recorded impulse responses containing convoluted corrective characteristics inherent in the sound sources and convoluted corrective characteristics inherent in the headphones from the storage means. Since digital acoustic signals are corrected on a real-time basis with respect to the movement of the head of the listener based on the impulse responses thus read, the headphones and the sound sources that have been used to measure the impulse responses can be corrected without delaying the signal processing.

An audio reproduction apparatus according to another embodiment of the present invention will hereinafter be described in detail with reference to FIGS. 6 through 10. The audio reproduction apparatus according to this embodiment includes arrangements that are identical to those shown in FIGS. 2 through 5, and hence those arrangements will not be described below.

The audio reproduction apparatus according to this embodiment allows not only a listener but also a plurality of listeners to perceive sound images with the same localization, sound field, etc. when audio signals are reproduced simultaneously with headphones, as if they were reproduced by loudspeakers located in a predetermined positional relationship.

Specifically, the audio reproduction apparatus according to this embodiment is used in a system for reproducing, with headphones, a multichannel audio signal that has been recorded in a stereophonic mode or the like. Particularly, the audio reproduction apparatus is used for reproducing, with headphones, digital audio signals recorded or transmitted in respective channels with a view to localizing respective sound images in a predetermined positional relationship (e.g., at right, left, and central positions in front of the listener, and other positions).

First, a movement of the head with respect to a reference direction is detected through each constant angle or predetermined angle, and converted into a digital address signal representing a magnitude of the movement including its direction. The address signal is used to read, from a memory, digitally recorded control signals from virtual sound source positions with respect to the reference direction to the ears of the listener. The digital audio signals in the respective channels which have been subjected with impulse responses to convolutional integration and the control signals are corrected and modified. In this manner, the audio reproduction apparatus can produce such a reproducing effect as if reproduced sounds were radiated from loudspeakers located in the virtual sound source positions.

Figure 6:
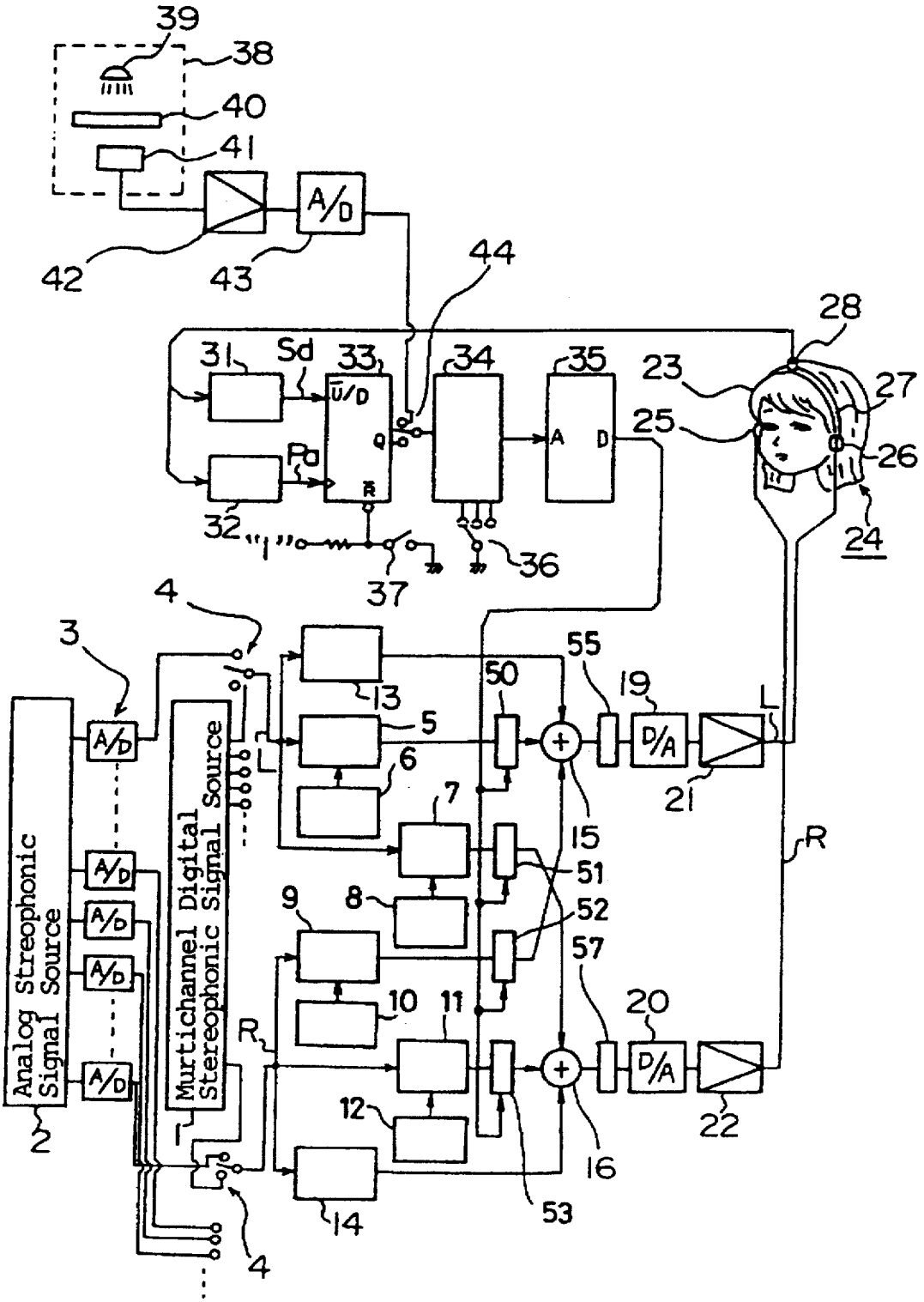
FIG. 6 is a block diagram of an audio reproduction apparatus according to another embodiment of the present invention.

As shown in FIG. 6, a multichannel digital stereophonic signal source 1 may be a digital audio disc (e.g., a compact disc), a digital satellite broadcasting system, and so on. An analog stereophonic signal source 2 may be an analog record, an analog broadcasting system, and so on. Analog signals from the analog stereophonic signal source 2 are converted into digital signals by as many A/D converters 3 as the number of channels if the analog signals are multichannel analog signals. Selectors 4 select either signals which have been inputted as digital signals or signals which have been inputted as analog signals, as digital signals represented by a constant sampling frequency and a constant number of quantizing bits. While two-channel selectors 4 are shown in FIG. 6, as many selectors 4 may be provided as the number of channels if the supplied signals are multichannel signals.

A left digital signal L of the digital signal series is supplied to a convolutional integrator 5. The convolutional integrator 5 is associated with a memory 6 which stores a set of digitally recorded impulse responses that are represented by a constant sampling frequency and a constant number of quantizing bits from a virtual sound source position to the ears of a listener 23, with respect to the head of the listener 23 which is fixed with respect to a reference direction of the head. In the convolutional integrator 5, the digital signal series is subjected with the impulse responses read from the memory 6 to convolutional integration on a real-time basis.

Then, in a controller 50, the digital signal series that has been subjected to the convolutional integration is corrected on a real time basis by a control signal which represents a time difference and a level difference between the ears of the listener 23 from the virtual sound source position to the ears in the direction in which the head of the listener 23 presently faces with respect to the reference direction of the head. A convolutional integrator 7 and a memory 8 supply a crosstalk component of a right digital signal R.

The right digital signal R is supplied to a convolutional integrator 11. The convolutional integrator 11 is associated with a memory 12 which stores a set of digitally recorded impulse responses that are represented by a constant sampling frequency and a constant number of quantizing bits from a virtual sound source position to the ears of the listener, with respect to the head of the listener 23 which is fixed with respect to a reference direction of the head. In the convolutional integrator 11, the digital signal series is subjected with the impulse responses read from the memory 12 to convolutional integration on a real-time basis.

Then, in a controller 53, the digital signal series that has been subjected to the convolutional integration is corrected on a real time basis by a control signal which represents a time difference and a level difference between the ears of the listener 23 from the virtual sound source position to the ears in the direction in which the head of the listener 23 presently faces with respect to the reference direction of the head. A convolutional integrator 9 and a memory 10 supply a crosstalk component of the left digital signal L.

The results of the convolutional integration effected on the audio signals and the impulse responses and corrected according to the control signals by the convolutional integrator 5, the memory 6, the controller 50, the convolutional integrator 9, the memory 10, and a controller 52 are supplied to an adder 15 and added to each other. The results of the convolutional integration effected on the audio signals and the impulse responses and corrected according to the control signals by the convolutional integrator 7, the memory 8, a controller 51, the convolutional integrator 11, the memory 12, and the controller 53 are supplied to an adder 16 and added to each other. At this time, reverberation signals produced by reverberation circuits 13, 14 are applied to the adders 15, 16. Multichannel digital signals, selected by the selectors 4, other than the left digital signal L and the right digital signal R can also be processed by the above circuits and supplied to the adders 15, 16.

The results produced by the convolutional integration and the correction and added by the adders 15, 16 are corrected into two-channel digital signals with characteristics inherent in sound sources or headphones used to measure the control signals, by correctors 55, 57. The correctors 55, 57 have corrective characteristics inherent in the sound sources and corrective characteristics inherent in the headphones which sound sources and headphones have been used to measure the impulse responses from the virtual sound source positions to the ears of the listener 23. The digital signals are then converted by respective D/A converters 19, 20 into analog signals, which are amplified by power amplifiers 21, 22 and supplied to headphones 24 worn by the listener 23. The listener 23 is allowed to listen to reproduced sounds from right and left sound generators 25, 26 of the headphones 24.

Each of the controllers 50, 51, 52, 53 may comprise a combination of a variable delay device and a variable level control unit or a level control unit for varying the levels in respective frequency bands, e.g., a graphic equalizer having a number of divided bands. The information stored in the memory 35 may be impulse responses representing a time difference and a level difference between the ears of the listener 23 from the virtual sound source position to the ears in the direction in which the head of the listener 23 presently faces with respect to the reference direction of the head. In this case, each of the controllers 50, 51, 52, 53 may comprise an IIR or FIR variable digital filter.

As described above, the audio signals and the digitally recorded impulse responses from the virtual sound source positions to the ears of the listener 23 with respect to the reference direction are subjected to convolutional integration in the convolutional integrators 5, 7, 9, 11 and the memories 6, 8, 10, 12, and the digital signals are corrected on a real time basis in the controllers 50, 51, 52, 53 by control signals which represent time differences and level differences between the ears of the listener 23 from the virtual sound source positions to the ears in the direction in which the head of the listener 23 presently faces with respect to the reference direction of the head, thereby correcting one or both of the corrective characteristics inherent in the sound sources and the headphones that have been used to measure the impulse responses. Consequently, real-time digital signal processing including simultaneous correction can be carried out.

An output signal from the encoder of a digital angle detector 28 is supplied to detecting circuits 31, 32. The detecting circuit 31 outputs a directional signal Sd which changes to "0" when the listener 23 turns the head clockwise and to "1" when the listener 23 turns the head counterclockwise. The detecting circuit 32 outputs a number of pulses Pa proportional to the angle through which the listener 23 varies the direction of the head, e.g., outputs a pulse Pa each time the listener 23 varies the direction of the head by 2°.

At the time the signal Sd is supplied to a count direction input terminal U/D of an up/down counter 33, the pulses Pa are supplied to a clock input terminal (count input) CK of the up/downcounter 33. The up/downcounter 33 produces a count output signal that is converted into a digital address signal representative of the direction and the magnitude of turning movement of the head of the listener 23. The digital address signal is supplied through an address control circuit 34 as an address signal to a memory 35.

In response to the supplied address signal, the memory 35 reads, from corresponding addresses of a table therein, digitally recorded control signals which represent time differences and level differences between the ears of the listener 23 from the virtual sound source positions to the ears with respect to the reference direction of the head. Then, the control signals and digital audio signals in the respective channels which have been subjected with the impulse responses to convolutional integration by the convolutional integrators 5, 7, 9, 11 and the memories 6, 8, 10, 12 associated respectively therewith are corrected on a real-time basis in the direction in which the head of the listener 23 presently faces, by the controllers 50, 51, 52, 53.

An analog output signal from an analog angle detector 38 is amplified by an amplifier 42 and then applied to an A/D converter 43. The A/D converter 43 supplies a digital output signal through a switch 44 to the address control circuit 34. The address control circuit 34 generates a digital address signal representing the magnitude of the movement of the head of the listener 23 including the direction through each constant angle or predetermined angle, with respect to the reference direction, and supplies the digital address signal as an address signal to the memory 35.

In response to the supplied address signal, the memory 35 reads, from corresponding addresses of a table therein, digitally recorded control signals which represent time differences and level differences between the ears of the listener 23 from the virtual sound source positions to the ears with respect to the reference direction of the head. Then, the control signals and digital audio signals in the respective channels which have been subjected with the impulse responses to convolutional integration by the convolutional integrators 5, 7, 9, 11 and the memories 6, 8, 10, 12 associated respectively therewith are corrected on a real-time basis in the direction in which the head of the listener 23 presently faces, by the controllers 50, 51, 52, 53.

If front left and right loudspeakers 45L, 45R are positioned in front of the listener 23, as shown in FIG. 5, impulse responses from the positions of the loudspeakers 45L, 45R to the ears of the listener 23 in the reference direction of the listener 23, i.e., $\theta=\theta_0$ are assumed to be indicated respectively by:

$$h_{LL}(t) = 1/(2\pi)\int_{-\infty}^{\infty} H_{LL}(\omega)\cdot\exp(j\omega,t)d\omega \tag{11}$$

-continued $$h_{LR}(t) = 1/(2\pi)\int_{-\infty}^{\infty} H_{LR}(\omega)\cdot\exp(j\omega,t)d\omega \tag{12}$$

$$h_{RL}(t) = 1/(2\pi)\int_{-\infty}^{\infty} H_{RL}(\omega)\cdot\exp(j\omega,t)d\omega \tag{13}$$

$$h_{RR}(t) = 1/(2\pi)\int_{-\infty}^{\infty} H_{RR}(\omega)\cdot\exp(j\omega,t)d\omega \tag{14}$$

The memories 6, 8, 10, 12 store digitally recorded impulse responses which represent the above impulse responses.

In the above equations, $h_{mn}$ indicates the impulse response from a loudspeaker position "m" to an ear "n", $H_{mn}(\omega)$ indicates the transfer function from the loudspeaker position "m" to the ear "n", $\omega$ is the angular frequency $2\pi f$, and f is the frequency.

FIG. 7 shows by way of example data stored in the table in the memory 35. The table of control signals stored in the memory 35 contains time differences $\Delta T_{IJ}(\theta)$ between the ears and level differences $\Delta L_{IJ}(\theta)$ between the ears (where IJ=LL, LR, RL, RR, . . . ).

Sound sources for measuring the control signals representative of the time differences between the ears and level differences between the ears may be loudspeakers. Positions where sounds are picked up in the ears of the listener 23 may be anywhere from the inlets of the external canals thereof to the ear drums thereof.

However, the positions for picking up sounds are required to be equal to the positions for determining corrective characteristics, described later, to cancel out the inherent characteristics of the headphones 24.

The above impulse responses that are digitally recorded when the angle $\theta$ is varied by a unit angle, e.g., 2°, are rewritten at respective addresses in the memory 35. The unit angle is selected to be large enough to recognize, with the ears, the angle through which the listener 23 turns the head.

The memory 23 stores three such tables which contain data corresponding to different head and auricle shapes of listeners 23 and characteristics of headphones 24 that are to be used. One of the three tables is selected by a selector 36 of the address control circuit 34.

The audio reproduction apparatus according to this embodiment is arranged as described above, and operates as follows: Digital audio signals in the respective channels from the multichannel digital stereophonic signal source 1, or digital audio signals in the respective channels which are converted by the A/D converters 3 from analog signals that are inputted to the analog stereophonic signal source 2 are selected by the selectors 4, and converted into two-channel digital signals for the respective ears which bear spatial information representative of a sound field by the convolutional integrators 5, 7, 9, 11, the memories 6, 8, 10, 12, the controllers 50, 51, 52, 53, and the adders 15, 16. The signals are corrected with respect to the characteristics of sound sources and headphones that are used, by the correctors 55, 57, and then amplified by the power amplifiers 21, 22 and supplied to the headphones 24.

When the listener 23 moves the head, if the digital angle detector 28 is used, the digital angle detector 28 produces signals Sd, Pa depending on the orientation of the head of the listener 23, and the up/down counter 33 produces a count depending on the orientation of the head of the listener 23. The count is supplied through the address control circuit 34 as an address signal to the memory 35. From the memory 35 are read digitally recorded control signals representative of time differences and level differences between the ears of the listener 23 from the virtual sound source positions with respect to the reference direction of the head of the listener 23 corresponding to the orientation of the head to the ears of the listener 23, among the data in the table shown in FIG. 7. The data thus read from the memory 35 are supplied to the controllers 50, 51, 52, 53.

If the analog angle detector 38 for detecting the rotation of the head is used, then an output signal from the analog angle detector 38 is amplified by the amplifier 42 and then converted into a digital signal depending on the orientation of the head of the listener 23 by the A/D converter 43. The digital signal is supplied through the through the address control circuit 34 as an address signal to the memory 35. From the memory 35 are read digitally recorded control signals representative of time differences and level differences between the ears of the listener 23 from the virtual sound source positions with respect to the reference direction of the head of the listener 23 corresponding to the orientation of the head to the ears of the listener 23, among the data in the table shown in FIG. 7. The data thus read from the memory 35 are supplied to the controllers 50, 51, 52, 53. The correctors 55, 57 have one or both of the corrective characteristics inherent in the sound sources and the headphones that have been used to measure the control signals. Consequently, the signals can be processed on a real-time basis because the digital signals containing these corrective data are processed out at one time.

Inasmuch as the audio signals L, R supplied to the headphones 24 are corrected together with the digitally recorded control signals which are representative of time differences and level differences between the ears of the listener 23 from the virtual sound source positions with respect to the reference direction of the head of the listener 23 corresponding to the orientation of the head to the ears of the listener 23, the audio signals L, R are capable of generating a sound field as if it were reproduced by a plurality of loudspeakers placed in the virtual sound source positions.

Inasmuch as the table of the memory 35 is used when the characteristics of the audio signals supplied to the headphones 24 are varied depending on the orientation of the head of the listener 23, the characteristics of the audio signals can be varied at small intervals depending on the orientation of the head of the listener 23 to achieve optimum characteristics.

Because control signals which are representative of time differences and level differences between the ears of the listener 23 and are digitally recorded in the table of the memory 35 are read and supplied purely electronically so as to correct, with the controllers 50, 51, 52, 53, the digital signals convoluted by the convolutional integrators 5, 7, 9, 11 and the memories 6, 8, 10, 12, no time delay is introduced in varying the characteristics of the audio signals depending on the orientation of the head of the listener 23, and hence no unnatural sound reproduction will result.

Changes that occur in the digitally recorded control signals representative of time differences and level differences between the ears of the listener 23 from the virtual sound source positions with respect to the reference direction of the head of the listener 23 to the ears of the listener 23 when the angle 8 varies may be set so as to be greater or smaller than standard values by a table. Therefore, since changes in the position of the sound image with respect to the orientation of the head of the listener 23 differ from each other, the perception of the distance from the listener 23 to the sound image can be varied based on those greater or smaller changes.

The audio reproduction apparatus according to the above embodiment is capable of processing both digitally recorded or transmitted signals and signals recorded or transmitted in an analog manner that are picked up in a multichannel stereophonic mode. The angular detecting means for detecting the movement of the head of the listener 23 may be either an angle detector for outputting a digital signal or an angle detector for outputting an analog signal.

In the above embodiment, when the characteristics of audio signals supplied to the headphones 24 are varied in synchronism with the movement of the head of the listener 23, the characteristics are varied not continuously with the movement of the head of the listener 23, but by reading data from the table of the memory 35 in each unit angle sufficient and required for human beings to recognize or in each predetermined angle based on the auditory characteristics of human beings. Therefore, only calculations effected to produce changes that are sufficient and required with respect to the movement of the head of the listener 23 are as effective as calculations for varying the characteristics continuously. Thus, the storage capacity of the memory 35 can be saved, and no high-speed calculations more than necessary are required for processing data.

Furthermore, the characteristics represented by the digitally recorded control signals indicative of the time differences between the ears and the level differences between the ears are controlled by purely electronic correction effected on the digital signals that have been subjected to convolutional integration in the convolutional integrators 5, 7, 9, 11 and the memories 6, 8, 10, 12 according to the table of the memory 35. Therefore, the characteristics suffer less degradation, and the characteristics of the audio signals upon movement of the head of the listener 23 are varied with no time delay. Accordingly, the listener 23 is prevented from feeling the reproduced sounds as unnatural unlike the conventional systems.

Changes that occur in the control signals indicative of the time differences between the ears and the level differences between the ears when the angle θ varies may be set so as to be greater or smaller than standard values by a table. Therefore, since changes in the position of the sound image with respect to the orientation of the head of the listener 23 differ from each other, the perception of the distance from the listener 23 to the sound image can be varied based on those greater or smaller changes.

In the above embodiment, the characteristics represented by the digitally recorded control signals indicative of the time differences between the ears and the level differences between the ears are controlled by purely electronic correction effected on the digital signals that have been subjected to convolutional integration in the convolutional integrators 5, 7, 9, 11 and the memories 6, 8, 10, 12 according to the table of the memory 35. However, as shown in FIG. 8, controllers 54, 56 may be connected to the output terminals of the adders 15, 16 for correcting the two-channel digital signals with control signals.

Figure 8:
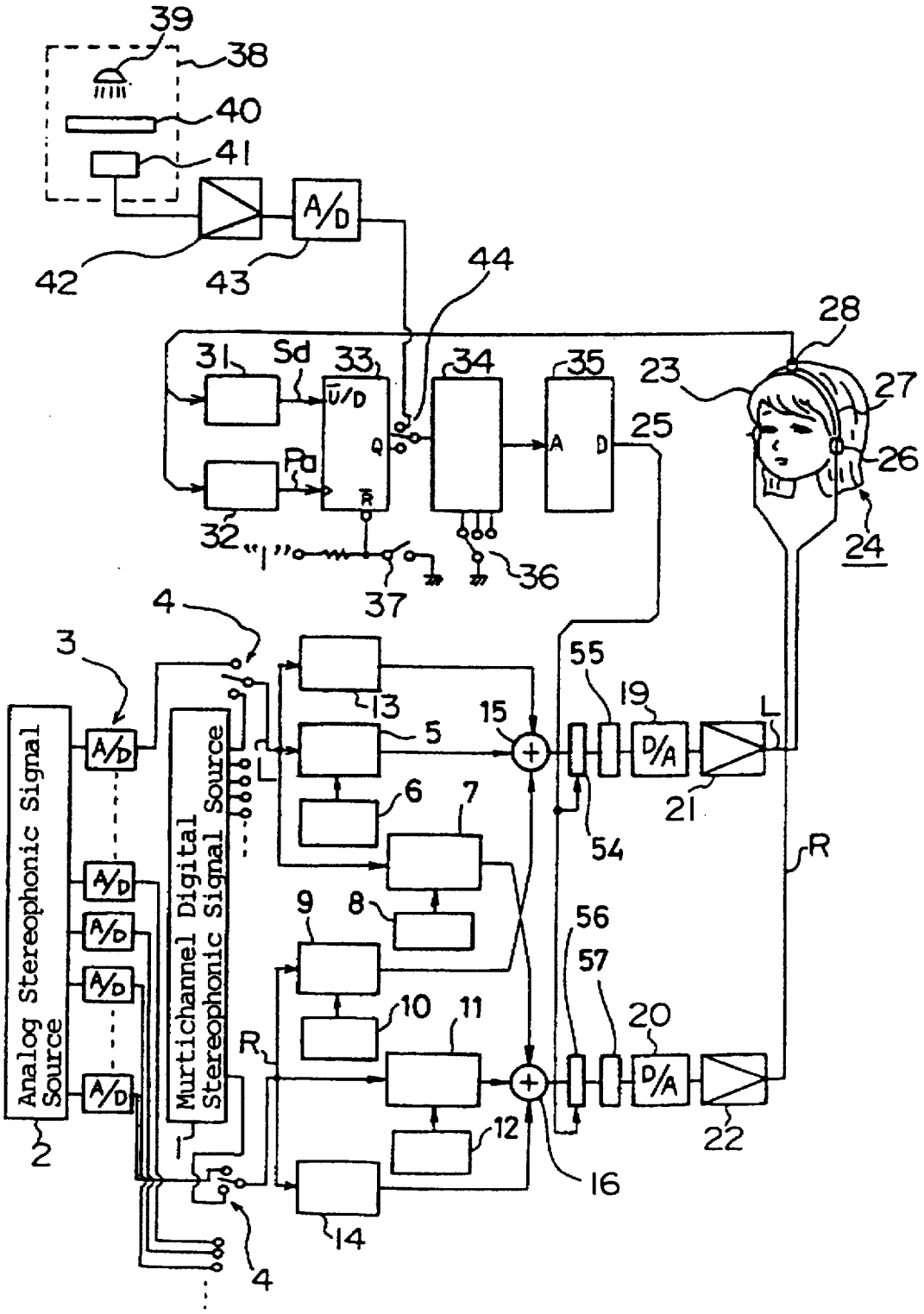
FIG. 8 is a block diagram of an audio reproduction apparatus according to still another embodiment of the present invention.

In FIG. 8, a left digital audio signal is subjected with impulse responses to convolutional integration by a convolutional integrator 5, a memory 6, a convolutional integrator 9, and a memory 10, and then supplied to an adder 15. A right digital audio signal is subjected with impulse responses to convolutional integration by a convolutional integrator 11, a memory 12, a convolutional integrator 7, and a memory 8, and then supplied to an adder 16. The right and left digital audio signals to which respective crosstalk components have been added by the adders 15, 16 are corrected on a real-time basis according to control signals from a memory 35 by the respective controllers 54, 56.

At this time, reverberation signals produced by reverberation circuits 13, 14 are applied to the adders 15, 16. Multichannel digital signals, selected by the selectors 4, other than the left digital signal L and the right digital signal R can also be processed by the above circuits and supplied to the adders 15, 16. The other structural details are identical to those shown in FIG. 6 and will not be described below.

Figure 9:
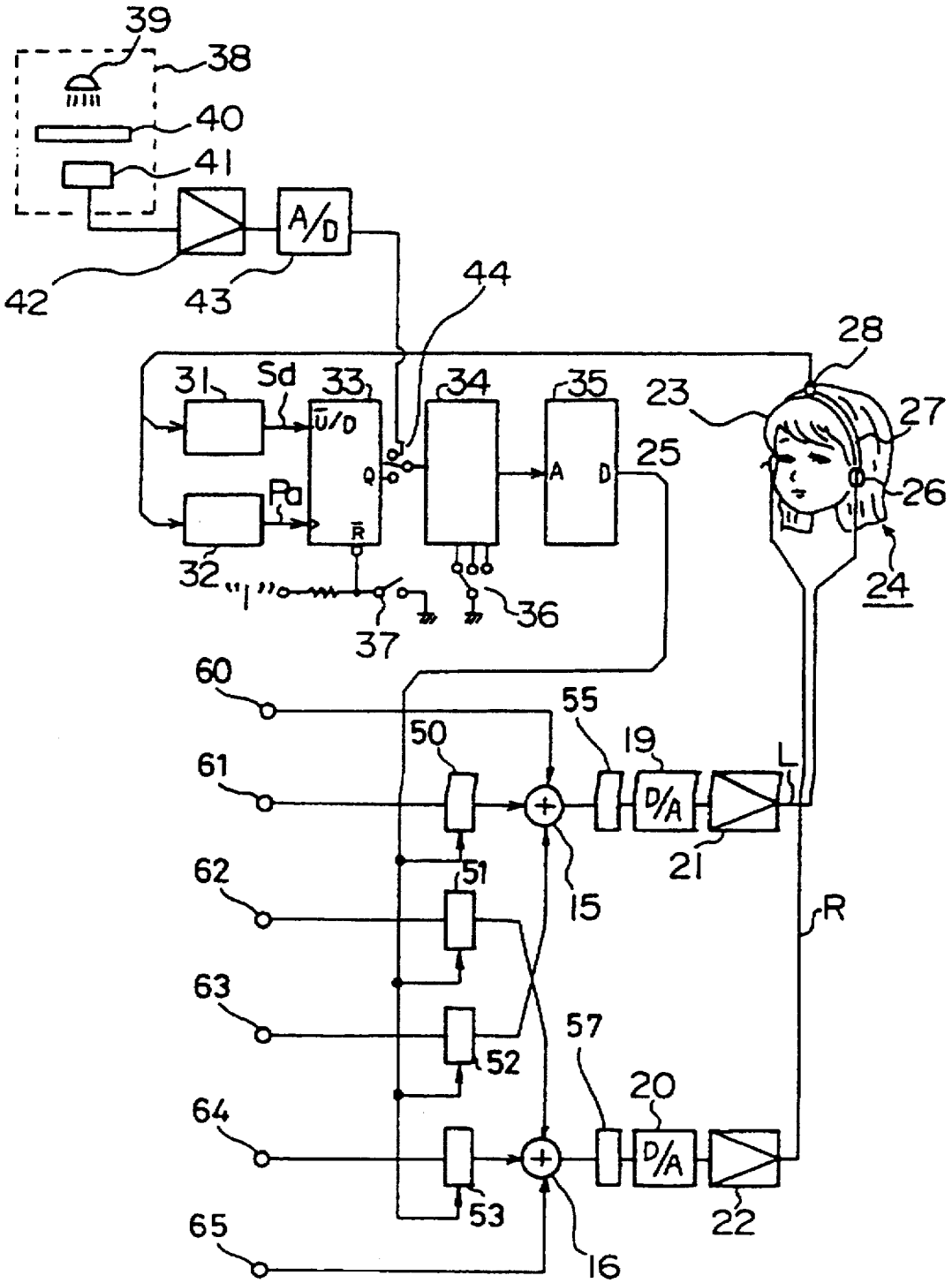
FIG. 9 is a block diagram of an audio reproduction apparatus according to yet still another embodiment of the present invention.

Since the audio signals are corrected according to control signals indicative of the time differences between the ears and the level differences between the ears depending on the rotation of the individual heads of plural listeners 23, the audio signals can be reproduced simultaneously by a plurality of sets of headphones 24. Since it is not necessary to employ as many sets of expensive A/D converters 3 and convolutional integrators 5, 7, 9, 11 as the number of listeners 23, the audio reproduction apparatus is highly inexpensive.

Where there are plural listeners in the above arrangement, as shown in FIG. 9, terminals 60, 61, 62, 63, 64, 65 are connected to the output terminals of the reverberation circuits 13, 14, the convolutional integrators 5, 7, 9, 11, and the memories 6, 8, 10, 12 (see FIG. 6), and as many circuits as the number of listeners 23 may be branched off from the terminals 60, 61, 62, 63, 64, 65.

Specifically, in FIG. 6, the output terminals of the reverberation circuits 13, 14, the convolutional integrators 5, 7, 9, 11, and the memories 6, 8, 10, 12 are branched off and connected to the terminals 60, 61, 62, 63, 64, 65 shown in FIG. 9 through transmission paths (not shown). As many circuits as the number of listeners 23 are connected to the terminals 60, 61, 62, 63, 64, 65. The terminals 60, 61, 62, 63, 64, 65 are supplied with right and left digital audio signals, right and left crosstalk components, and reverberation signals, respectively.

In the arrangement shown in FIG. 9, digital audio signals in the respective channels which have been subjected with impulse responses to convolutional integration by the convolutional integrators 5, 7, 9, 11 and the memories 6, 8, 10, 12 are supplied through transmission paths (not shown) to the terminals 60, 61, 62, 63, 64, 65. In the controllers 50, 51, 52, 53, the digital audio signals are corrected by control signals read from the memory 35, modified, and supplied to the adders 15, 16. The two-channel digital signals that are corrected into characteristics inherent in the headphones 24 by the correctors 55, 57 are converted by the D/A converters 19, 20 into analog signals. The analog signals are amplified by the power amplifiers 21, 22, and then supplied to the headphones 24. Other structural details and operation are identical to those of the arrangement shown in FIG. 6, and will not be described in detail.

Figure 10:
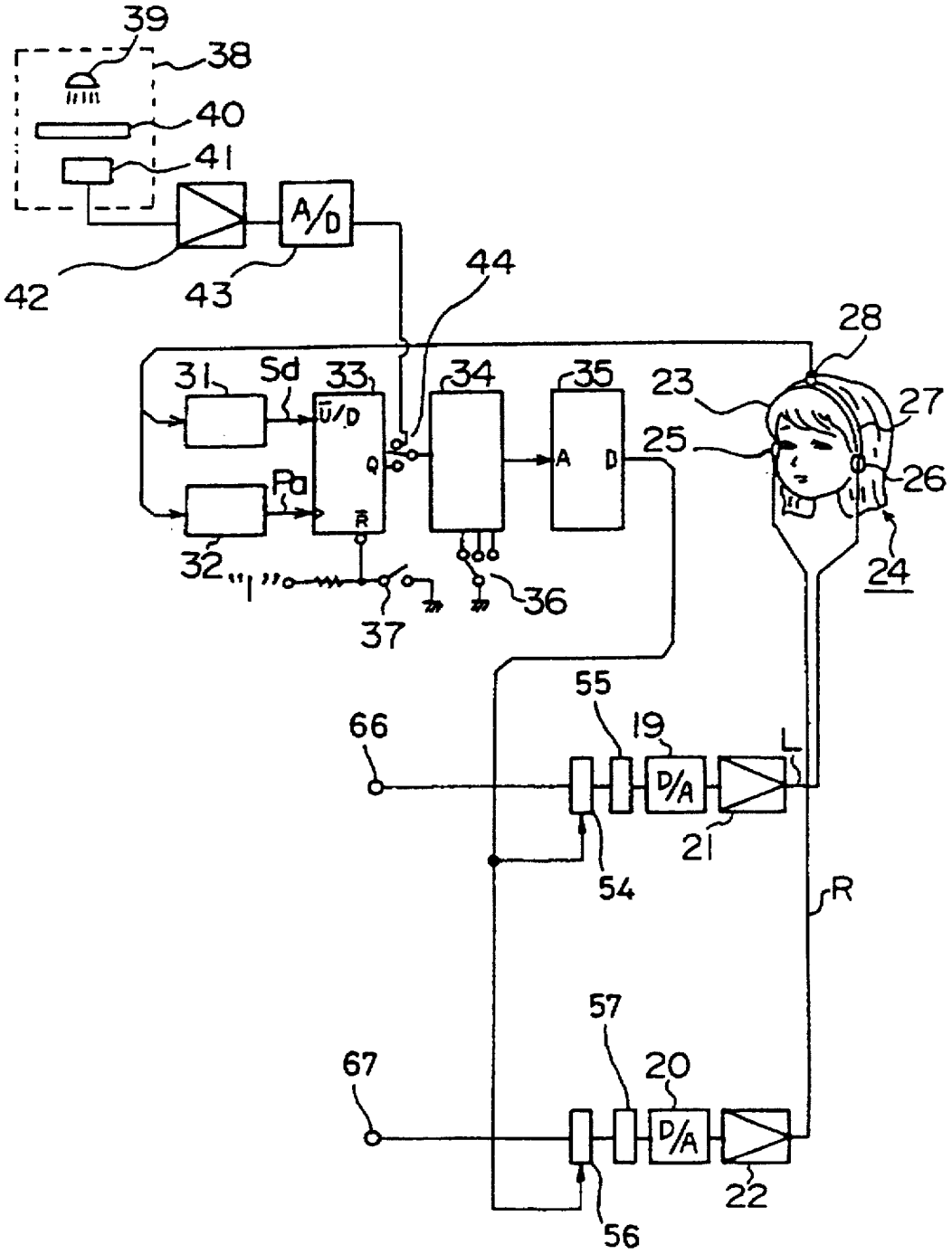
FIG. 10 is a block diagram of an audio reproduction apparatus according to a further embodiment of the present invention.

As shown in FIG. 10, terminals 66, 67 may be connected to the output terminals of the adders 15, 16, and as many circuits as the number of listeners 23 may be branched off from the terminals 66, 67.

Specifically, in FIG. 8, the output terminals of the reverberation circuits 13, 14 and the adders 15, 16 are branched off and connected to the terminals 66, 67 shown in FIG. 10 through transmission paths (not shown). As many circuits as the number of listeners 23 are branched off from the terminals 66, 67. The terminals 66, 67 are supplied with right and left digital audio signals, respectively.

In the arrangement shown in FIG. 10, two-channel digital signals supplied through transmission paths (not shown) are corrected according to control signals read from the memory 35 by the controllers 54, 56. The two-channel digital signals that are corrected into characteristics inherent in the headphones 24 by the correctors 55, 57 are converted by the D/A converters 19, 20 into analog signals. The analog signals are amplified by the power amplifiers 21, 22, and then supplied to the headphones 24. Other structural details and operation are identical to those of the arrangement shown in FIG. 8, and will not be described in detail.

In the above arrangements, since the audio signals are corrected according to control signals indicative of the time differences between the ears and the level differences between the ears depending on the rotation of the individual heads of plural listeners 23, the audio signals can be reproduced simultaneously by a plurality of sets of headphones 24. Since it is not necessary to employ as many expensive A/D converters 3 and as many convolutional integrators 5, 7, 9, 11 as the number of listeners 23, but the two-channel digital signals are corrected by the control signals, the audio reproduction apparatus is highly inexpensive.

According to the present invention, a second memory means is be addressed by a digital address signal from an address signal converting means to read control signals representative of a time difference between the ears of a listener and a level difference between the ears of the listener from the second memory means, and digital audio signals that have been subjected with impulse responses to convolutional integration by integrating means are corrected by the control means. Therefore, the audio signals are corrected without a delay in signal processing to allow the listener to listen to reproduced sounds as if they were radiated from loudspeakers placed in virtual sound source positions.

An audio reproduction apparatus according to another embodiment of the present invention will be described in detail with reference to FIGS. 11A, 11B through 13. The audio reproduction apparatus according to this embodiment includes arrangements that are identical to those shown in FIGS. 2 through 5, and hence those arrangements will not be described below.

The audio reproduction apparatus according to this embodiment allows not only a listener but also a plurality of listeners to perceive sound images with the same localization, sound field, etc. when audio signals are reproduced simultaneously with headphones in a wireless fashion, as if they were reproduced by loudspeakers located in a predetermined positional relationship.

Specifically, the audio reproduction apparatus according to this embodiment is used in a system for reproducing, with headphones in a wireless manner, a multichannel audio signal that has been recorded in a stereophonic mode or the like. Particularly, the audio reproduction apparatus is used for reproducing, with headphones in a wireless manner, digital audio signals recorded or transmitted in respective channels with a view to localizing respective sound images in a predetermined positional relationship (e.g., at right, left, and central positions in front of the listener, and other positions).

First, digital audio signals in respective channels which have been subjected with impulse responses to convolutional integration are transmitted by a transmitting device, and received by a receiving device on a listener who wears headphones. A movement of the head of the listener with respect to the reference direction is detected through each constant angle or predetermined angle, and converted into a digital address signal which indicates a magnitude of the movement including its direction. The address signal is used to read, from a memory, digitally recorded control signals from virtual sound source positions with respect to the reference direction to the ears of the listener. The control signals and the audio signals are corrected and modified on a real-time basis. In this manner, the audio reproduction apparatus can produce such a reproducing effect in a wireless fashion as if reproduced sounds were radiated from loudspeakers located in the virtual sound source positions.

Figure 11A:
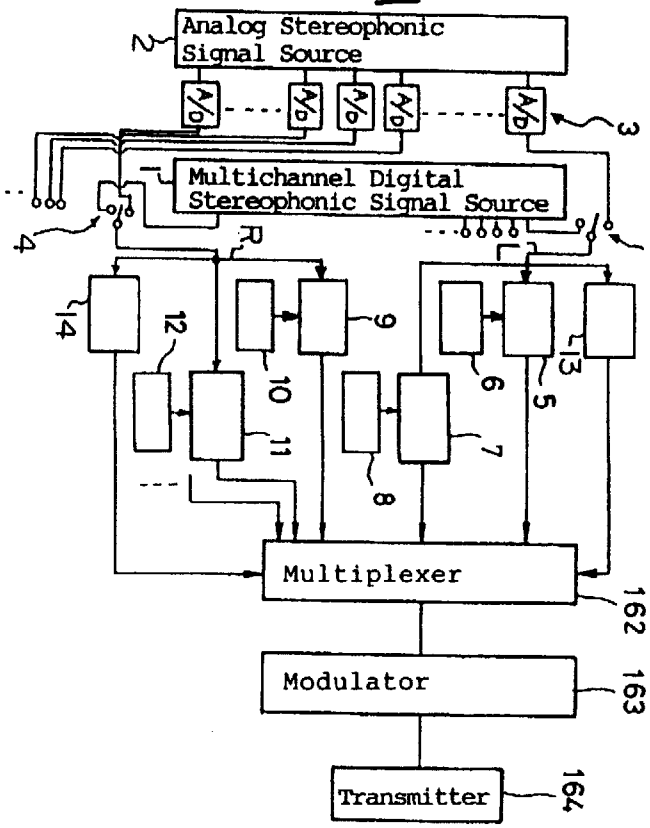
FIGS. 11A and 11B are block diagram of transmitting devices in an audio reproduction apparatus, FIG. 11A showing an arrangement with no adders, and FIG. 11B showing an arrangement with adders.

FIG. 11A shows by way of example a transmitting device in the audio reproduction apparatus. A multichannel digital stereophonic signal source 1 may be a digital audio disc (e.g., a compact disc), a digital satellite broadcasting system, and so on. An analog stereophonic signal source 2 may be an analog record, an analog broadcasting system, and so on. Analog signals from the analog stereophonic signal source 2 are converted into digital signals by as many A/D converters 3 as the number of channels if the analog signals are multichannel analog signals. Selectors 4 select either signals which have been inputted as digital signals or signals which have been inputted as analog signals, as digital signals represented by a constant sampling frequency and a constant number of quantizing bits. While two-channel selectors 4 are shown in FIG. 11A, as many selectors 4 may be provided as the number of channels if the supplied signals are multichannel signals.

A left digital signal L of the digital signal series is supplied to a convolutional integrator 5. The convolutional integrator 5 is associated with a memory 6 which stores a set of digitally recorded impulse responses that are represented by a constant sampling frequency and a constant number of quantizing bits from a virtual sound source position to the ears of a listener 23, with respect to the head of the listener 23 which is fixed with respect to a reference direction of the head. In the convolutional integrator 5, the digital signal series is subjected with the impulse responses read from the memory 6 to convolutional integration on a real-time basis.

A convolutional integrator 7 and a memory 8 supply a crosstalk component of a right digital signal R.

The right digital signal R is supplied to a convolutional integrator 11. The convolutional integrator 11 is associated with a memory 12 which stores a set of digitally recorded impulse responses that are represented by a constant sampling frequency and a constant number of quantizing bits from a virtual sound source position to the ears of the listener 23, with respect to the head of the listener 23 which is fixed with respect to a reference direction of the head. In the convolutional integrator 11, the digital signal series is subjected with the impulse responses read from the memory 12 to convolutional integration on a real-time basis.

A convolutional integrator 9 and a memory 10 supply a crosstalk component of the left digital signal L.

The digital signals are also subjected with impulse responses to convolutional integration in the convolutional integrator 7, the memory 8, the convolutional integrator 11, and the memory 12. The digital signal series which has been subjected with the impulse responses to convolutional integration by the convolutional integrators 5, 7, 9, 11 and the memories 6, 8, 10, 12 is supplied to a multiplexer 162. At this time, reverberation signals from respective reverberation circuits 13, 14 are also supplied to the multiplexer 162. Then, the digital signal series is multiplexed by the multiplexer 162, modulated according to a given process by a modulator 163, and transmitted as an electromagnetic wave by a transmitting device 164.

Figure 12:
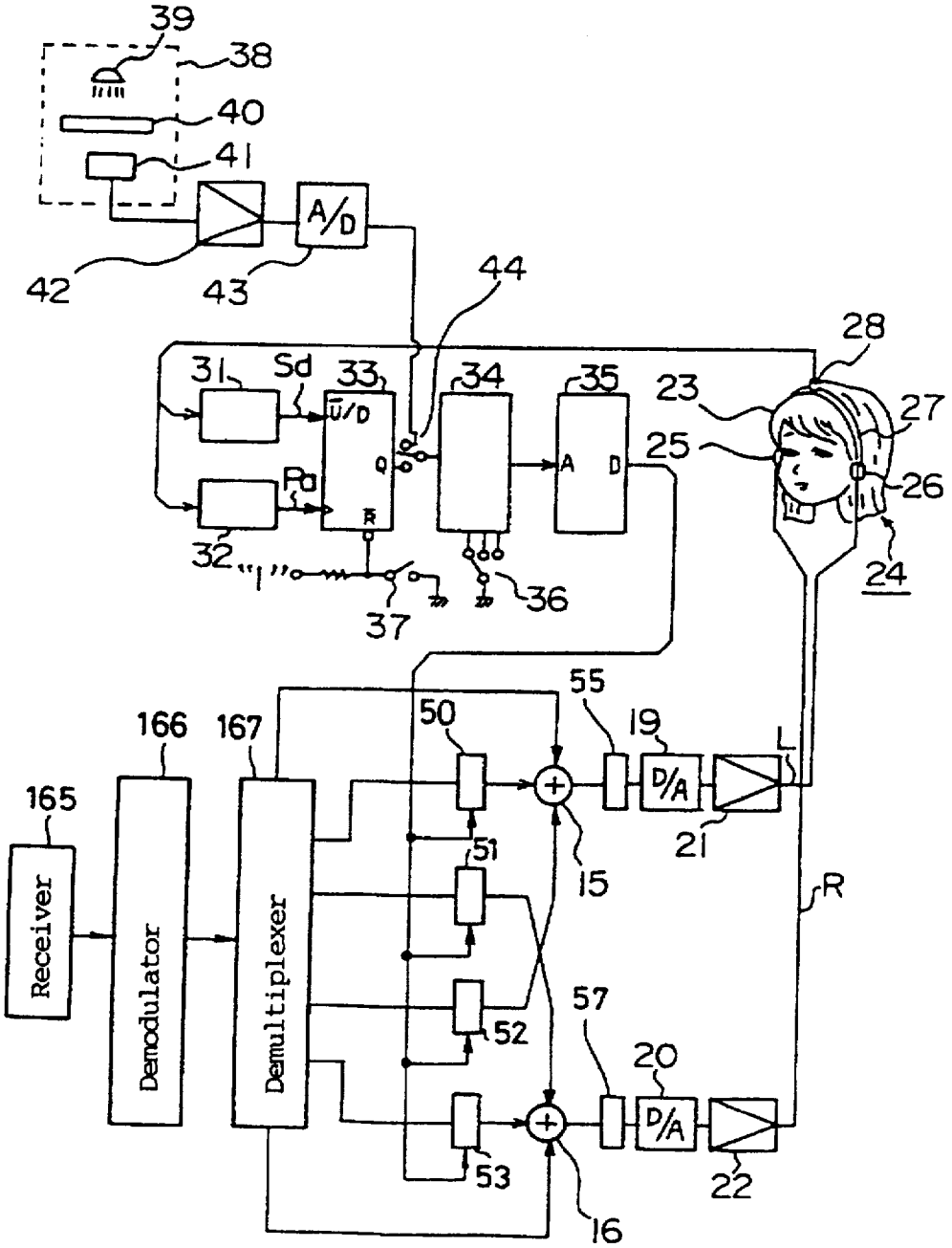
FIG. 12 is a block diagram of a receiving device according to an embodiment of the present invention in the audio reproduction apparatus.

FIG. 12 shows by way of example of a receiving device in the audio reproduction apparatus. The receiving device shown in FIG. 12 is combined with the transmitting device shown in FIG. 11A. As shown in FIG. 12, the electromagnetic wave convolutionally integrated and transmitted from the transmitting device shown in FIG. 11A is received by a receiver 165, demodulated by a demodulator 16, and separated into digital audio signals by a demultiplexer 167. The digital audio signals separated by the demultiplexer 167 are supplied respectively to controllers 50, 51, 52, 53.

In the controllers 50, 51, 52, 53, a movement of the head of a listener 23 with respect to a reference direction is converted into a digital address signal representing a magnitude of the movement including its direction in which the head of the listener 23 presently faces, through each constant angle or predetermined angle. The digital audio signals are corrected on a real time basis by control signals which represent time differences and level differences between the ears of the listener 23 from the virtual sound source positions to the ears.

The digital audio signals which have been corrected in the controllers 50, 51, 52, 53 are added into two-channel digital audio signals by adders 15, 16. Reverberation signals are directly supplied to the adders 15, 16. The two-channel digital audio signals are further corrected into characteristics inherent in sound sources or headphones that have been used to measure the control signals.

The correctors 55, 57 have corrective characteristics inherent in the sound sources and corrective characteristics inherent in the headphones which sound sources and headphones have been used to measure the impulse responses from the virtual sound source positions to the ears of the listener 23. The digital signals are then converted by respective D/A converters 19, 20 into analog signals, which are amplified by power amplifiers 21, 22 and supplied to headphones 24 worn by the listener 23. The listener 23 is allowed to listen to reproduced sounds from right and left sound generators 25, 26 of the headphones 24.

Each of the controllers 50, 51, 52, 53 may comprise a combination of a variable delay device and a variable level control unit or a level control unit for varying the levels in respective frequency bands, e.g., a graphic equalizer having a number of divided bands. The information stored in the memory 35 may be impulse responses representing a time difference and a level difference between the ears of the listener 23 from the virtual sound source position to the ears in the direction in which the head of the listener 23 presently faces with respect to the reference direction of the head. In this case, each of the controllers 50, 51, 52, 53 may comprise an IIR or FIR variable digital filter.

As described above, the audio signals and the digitally recorded impulse responses from the virtual sound source positions to the ears of the fixed listener 23 with respect to the reference direction are subjected to convolutional integration in the convolutional integrators 5, 7, 9, 11 and the memories 6, 8, 10, 12. The audio signals are then transmitted as an electromagnetic wave from the transmitter 164. The electromagnetic wave received by the receiver 165 is processed into audio signals that are corrected on a real time basis by control signals which represent time differences and level differences between the ears of the listener 23 from the virtual sound source positions to the ears in the direction in which the head of the listener 23 presently faces, with respect to the reference direction of the head. The audio signals are then corrected based on one or beth of the corrective characteristics of the sound sources and the headphones that have been used to measure the control signals. Therefore, it is possible to effect digital signal processing including simultaneous correction on a real-time basis in a wireless fashion.

The memory 35 reads, from corresponding addresses of a table therein, digitally recorded control signals which represent time differences and level differences between the ears of the listener 23 from the virtual sound source positions to the ears with respect to the reference direction of the head.

Then, digital audio signals in the respective channels which have been subjected with the impulse responses to convolutional integration by the convolutional integrators 5, 7, 9, 11 and the memories 6, 8, 10, 12 associated respectively therewith are corrected on a real-time basis in the direction in which the head of the listener 23 presently faces, by the controllers 50, 51, 52, 53 in a wireless manner.

An analog output signal from an analog angle detector 38 is amplified by an amplifier 42 shown in FIG. 12 and then applied to an A/D converter 43. The A/D converter 43 supplies a digital output signal through a switch 44 to a address control circuit 34. The address control circuit 34 generates a digital address signal representing the magnitude of the movement of the head of the listener 23 including the direction through each constant angle or predetermined angle, with respect to the reference direction, and supplies the digital address signal as an address signal to the memory 35.

The memory 35 reads, from corresponding addresses of a table therein, digitally recorded control signals which represent time differences and level differences between the ears of the listener 23 from the virtual sound source positions to the ears with respect to the reference direction of the head. Then, the control signals and digital audio signals in the respective channels which have been subjected with the impulse responses to convolutional integration by the convolutional integrators 5, 7, 9, 11 and the memories 6, 8, 10, 12 associated respectively therewith are corrected on a real-time basis in the direction in which the head of the listener 23 presently faces, by the controllers 50, 51, 52, 53 in a wireless manner.

The audio reproduction apparatus according to this embodiment which is arranged as described above operates as follows: Digital audio signals in the respective channels from the multichannel digital stereophonic signal source 1, or digital audio signals in the respective channels which are converted by the A/D converters 3 from analog signals that are inputted to the analog stereophonic signal source 2 are selected by the selectors 4, and subjected with impulse responses to convolutional integration by the convolutional integrators 5, 7, 9, 11, the memories 6, 8, 10, 12. The digital audio signals in the respective channels are then transmitted from the transmitter 164.

The transmitted audio signals are received by the transmitter 165 on the listener 23 wearing the headphones 24. A movement of the head of the listener 23 with respect to the reference direction is detected by a digital angle detector 28 through each constant angle or predetermined angle, and converted into a digital address signal indicative of a magnitude thereof including its direction by the address control circuit 34.

The digital address signal is used to read, from the memory 35, digitally recorded control signals from the virtual sound source positions to the ears of the listener 23 with respect to the reference direction of the head of the listener 23. The control signals and the audio signals are corrected and modified on a real-time basis in the controllers 50, 51, 52, 53. The audio signals are converted into two-channel digital signals for the respective ears which bear spatial information representative of a sound field by the controllers 50, 51, 52, 53 and the adders 15, 16. The two-channel digital signals are corrected with respect to the characteristics of sound sources and headphones that are used, by the correctors 55, 57, and then amplified by the power amplifiers 21, 22 and supplied to the headphones 24. In this manner, the audio reproduction apparatus can produce such a reproducing effect as if reproduced sounds were radiated from loudspeakers located in the virtual sound source positions.

When the listener 23 moves the head, if the digital angle detector 28 is used, the digital angle detector 28 produces signals Sd, Pa depending on the orientation of the head of the listener 23, and the up/down counter 33 produces a count depending on the orientation of the head of the listener 23. The count is supplied through the address control circuit 34 as an address signal to the memory 35. From the memory 35 are read digitally recorded control signals representative of time differences and level differences between the ears of the listener 23 from the virtual sound source positions with respect to the reference direction of the head of the listener 23 corresponding to the orientation of the head to the ears of the listener 23, among the data in the table shown in FIG. 7. The data thus read from the memory 35 are supplied to the controllers 50, 51, 52, 53.

If the analog angle detector 38 for detecting the rotation of the head is used, then an output signal from the analog angle detector 38 is amplified by the amplifier 42 and then converted into a digital signal depending on the orientation of the head of the listener 23 by the A/D converter 43. The digital signal is supplied through the through the address control circuit 34 as an address signal to the memory 35. From the memory 35 are read digitally recorded control signals representative of time differences and level differences between the ears of the listener 23 from the virtual sound source positions with respect to the reference direction of the head of the listener 23 corresponding to the orientation of the head to the ears of the listener 23, among the data in the table shown in FIG. 7. The data thus read from the memory 35 are supplied to the controllers 50, 51, 52, 53. The controllers 55, 57 have one or both of the corrective characteristics inherent in the sound sources and the headphones that have been used to measure the control signals. Consequently, the signals can be processed on a real-time basis because the digital signals containing these corrective data are processed at one time.

Inasmuch as the audio signals L, R supplied to the headphones 24 are corrected together with the digitally recorded control signals which are representative of time differences and level differences between the ears of the listener 23 from the virtual sound source positions with respect to the reference direction of the head of the listener 23 corresponding to the orientation of the head to the ears of the listener 23, the audio signals L, R are capable of generating a sound field as if it were reproduced by a plurality of loudspeakers placed in the virtual sound source positions.

Inasmuch as the table of the memory 35 is used when the characteristics of the audio signals supplied to the headphones 24 are varied depending on the orientation of the head of the listener 23, the characteristics of the audio signals can be varied at small intervals depending on the orientation of the head of the listener 23 to achieve optimum characteristics.

Because control signals which are representative of time differences and level differences between the ears of the listener 23 and are digitally recorded in the table of the memory 35 connected to the receiver 165 are read and supplied purely electronically so as to correct, with the controllers 50, 51, 52, 53, the digital signals convoluted by the convolutional integrators 5, 7, 9, 11 and the memories 6, 8, 10, 12, no time delay is introduced in varying the characteristics of the audio signals depending on the orientation of the head of the listener 23, and hence no unnatural sound reproduction will result.

Figure 11B:
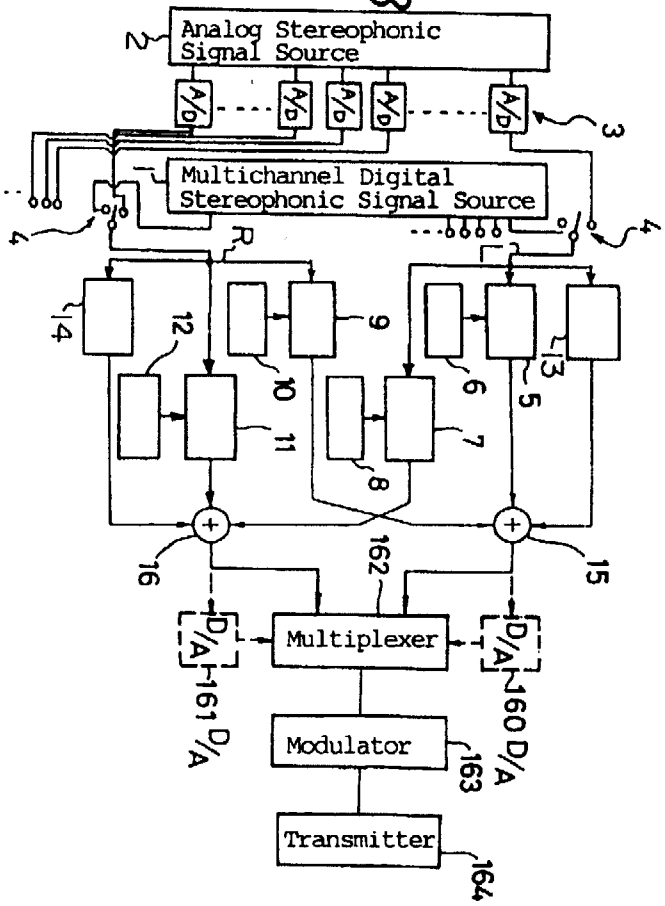

FIG. 11B shows another transmitting device for use in the audio reproduction apparatus. Only those components of the transmitting device shown in FIG. 11B which are different from those of the transmitting device shown in FIG. 11A will be described below. Those parts of the transmitting device shown in FIG. 11B which are identical to those shown in FIG. 11A are denoted by identical reference numerals, and will not be described in detail below. The results of convolutional integration effected on audio signals and impulse responses by the convolutional integrator 5, the memory 6, the convolutional integrator 9, and the memory 10 are supplied to the adder 15 and added thereby. The results of convolutional integration effected on audio signals and impulse responses by the convolutional integrator 7, the memory 8, the convolutional integrator 11, and the memory 12 are supplied to the adder 16 and added thereby.

At this time, reverberation signals produced by reverberation circuits 13, 14 are applied to the adders 15, 16. Left and right digital signals L, R in two channels that are supplied to the adders 15, 16 are supplied to the multiplexer 162. Multichannel digital signals, selected by the selectors 4, other than the left digital signal L and the right digital signal R can also be processed by the above circuits and supplied to the adders 15, 16.

The two-channel digital signals supplied to the adders 15, 16 may be converted into analog signals by D/A converters 160, 161, respectively, and the analog signals may then be supplied to the multiplexer 162.

Figure 13:
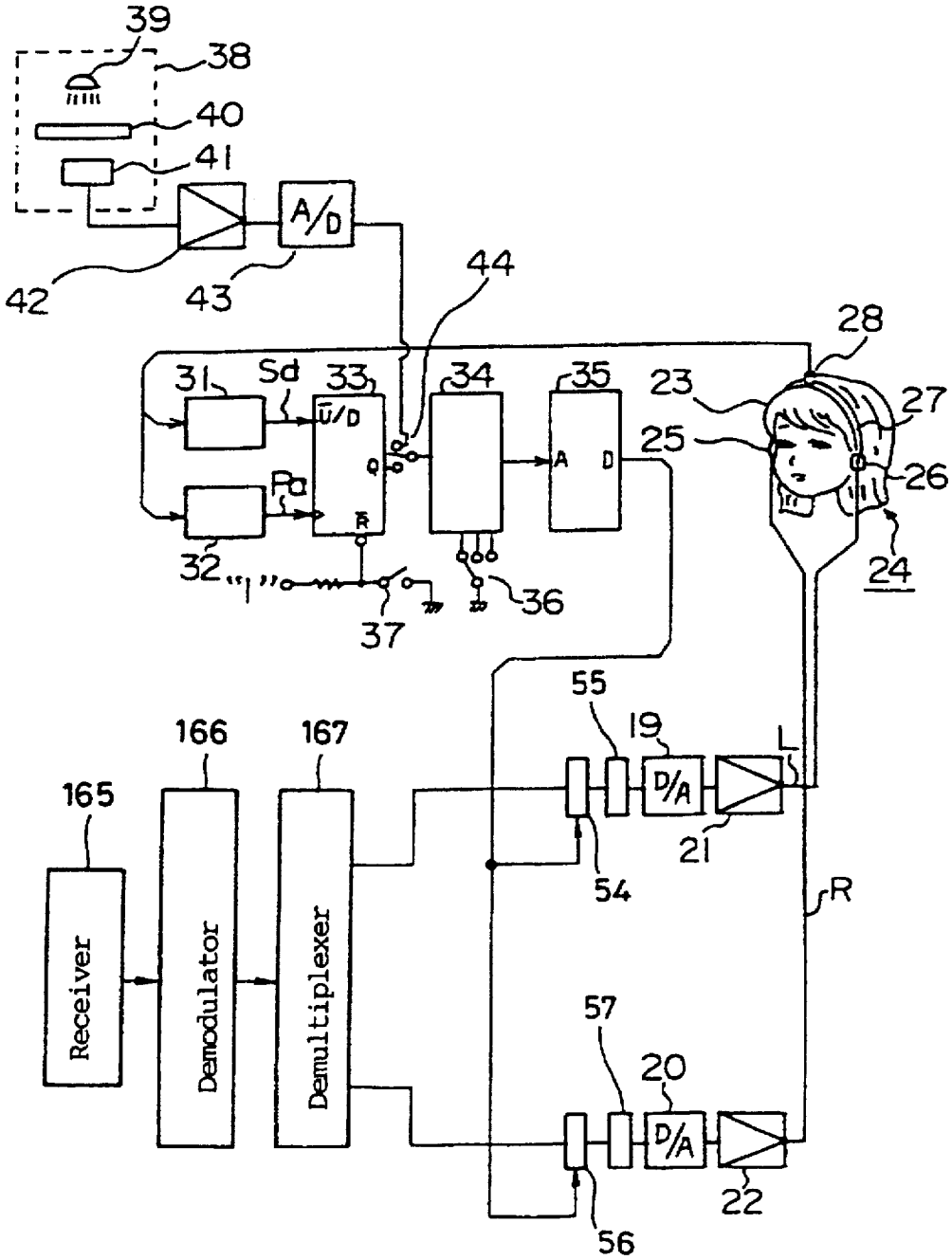
FIG. 13 is a block diagram of a receiving device according to another embodiment of the present invention in the audio reproduction apparatus.

FIG. 13 shows a receiving device according to another embodiment of the present invention in the audio reproduction apparatus. The receiving device shown in FIG. 13 is combined with the transmitting device shown in FIG. 11B. Only those components of the receiving device shown in FIG. 13 which are different from those of the receiving device shown in FIG. 12 will be described below. Those parts of the receiving device shown in FIG. 13 which are identical to those shown in FIG. 12 are denoted by identical reference numerals, and will not be described in detail below. In FIG. 13, two-channel digital signals from the demultiplexer 167 are supplied respectively to the controllers 54, 56.

If the two-channel digital signals supplied to the adders 15, 16 in FIG. 11B are first converted into analog signals by the D/A converters 160, 161 and the analog signals are then supplied to the multiplexer 162, then the D/A converters 19, 20 may be dispensed with. In this case, only the D/A converters 160, 161 for the two channels may be required in the transmitting device, and if a plurality of receiving devices are employed, it is not necessary to provide as many D/A converters 19, 20 as the number of receiving devices.

In this embodiment, since digital or analog signals which have obtained spatial information through convolution of impulse responses are transmitted as electromagnetic waves in a wireless fashion from the transmitting device, the cords of the headphones 24 worn by a plurality of listeners 23 are not likely to become entangled, and receiving devices can simply be added without wiring and circuit modifications even when the number of listeners 23 is increased.

In the above embodiment, an electromagnetic wave is transmitted from the transmitter 164 of the transmitting device shown in FIG. 11B to the receiver 165 of the receiving device shown in FIG. 13. However, each of the transmitter 164 of the transmitting device shown in FIG. 11B and the receiver 165 of the receiving device shown in FIG. 13 may be a radio unit having a transmitter and a receiver, and an electromagnetic wave representing a signal processing modification signal from the receiving device to the transmitting device with respect to an electromagnetic wave transmitted from the transmitting device to the receiving device for modifying the content of signal processing in the transmitting device. For example, such a signal processing modification signal may be of such a nature as to modify the characteristics of the reverberation circuits 13, 14 or various characteristics that can be selected in the transmitting device.

With the above arrangement, it is possible to carry out bi-directional communications between the transmitting device and the receiving device for allowing the listener 23 to control the apparatus highly conveniently. Since the bi-directional communications permit the listener 23 to control the transmitting device from the receiving device, the listener 23 associated with the receiving device can control various characteristics that can be selected in the transmitting device, e.g., switching between the multichannel digital stereophonic signal source 1 and the analog stereophonic signal source 2, and changing the memories 6, 8, 10, 12 for obtaining spatial information to increase the reproduction effect. Consequently, the listener 23 can control the apparatus highly conveniently.

According to the present invention, when two-channel digital audio signals transmitted from transmitting means are received by receiving means, the two-channel digital audio signals are corrected with regard to a movement of the head of the listener on a real-time basis based on a control signal. The two-channel digital audio signals are corrected in a wireless manner, without a signal processing delay, such that the listener can hear reproduced sounds as if they were reproduced from loudspeakers placed in virtual sound source positions.

An audio reproduction apparatus according to another embodiment of the present invention will be described below with reference to FIGS. 14 and 15. The audio reproduction apparatus according to this embodiment includes arrangements that are identical to those shown in FIGS. 2 through 5, and hence those arrangements will not be described below.

The audio reproduction apparatus according to this embodiment allows a listener to perceive sound images with the same localization, sound field, etc. when audio signals are reproduced with headphones, as if they were reproduced by loudspeakers located in a predetermined positional relationship. Particularly, the audio reproduction apparatus permits the listener to correct, in a position close to the headphones, characteristics inherent in the headphones to reset sound sources in the front of the listener, select a sound field and reverberation to be reproduced, and adjust a sound level and/or a balance for reproduction.

Specifically, the audio reproduction apparatus according to this embodiment is used in a system for reproducing, with headphones, a multichannel audio signal that has been recorded in a stereophonic mode or the like. Particularly, the audio reproduction apparatus is used for reproducing, with headphones, digital audio signals recorded or transmitted in respective channels with a view to localizing respective sound images in a predetermined positional relationship (e.g., at right, left, and central positions in front of the listener, and other positions), while allowing the listener to adjust, in a position close to the headphones, various reproducing conditions highly conveniently.

First, digital audio signals in respective channels which have been subjected with impulse responses to convolutional integration are transmitted by a transmitting device, and received by a receiving device on a listener who wears headphones. A movement of the head of the listener with respect to the reference direction is detected through each constant angle or predetermined angle, and converted into a digital address signal which indicates a magnitude of the movement including its direction. The address signal is used to read, from a memory, digitally recorded control signals from virtual sound source positions with respect to the reference direction to the ears of the listener. The control signals and the audio signals are corrected and modified on a real-time basis. In this manner, the audio reproduction apparatus can produce such a reproducing effect directly or in a wireless fashion as if reproduced sounds were radiated from loudspeakers located in the virtual sound source positions.

The arrangement according to this embodiment is used in the audio reproduction apparatus shown in FIGS. 1, 6, 8, 9, 10, 11A and 11B, 12, and 13. The structures of the audio reproduction apparatus shown in FIGS. 1, 6, 8, 9, 10, 11A and 11B, 12, and 13 will not be described below as they have already been described above.

Correcting circuits for correcting the inherent characteristics of the sound sources and the headphones 24 that are used are housed in the headphones 24 themselves. However, the correcting circuits may not necessarily be housed in the headphones 24 themselves, but may be disposed in the cords of the headphones 24, or connectors which interconnect the apparatus and the cords of the headphones 24 or a subsequent stage, or the controllers in the apparatus or a subsequent stage.

The audio reproduction apparatus according to the present invention operates as follows: Digital audio signals in the respective channels from the multichannel digital stereophonic signal source 1, or digital audio signals in the respective channels which are converted by the A/D converters 3 from analog signals that are inputted to the analog stereophonic signal source 2 are selected by the selectors 4. In the arrangement shown in FIG. 1, the digital signal series is subjected with impulse responses to convolutional integration by the convolutional integrators 5, 7, 9, 11 and the memories 6, 8, 10, 12 and supplied to the adders 15, 16.

In the arrangement shown in FIG. 6, the digital audio signals in the respective channels which have been subjected with impulse responses to convolutional integration by the convolutional integrators 5, 7, 9, 11 and the memories 6, 8, 10, 12 are corrected and modified by control signals read from the memory 35, and then supplied to the adders 15, 16.

In the arrangement shown in FIG. 8, the two-channel digital signals from the adders 15, 16 are corrected and modified by control signals read from the memory 35. The two-channel digital signals are converted by the D/A converters 19, 20 into analog signals, which are amplified by the power amplifiers 21, 22 and thereafter supplied to the headphones 24.

The listener 23 who wears the headphones 24 can thus listen to audio signals reproduced thereby. A movement of the head of the listener 23 with respect to a reference direction is detected through each constant angle or predetermined angle by the digital angle detector 28, and converted into a digital address signal representing a magnitude of the movement including its direction by the address control circuit 34.

The address signal is used to read, from the memory 35, digitally recorded impulse responses or control signals from the virtual sound source positions with respect to the reference direction of the head of the listener 23 to the ears of the listener 23. In the convolutional integrators 5, 7, 9, 11 and the memories 6, 8, 10, 12 or the controllers 50, 51, 52, 53, the impulse responses or control signals and t he audio signals are corrected and modified on a real-time basis. The signals are converted into two-channel digital signals for the respective ears which bear spatial information representative of a sound field by the convolutional integrators 5, 7, 9, 11, the memories 6, 8, 10, 12 or the controllers 50, 51, 52, 53, and the adders 15, 16. Thereafter, the digital signals are amplified by the power amplifiers 21, 22 and then supplied to the headphones 24. The correctors housed in the headphones 24 correct the signals with respect to the characteristics of the sound sources and headphones that are used, achieving such a reproducing effect as if reproduced sounds were radiated from loudspeakers located in the virtual sound source positions.

In FIGS. 6 and 8, only one listener 23 is shown. However, the audio reproduction apparatus may be arranged as shown in FIG. 9 or 10 if there are a plurality of listeners 23. FIG. 9 corresponds to FIG. 6 and shows an arrangement in which the stages subsequent to the convolutional integrators 5, 7, 9, 11 are branched off by the terminals 60~65. FIG. 10 corresponds to FIG. 8 and shows an arrangement in which the stages subsequent to the adders 15, 16 are branched off by the terminals 66, 67.

In these arrangements, after the signals are converted into digital signals bearing spatial information by the convolutional integrators 5, 7, 9, 11 and the memories 6, 8, 10, 12, the digital signals may be processed depending on the rotation of the head of each listener, without the need for as many sets of expensive D/A converters 3 and convolutional integrators 5, 7, 9, 11 as the number of listeners.

Therefore, only as many sets of the headphones 24, the digital angle detector 28, the angle-detecting signal processing circuits 31~35, the controllers 50~53, 54, 56 as the number of listeners are required, and audio signals can simultaneously be supplied to a plurality of listeners inexpensively.

If the digital angle detector 28 is used, then a movement of the head of the listener 23 produces signals Sd, Pa depending on the direction of the movement, and the count produced by the up/down counter 33 is of a value representative of the direction of the head of the listener 23. The count value is supplied through the address control circuit 34 as an address signal to a memory 35.

From the memory 35 are read digitally recorded impulse responses from the virtual sound source positions with respect to the reference direction of the head of the listener 23 corresponding to the orientation of the head to the ears of the listener 23, among the data in the table shown in FIG. 4, or control signals representative of time differences and level differences between the ears of the listener 23, as shown in FIG. 7. The data thus read from the memory 35 are supplied to the convolutional integrators 5, 7, 9, 11 and the memories 6, 8, 10, 12 or the controllers 50, 51, 52, 53, 54, 56.

If the analog angle detector 38 for detecting the rotation of the head is used, then an output signal from the analog angle detector 38 is amplified by the amplifier 42 and then converted into a digital signal depending on the orientation of the head of the listener 23 by the A/D converter 43. The digital signal is supplied through the through the address control circuit 34 as an address signal to the memory 35. From the memory 35 are read digitally recorded impulse responses from the virtual sound source positions with respect to the reference direction of the head of the listener 23 corresponding to the orientation of the head to the ears of the listener 23, among the data in the table shown in FIG. 4, or control signals representative of time differences and level differences between the ears of the listener 23, as shown in FIG. 7. The data thus read from the memory 35 are supplied to the convolutional integrators 5, 7, 9, 11 and the memories 6, 8, 10, 12 or the controllers 50, 51, 52, 53, 54, 56.

The correctors housed in the headphones 24 have one or both of the corrective characteristics inherent in the sound sources and the corrective characteristics inherent in the headphones which sound sources and headphones have been used to measure the impulse responses or the control signals. Consequently, the signals can be processed on a real-time basis because the digital signals containing these corrective data are processed at one time.

Since the audio signals L, R thus supplied to the headphones 24 have been corrected with the digitally recorded impulse responses from the virtual sound source positions with respect to the reference direction of the head of the listener 23 corresponding to the orientation of the head to the ears of the listener 23, or the control signals representative of time differences and level differences between the ears of the listener 23, the audio signals L, R are capable of generating a sound field as if it were reproduced by a plurality of loudspeakers placed in the virtual sound source positions.

Because control signals which are representative of time differences and level differences between the ears of the listener 23 and are digitally recorded in the table of the memory 35 are read and supplied purely electronically so as to correct, with the controllers 50, 51, 52, 53, the digital signals convoluted by the convolutional integrators 5, 7, 9, 11 and the memories 6, 8, 10, 12, no time delay is introduced in varying the characteristics of the audio signals depending on the orientation of the head of the listener 23, and hence no unnatural sound reproduction will result.

While the signals are directly supplied to the headphones 24 over signal lines in the above embodiment, they may be transmitted to the headphones 24 in a wireless fashion as described below. In the transmitting device of the audio reproduction apparatus, the digital signal series which has been subjected with the impulse responses to convolutional integration by the convolutional integrators 5, 7, 9, 11 and the memories 6, 8, 10, 12 is supplied to the multiplexer 162. Then, the digital signal series is multiplexed by the multiplexer 162, modulated according to a given process by the modulator 163, and transmitted as an electromagnetic wave by the transmitting device 164.

FIG. 12 shows by way of example of a receiving device in the audio reproduction apparatus. The receiving device shown in FIG. 12 is combined with the transmitting device shown in FIG. 11A. As shown in FIG. 12, the electromagnetic wave convolutionally integrated and transmitted from the transmitting device shown in FIG. 11A is received by a receiver 165, demodulated by a demodulator 16, and separated into digital audio signals by a demultiplexer 167. The digital audio signals separated by the demultiplexer 167 are supplied respectively to controllers 50, 51, 52, 53.

In the controllers 50, 51, 52, 53, a movement of the head of a listener 23 with respect to a reference direction is converted into a digital address signal representing a magnitude of the movement including its direction in which the head of the listener 23 presently faces, through each constant angle or predetermined angle. The digital audio signals are corrected on a real time basis by control signals which represent time differences and level differences between the ears of the listener 23 from the virtual sound source positions to the ears.

The digital audio signals which have been corrected in the controllers 50, 51, 52, 53 are added into two-channel digital audio signals by the adders 15, 16. Reverberation signals are directly supplied to the adders 15, 16.

The digital signals are then converted by respective D/A converters 19, 20 into analog signals, which are amplified by power amplifiers 21, 22 and supplied to headphones 24 worn by the listener 23. The two-channel digital signals are further corrected by the correctors housed in the headphones 24 into characteristics inherent in sound sources or headphones that have been used to measure the control signals. The correctors have corrective characteristics inherent in the sound sources and corrective characteristics inherent in the headphones which sound sources and headphones have been used to measure the impulse responses from the virtual sound source positions to the ears of the listener 23. The listener 23 is now allowed to listen to reproduced sounds from the right and left sound generators 25, 26 of the headphones 24.

As described above, the audio signals and the digitally recorded impulse responses from the virtual sound source positions to the ears of the fixed listener 23 with respect to the reference direction are subjected to convolutional integration in the convolutional integrators 5, 7, 9, 11 and the memories 6, 8, 10, 12. The audio signals are then transmitted as an electromagnetic wave from the transmitter 164. The electromagnetic wave received by the receiver 165 is processed into audio signals that are corrected, in the controllers 50, 51, 52, 53, on a real time basis by control signals which represent time differences and level differences between the ears of the listener 23 from the virtual sound source positions to the ears in the direction in which the head of the listener 23 presently faces, with respect to the reference direction of the head. The audio signals are then corrected based on one or both of the corrective characteristics of the sound sources and the headphones that have been used to measure the control signals. Therefore, it is possible to effect digital signal processing including simultaneous correction on a real-time basis in a wireless fashion.

FIG. 11B shows another transmitting device for use in the audio reproduction apparatus. The results of convolutional integration effected on audio signals and impulse responses by the convolutional integrator 5, the memory 6, the convolutional integrator 9, and the memory 10 are supplied to the adder 15 and added thereby. The results of convolutional integration effected on audio signals and impulse responses by the convolutional integrator 7, the memory 8, the convolutional integrator 11, and the memory 12 are supplied to the adder 16 and added thereby.

At this time, reverberation signals produced by reverberation circuits 13, 14 are applied to the adders 15, 16. Left and right digital signals L, R in two channels that are supplied to the adders 15, 16 are supplied to the multiplexer 162. Multichannel digital signals, selected by the selectors 4, other than the left digital signal L and the right digital signal R can also be processed by the above circuits and supplied to the adders 15, 16.

The two-channel digital signals supplied to the adders 15, 16 may be converted into analog signals by D/A converters 160, 161, respectively, and the analog signals may then be supplied to the multiplexer 162.

FIG. 13 shows a receiving device according to another embodiment of the present invention in the audio reproduction apparatus. The receiving device shown in FIG. 13 is combined with the transmitting device shown in FIG. 11B. In FIG. 13, two-channel digital signals from the demultiplexer 167 are supplied respectively to the controllers 54, 56.

If the two-channel digital signals supplied to the adders 15, 16 in FIG. 11B are first converted into analog signals by the D/A converters 160, 161 and the analog signals are then supplied to the multiplexer 162, then the D/A converters 19, 20 may be dispensed with. In this case, only the D/A converters 160, 161 for the two channels may be required in the transmitting device, and if a plurality of receiving devices are employed, it is not necessary to provide as many D/A converters 19, 20 as the number of receiving devices.

In this embodiment, since digital or analog signals which have obtained spatial information through convolution of impulse responses are transmitted as electromagnetic waves in a wireless fashion from the transmitting device, the cords of the headphones 24 worn by a plurality of listeners 23 are not likely to become entangled, and receiving devices can simply be added without wiring and circuit modifications even when the number of listeners 23 is increased.

In the above embodiment, an electromagnetic wave is transmitted from the transmitter 164 of the transmitting device shown in FIG. 11B to the receiver 165 of the receiving device shown in FIG. 13. However, each of the transmitter 164 of the transmitting device shown in FIG. 11B and the receiver 165 of the receiving device shown in FIG. 13 may be a radio unit having a transmitter and a receiver, and an electromagnetic wave representing a signal processing modification signal from the receiving device to the transmitting device with respect to an electromagnetic wave transmitted from the transmitting device to the receiving device for modifying the signal processing in the transmitting device. For example, such a signal processing modification signal may be of such a nature as to modify the characteristics of the reverberation circuits 13, 14 or various characteristics that can be selected in the transmitting device.

With the above arrangement, it is possible to carry out bi-directional communications between the transmission device and the receiving device for allowing the listener 23 to control the apparatus highly conveniently. Since the bi-directional communications permit the listener 23 to control the transmitting device from the receiving device, the listener 23 associated with the receiving device can control various characteristics that can be selected in the transmitting device, e.g., switching between the multichannel digital stereophonic signal source 1 and the analog stereophonic signal source 2, and changing the memories 6, 8, 10, 12 for obtaining spatial information to increase the reproduction effect. Consequently, the listener 23 can control the apparatus highly conveniently.

Because reverberation signals produced by the reverberation circuits 13, 14 are added, and the added reverberation signals produce sounds which the listener 23 hears as if reflected or reverberated from hall walls, the listener 23 can listen to the reproduced sounds with such a presence as attained if the listener 23 were listening to music sounds in a famous concert hall.

The correcting circuits for correcting the inherent characteristics of the sound sources and the headphones 24 that are used to measure the impulse responses may be disposed in the headphones 24 themselves, or connectors which interconnect the apparatus and the headphones 24 or a subsequent stage, or the wireless headphones 24. With this arrangement, when headphones of a different type is used, it is not necessary to modify corrective data for the new headphones in a main apparatus section. The listener 23 can therefore handle the apparatus highly conveniently.

In the above embodiment, only the correcting circuits for correcting the inherent characteristics of the sound sources and the headphones 24 that are used to measure the impulse responses are incorporated. However, other selector switches for signal processing may also be incorporated. FIGS. 14 and 15 show headphones for use with the audio reproduction apparatus according to the present invention.

Figure 14:
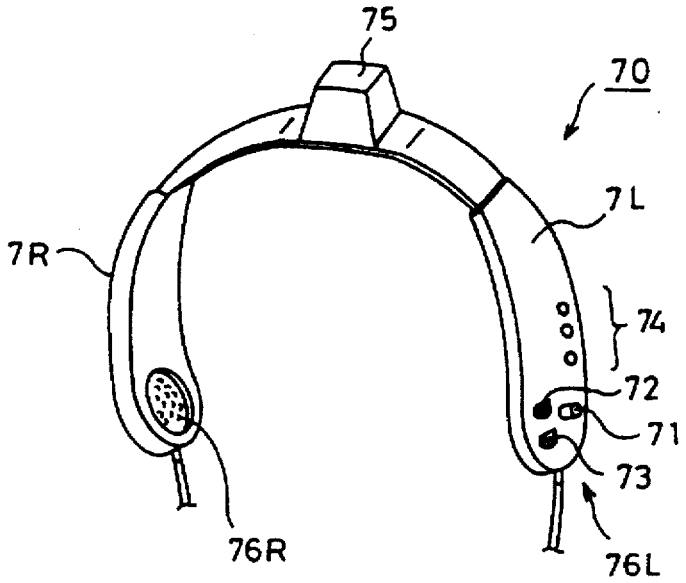
FIG. 14 is a view of headphones according to an embodiment of the present invention for the audio reproduction apparatus.

In FIG. 14, headphones 70 have a head rotation detector 75, a left arm 7L, and a right arm 7R. The right arm 7L houses a right unit 76R therein. The left arm 7L houses a left unit 76L therein, and supports on its outer surface a reset switch 71, a sound intensity or volume adjustment dial 72, a balance adjustment dial 73, and selector switches 74 for selecting sound sources, reverberations, and sound fields. Correcting circuits for correcting the characteristics inherent in the headphones are housed as electric circuits in the left and right arms 7L, 7R. However, mechanical and acoustic correcting circuits may be housed in the left and right units 76L, 76R.

Figure 15:
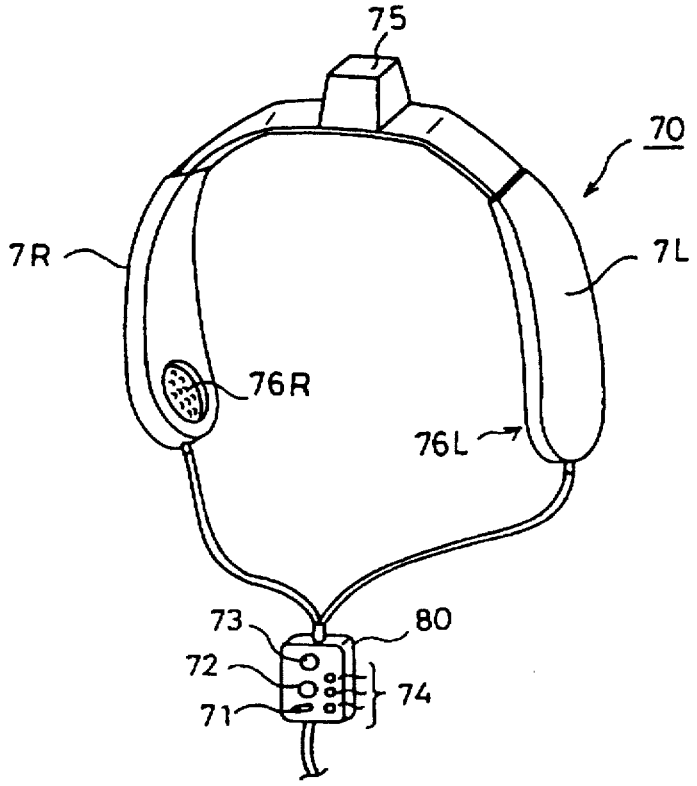
FIG. 15 is a view of headphones according to another embodiment of the present invention for the audio reproduction apparatus.

In FIG. 15, headphones 70 are connected to a remote control unit 80 which has a reset switch 71, a sound intensity or volume adjustment dial 72, a balance adjustment dial 73; and selector switches 74 for selecting sound sources, reverberations, and sound fields.

With the headphones 70 shown in FIGS. 14 and 15, only the correcting circuits for correcting the characteristics inherent in the headphones are associated with the headphones 70, and other circuits are contained in the main apparatus section, with the headphones 70 having their adjustment switches. This is because the correcting circuits for correcting the characteristics inherent in the headphones have a relatively low power requirement and do not impose a large power burden on the headphones 70. Therefore, other circuits which are of a low power requirement may also be associated with the headphones 70.

The headphones 70 shown in FIGS. 14 and 15 may be used with any of the audio reproduction apparatus shown in FIGS. 1, 6, 8, 9, 10, 11, 12, and 13. Particularly, the receiving device of each of the audio reproduction apparatus shown in FIGS. 11A and 11B through 13 receives signals and transmits various adjustment signals in a wireless manner, and the head rotation detector 75 includes a radio unit having receiving and transmitting units in addition to the digital angle detector 28.

If reproduced audio signals are signals including video information, then the listener 23 can use the various adjustment switches, referred to above, while watching video images for better control of the apparatus.

In the above embodiment, since the audio signals are corrected according to control signals indicative of the time differences between the ears and the level differences between the ears depending on the rotation of the individual heads of plural listeners 23, the audio signals can be reproduced simultaneously by a plurality of sets of headphones 24. Since it is not necessary to employ as many sets of expensive A/D converters 3 and convolutional integrators 5, 7, 9, 11 as the number of listeners 23, the audio reproduction apparatus is highly inexpensive.

In the above embodiments, since the correcting circuits 7L, 7R for correcting the characteristics inherent in the headphones, the reset switch 71, the sound intensity or volume adjustment dial 72, the balance adjustment dial 73, and the selector switches 74 for selecting sound sources, reverberations, and sound fields are disposed in and around the headphones 70 themselves, they can be operated on and around the headphones 70 for improved convenience.

If reproduced audio signals are signals including video information, then the listener 23 can use the reset switch 71 while watching video images for localizing sound images in front of the video images to increase the quality of reproduced sounds.

Inasmuch as the correcting circuits for correcting the characteristics inherent in the headphones are disposed in and around the headphones 70 themselves, when headphones of a different type is used, it is not necessary to modify, in the main apparatus section, corrective data for the new headphones.

Because the reset switch 71, the sound intensity or volume adjustment dial 72, the balance adjustment dial 73, and the selector switches 74 for selecting sound sources, reverberations, and sound fields are disposed in and around the headphones 70 themselves, if reproduced audio signals are signals including video information, then the listener 23 can adjust these switches while watching video images at all times for improved convenience.

Furthermore, since the signals are digitally processed, the capacity of the memory means is reduced for processing the signals at a high speed. Consequently, the audio signals can be corrected on a real-time basis with respect to the movement of the head of the listener.

Audio reproduction apparatus according to other embodiments of the present invention will be described in detail below with reference to FIGS. 16 through 27. The audio reproduction apparatus according to these embodiments include arrangements that are identical to those shown in FIGS. 2 through 5, and hence those arrangements will not be described below.

The audio reproduction apparatus according to these embodiments allow a listener to perceive sound images with the same localization, sound field, etc. when audio signals are reproduced with headphones, as if they were reproduced by loudspeakers located in a predetermined positional relationship, particularly in such a manner that when playback channels are changed, a plurality of reproduced sound images can be localized by the changed playback channels.

Specifically, the audio reproduction apparatus according to the embodiments are used in a system for reproducing, with headphones, a multichannel audio signal that has been recorded in a stereophonic mode or the like. Particularly, the audio reproduction apparatus are used for reproducing, with headphones, digital audio signals recorded or transmitted in respective channels with a view to localizing respective sound images in a predetermined positional relationship (e.g., at right, left, and central positions in front of the listener, and other positions), while decoding or encoding playback channels and localizing reproduced sound images in a plurality of channels with the changed playback channels.

Figure 16:
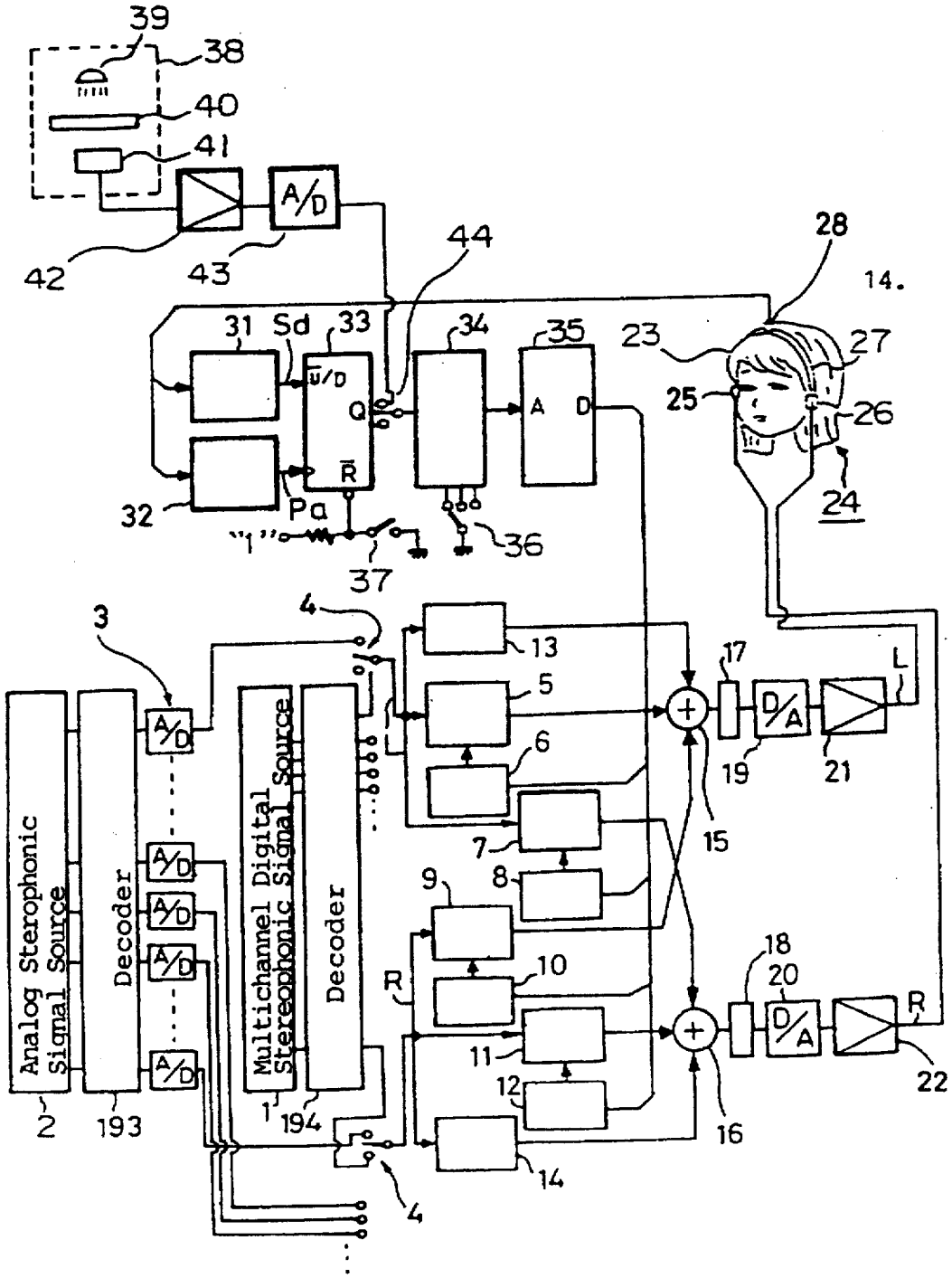
FIG. 16 is a block diagram of an audio reproduction apparatus according to a still further embodiment of the present invention.

FIG. 16 shows an audio reproduction apparatus according to the present invention. As shown in FIG. 16, a multichannel digital stereophonic signal source 1 may be a digital audio disc (e.g., a compact disc), a digital satellite broadcasting system, and so on. An analog stereophonic signal source 2 may be an analog record, an analog broadcasting system, and so on. Digital and analog signals from the digital stereophonic signal source 1 and the analog stereophonic signal source 2 are audio signals in a plurality of channels.

The analog signals are converted into digital signals by as many A/D converters 3 as the number of channels if the analog signals are multichannel analog signals. Selectors 4 select either signals which have been inputted as digital signals or signals which have been inputted as analog signals, as digital signals represented by a constant sampling frequency and a constant number of quantizing bits. While two-channel selectors 4 are shown in FIG. 1, as many selectors 4 may be provided as the number of channels if the supplied signals are multichannel signals.

A left digital signal L of the digital signal series is supplied to a convolutional integrator 5. The convolutional integrator 5 is associated with a memory 6 which stores a set of digitally recorded impulse responses that are represented by a constant sampling frequency and a constant number of quantizing bits from a virtual sound source position to the ears of a listener 23, in the direction in which the head of the listener 23 presently faces with respect to a reference direction of the head. In the convolutional integrator 5, the digital signal series is subjected with the impulse responses read from the memory 6 to convolutional integration on a real-time basis. A convolutional integrator 7 and a memory 8 supply a crosstalk component of a right digital signal R.

The right digital signal R is supplied to a convolutional integrator 11. The convolutional integrator 11 is associated with a memory 12 which stores a set of digitally recorded impulse responses that are represented by a constant sampling frequency and a constant number of quantizing bits from a virtual sound source position to the ears of the listener 23, in the direction in which the head of the listener 23 presently faces with respect to a reference direction of the head. In the convolutional integrator 11, the digital signal series is subjected with the impulse responses read from the memory 12 to convolutional integration on a real-time basis. A convolutional integrator 9 and a memory 10 supply a crosstalk component of the left digital signal L.

The digital signal series that have been subjected to convolutional integration with the impulse responses in the convolutional integrators 5, 7, 9, 11 and the memories 6, 8, 10, 12 are supplied to adders 15, 16. The two-channel digital signals added by the adders 15, 16 are corrected by correcting circuits 17, 18 to remove therefrom characteristics inherent in sound sources and headphones which are used, and then converted by respective D/A converters 19, 20 into analog signals, which are amplified by power amplifiers 21, 22. Thereafter, the signals are supplied to headphones 24 in playback channels decoded by decoders 193, 194.

Figure 17:
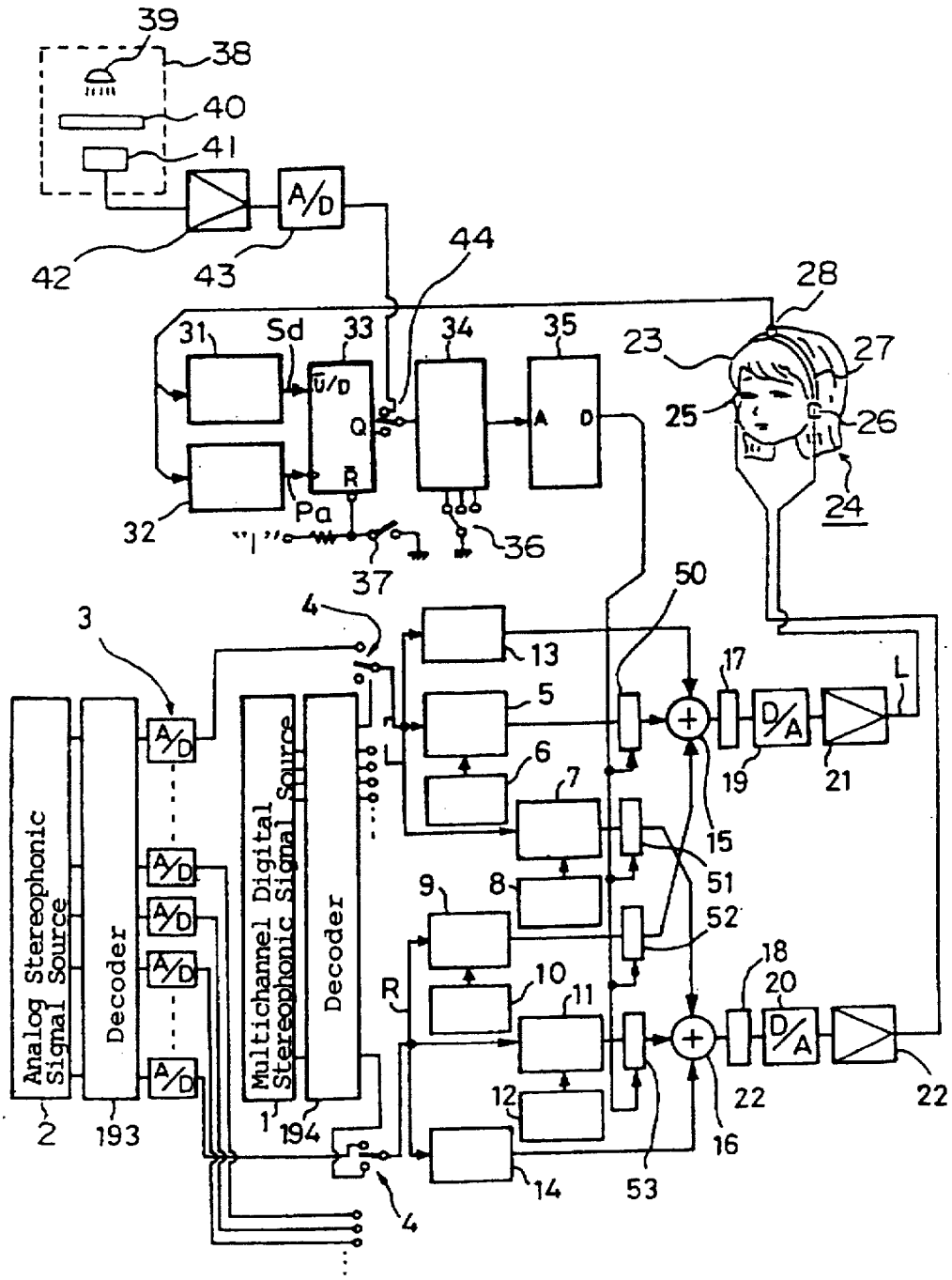
FIG. 17 is a block diagram of an audio reproduction apparatus according to a yet further embodiment of the present invention.

In the above embodiment, the impulse responses are stored in the memories 6, 8, 10, 12, and the digital signals are corrected by only the impulse responses. However, the audio reproduction apparatus may be arranged as shown in FIG. 17. Specifically, the memories 6, 8, 10, 12 associated with the convolutional integrators 5, 7, 9, 11 store a pair of digitally recorded impulse responses from virtual sound source positions to the ears, with respect to the head that is fixed with respect to the reference direction. The digital signal series are subjected with the impulse responses to convolutional integration on a real-time basis. A memory 35 stores control signals representative of time differences and level differences between the ears of the listener 23 from the virtual sound source positions to the ears with respect to the reference direction of the head.

With respect to each of the digital signals subjected to convolutional integration in each of the channels, a detected movement of the head with respect to the reference direction is converted into a digital address signal representing a magnitude of the movement including its direction, through each constant angle or predetermined angle. The address signals are used to read control signals from the memory 35, and the digital signals are corrected and modified on a real-time basis in controllers the 50, 51, 52, 53. The corrected signals are then supplied to adders 15, 16. In this case, playback channels are also decoded by decoders 193, 194.

Figure 18:
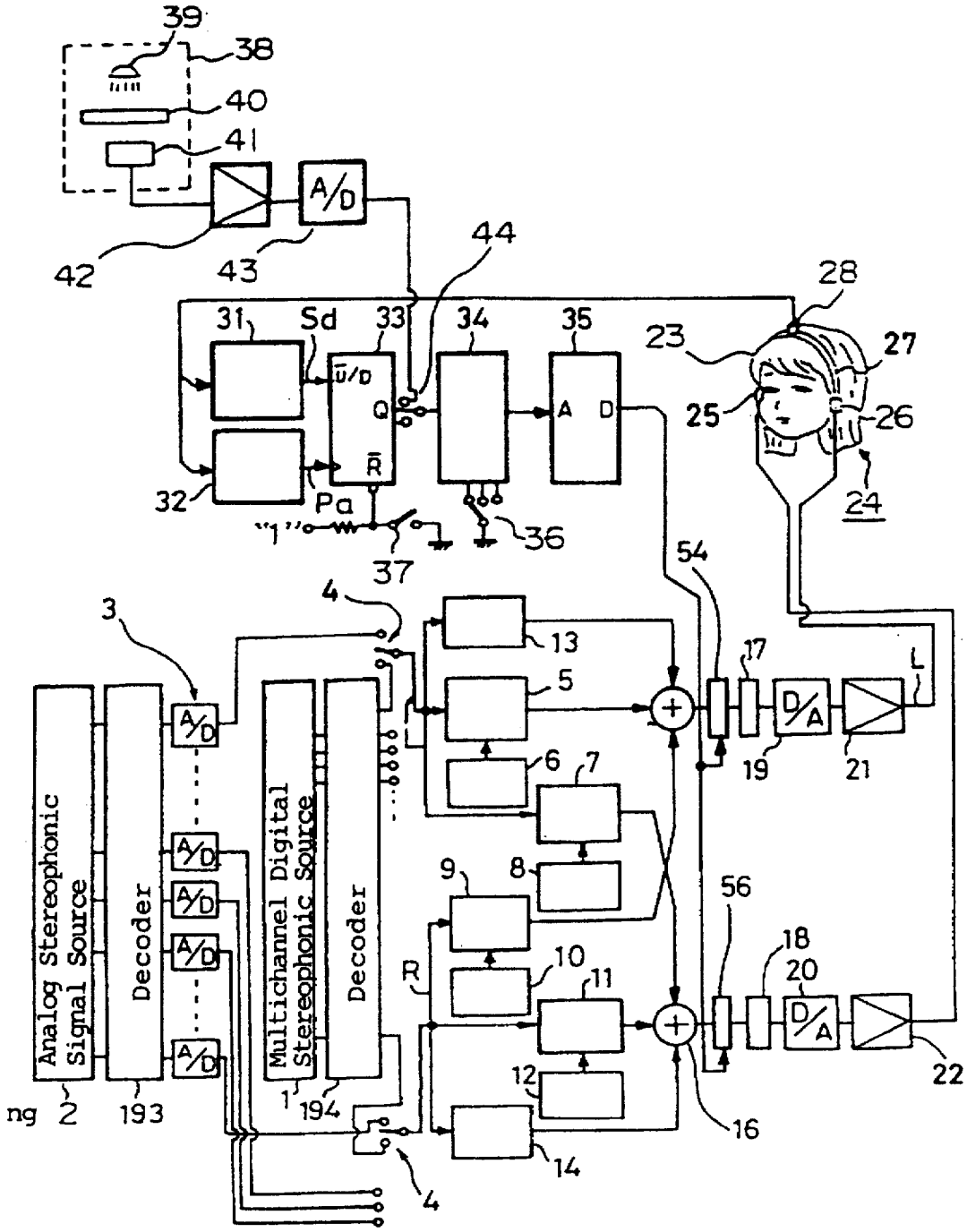
FIG. 18 is a block diagram of an audio reproduction apparatus according to a yet still further embodiment of the present invention.

Alternatively, as shown in FIG. 18, the digital signal series that have been subjected with the impulse responses to convolutional integration on a real-time basis are supplied to the adders 15, 16, and, with respect to each of the two-channel digital signals from the adders 15, 16, a detected movement of the head with respect to the reference direction is converted into a digital address signal representing a magnitude of the movement including its direction, through each constant angle or predetermined angle. The address signals are used to read control signals from the memory 35, and the digital signals are corrected and modified on a real-time basis in the controllers 54, 56. In this case, playback channels are also decoded by the decoders 193, 194.

Each of the controllers 50, 51, 52, 53, 54, 56 may comprise a combination of a variable delay device and a variable level control unit or a level control unit for varying the levels in respective frequency bands, e.g., a graphic equalizer having a number of divided bands. The information stored in the memory 35 may be impulse responses representing a time difference and a level difference between the ears of the listener 23 from the virtual sound source position to the ears in the direction in which the head of the listener 23 presently faces with respect to the reference direction of the head. In this case, each of the controllers 50, 51, 52, 53, 54, 56 may comprise an IIR or FIR variable digital filter.

In this manner, the controllers give spatial information, and the digital signals corrected with respect to the characteristics inherent in the sound sources and headphones which are used and varied with respect to the movement of the head are converted by the D/A converters 19, 20 into analog signals. The analog signals are amplified by the power amplifiers 21, 22, and then supplied to the headphones 24.

The correcting circuits 17, 18 for correcting the characteristics inherent in the sound sources and headphones may be circuits for carrying out analog signal processing or digital signal processing, and may be incorporated in the headphones if the headphones are of the wireless type. The correcting circuits 17, 18 may not necessarily be housed in the headphones 24 themselves, but may be disposed in the cords of the headphones 24, or connectors which interconnect the apparatus and the cords of the headphones 24 or a subsequent stage, or the controllers in the apparatus or a subsequent stage.

At the time the signal Sd is supplied to the count direction input terminal U/D of the up/down counter 33, the pulses Pa are supplied to the clock input terminal (count input) CK of the up/down counter 33. The up/down counter 33 produces a count output signal that is converted into a digital address signal representative of the direction and the magnitude of turning movement of the head of the listener 23. The digital address signal is supplied through the address control circuit 34 as an address signal to the memories 6, 8, 10, 12.

In response to the supplied address signal, the memories 6, 8, 10, 12 read, from corresponding addresses of tables therein, digitally recorded impulse responses from the virtual sound source positions with respect to the reference direction of the head of the listener 23 to the ears of the listener 23. At the same time, the digital audio signals in the respective channels and the impulse responses are subjected to convolutional integration in the convolutional integrators 5, 7, 9, 11, thus correcting the signals in the direction in which the head of the listener 23 is now oriented, on a real-time basis.

In FIG. 16, an analog output signal from the analog angle detector 38 is amplified by the amplifier 42 and then applied to the A/D converter 43. The A/D converter 43 supplies a digital output signal through the switch 44 to the address control circuit 34. The address control circuit 34 generates a digital address signal representing the magnitude of the movement of the head of the listener 23 including the direction through each constant angle or predetermined angle, with respect to the reference direction, and supplies the digital address signal as an address signal to the memories 6, 8, 10, 12.

In response to the supplied address signal, the memories 6, 8, 10, 12 read, from corresponding addresses of tables therein, digitally recorded impulse responses from the virtual sound source positions with respect to the reference direction of the head of the listener 23 to the ears of the listener 23. At the same time, the digital audio signals in the respective channels and the impulse responses are subjected to convolutional integration in the convolutional integrators 5, 7, 9, 11, thus correcting the signals in the direction in which the head of the listener 23 is now oriented, on a real-time basis.

In FIG. 17, in response to the supplied address signal, the memory 35 reads, from corresponding addresses of a table therein, digitally recorded control signals which represent time differences and level differences between the ears of the listener 23 from the virtual sound source positions with respect to the reference direction of the head to the ears. Then, the control signals and digital audio signals in the respective channels which have been subjected with the impulse responses to convolutional integration by the convolutional integrators 5, 7, 9, 11 and the memories 6, 8, 10, 12 associated respectively therewith are corrected on a real-time basis in the direction in which the head of the listener 23 presently faces, by the controllers 50, 51, 52, 53. In FIG. 18, the control signals and the two-channel audio signals from the adders 15, 16 are also corrected by the correctors 54, 56 in the same manner described above.

The audio reproduction apparatus of the above embodiments are arranged as described above, and operate as follows: Digital audio signals in the respective channels from the multichannel digital stereophonic signal source 1, or digital audio signals in the respective channels which are converted by the A/D converters 3 from analog signals that are inputted to the analog stereophonic signal source 2 are selected by the selectors 4. In FIG. 16, the digital signal series is subjected with the impulse responses read from the memories 6, 8, 10, 12 to convolutional integration by the convolutional integrators 5, 7, 9, 11 on a real-time basis, and then supplied to the adders 15, 16.

In FIG. 17, the digital audio signals in the respective channels that have been subjected with the impulse responses to convolutional integration by the convolutional integrators 5, 7, 9, 11 and the memories 6, 8, 10, 12 are corrected and modified by control signals read from the memory 35 in the controllers 50, 51, 52, 53, and then supplied to the adders 15, 16. In FIG. 18, the two-channel digital signals from the adders 15, 16 are corrected and modified by control signals read from the memory 35 in the controllers 54, 56.

The two-channel digital signals are converted by the respective D/A converters 19, 20 into analog signals, which are amplified by the power amplifiers 21, 22. Thereafter, the signals are supplied to the headphones 24 in playback channels decoded by the decoders 193, 194.

The listener 23 who wears the headphones 24 can thus listen to audio signals reproduced thereby. In the digital angle detector 28 or the analog angle detector 38, the movement of the head of the listener 23 with respect to the reference direction is detected through each constant angle or predetermined angle, and converted into a digital address signal representing a magnitude of the movement including its direction by the address control circuit 34.

The address signal is used to read, from the memory 35, digitally recorded impulse responses or control signals from virtual sound source positions with respect to the reference direction of the head to the ears of the listener 23. The impulse responses or control signals and the audio signals are corrected and modified on a real-time basis by the convolutional integrators 5, 7, 9, 11 and the memories 6, 8, 10, 12 or the controllers 50, 51, 52, 53, 54, 56.

The convolutional integrators 5, 7, 9, 11 and the memories 6, 8, 10, 12 or the controllers 50, 51, 52, 53, 54, 56 convert the signals into digital signals in two channels which bear spatial information representative of a sound field. The digital signals are corrected with respect to the characteristics of the sound sources and headphones that are used, by the correcting circuits 17, 18, and then amplified by the power amplifiers 21, 22. Thereafter, the signals are supplied to the headphones 24 in playback channels decoded by the decoders 193, 194. In this manner, the audio reproduction apparatus can produce such a reproducing effect through the playback channels as if reproduced sounds were radiated from loudspeakers located in the virtual sound source positions.

In FIGS. 16, 17, and 18, only one listener 23 is shown. However, if there are a plurality of listeners 23, then the audio reproduction apparatus may be arranged such that the stages subsequent to the convolutional integrators 5, 7, 9, 11 shown in FIG. 17 are branched off by terminals or the Stages subsequent to the adders 15, 16 shown in FIG. 18 are branched off by terminals through transmission paths.

In these arrangements, after the signals are converted into digital signals bearing spatial information by the convolutional integrators 5, 7, 9, 11 and the memories 6, 8, 10, 12, the digital signals may be processed depending on the rotation of the head of each listener, without the need for as many sets of expensive D/A converters 3 and convolutional integrators 5, 7, 9, 11 as the number of listeners.

Therefore, only as many sets of the headphones 24, the digital angle detector 28, the angle-detecting signal processing circuits 31~35, the controllers 50~53, 54, 56 as the number of listeners are required, and audio signals can simultaneously be supplied to a plurality of listeners inexpensively.

When the listener 23 moves the head, the digital angle detector 28 or the analog angle detector 38 produce digital or analog signals depending on the orientation of the head of the listener 23, and the signals are of values depending on the orientation of the head of the listener 23. The signals are then supplied through the address control circuit 34 as an address signal to the memories 6, 8, 10, 12 or the memory 35. In FIG. 16, the address is supplied directly to the memories 6, 8, 10, 12 without passing through the memory 35. In FIGS. 17 and 18, the address is supplied to the memory 35.

From the memories 6, 8, 10, 12 or the memory 35, there are read digitally recorded impulse responses from the virtual sound source positions with respect to the reference direction of the head of the listener 23 corresponding to the orientation of the head to the ears of the listener 23, among the data in the table shown in FIG. 4, or control signals representative of time differences and level differences between the ears of the listener 23, as shown in FIG. 7. The data thus read are supplied to the convolutional integrators 5, 7, 9, 11 or the controllers 50, 51, 52, 53, 54, 56.

If the analog angle detector 38 for detecting the rotation of the head is used, then an output signal from the analog angle detector 38 is amplified by the amplifier 42 and then converted into a digital signal depending on the orientation of the head of the listener 23 by the A/D converter 43. The digital signal is supplied through the through the address control circuit 34 as an address signal to the memories 6, 8, 10, 12 or the memory 35. From the memories 6, 8, 10, 12 or the memory 35 are read digitally recorded impulse responses from the virtual sound source positions with respect to the reference direction of the head of the listener 23 corresponding to the orientation of the head to the ears of the listener 23, among the data in the table shown in FIG. 4, or control signals representative of time differences and level differences between the ears of the listener 23, as shown in FIG. 7. The data thus read are supplied to the convolutional integrators 5, 7, 9, 11 or the controllers 50, 51, 52, 53, 54, 56.

The correcting circuits 17, 18 have one, a combination of some, or all of the corrective characteristics inherent in the sound sources, sound field, and headphones which have been used. Consequently, the signals can be processed on a real-time basis because the digital signals containing these corrective data are processed at one time.

Since the audio signals L, R thus supplied to the headphones 24 have been corrected with the digitally recorded impulse responses from the virtual sound source positions with respect to the reference direction of the head of the listener 23 corresponding to the orientation of the head to the ears of the listener 23, or the control signals representative of time differences and level differences between the ears of the listener 23, the audio signals L, R are capable of generating a sound field as if it were reproduced by a plurality of loudspeakers placed in the virtual sound source positions.

Because control signals which are representative of time differences and level differences between the ears of the listener 23 and are digitally recorded in the table of the memory 35 are read and supplied purely electronically so as to correct, with the controllers 50, 51, 52, 53, the digital signals convoluted by the convolutional integrators 5, 7, 9, 11 and the memories 6, 8, 10, 12, no time delay is introduced in varying the characteristics of the audio signals depending on the orientation of the head of the listener 23, and hence no unnatural sound reproduction will result.

While the signals are directly supplied to the headphones 24 over signal lines in the above embodiments, they may be transmitted to the headphones 24 in a wireless fashion as described below. In FIG. 17, a modulator and a transmitter may be connected as stages subsequent to the convolutional integrators 5, 7, 9, 11 for transmitting signals, and a receiver and a demodulator may be connected in association with headphones 24 for receiving transmitted signals. Alternatively, in FIG. 18, a modulator and a transmitter may be connected as stages subsequent to the adders 15, 16 for transmitting signals, and a receiver and a demodulator may be connected in association with headphones 24 for receiving transmitted signals.

The memory 35 has a plurality of tables for the listener 23 to choose from with the selector 36 to achieve optimum characteristics irrespective of different head and auricle configurations of a different listener 23 and different characteristics of different headphones 24 used.

In the above embodiments, based on an angle-depending signal from the digital angle detector 28 or the analog angle detector 38 as angle detecting means, the memories 6, 8, 10, 12 or the memory 35 as storage means are addressed by an address signal from the address control circuit 34 as address signal converting means to read impulse responses or control signals recorded in the memories 6, 8, 10, 12 or the memory 35. The audio signals are corrected by the impulse responses or control signals in the convolutional integrators 5, 7, 9, 11, the memories 6, 8, 10, 12, and the controllers 50, 51, 52, 53, 54, 56 as control means on a real-time basis with respect to the movement of the head of the listener or listeners 23. The audio signals corrected by the convolutional integrators 5, 7, 9, 11, the memories 6, 8, 10, 12, and the controllers 50, 51, 52, 53, 54, 56 are reproduced by the headphones 24 as audio reproducing means so as to localize reproduced sound images in a number of channels other than the number of channels converted by the decoder 193 as channel number converting means.

Figure 19:
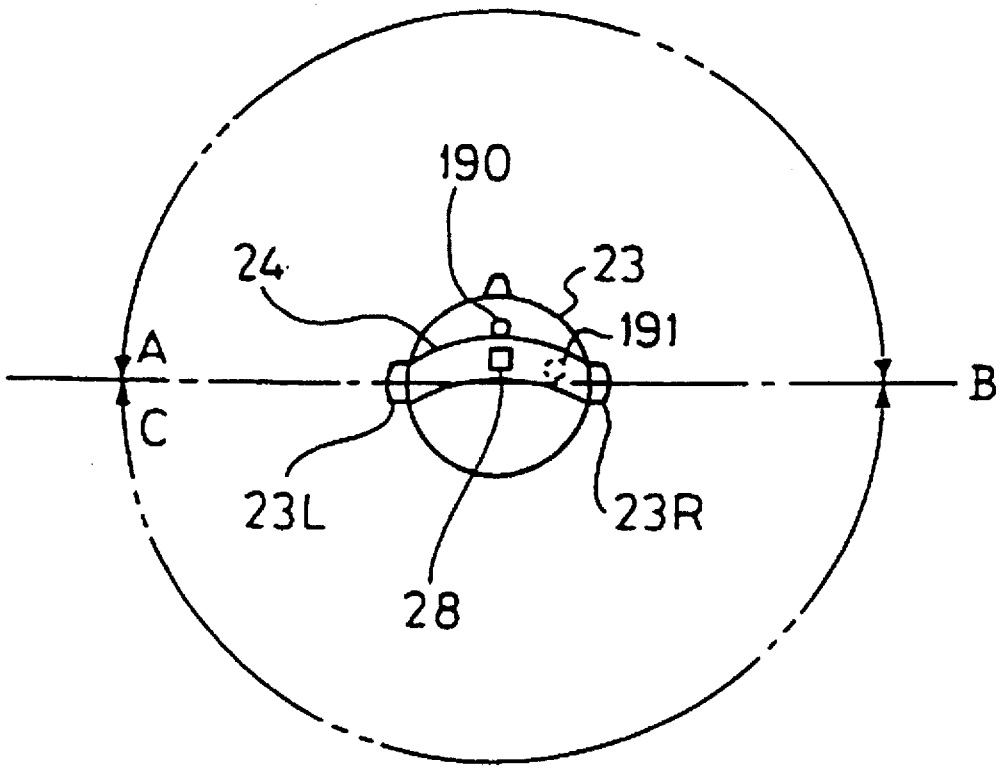
FIG. 19 is a view showing a simulated loudspeaker arrangement for the audio reproduction apparatus.

FIGS. 19 through 25 show simulated loudspeaker arrangements for the audio reproduction apparatus according to the present invention. As shown in FIG. 19, headphones 24 can localize a sound image reproduced from audio signals in playback channels of the audio signals that have been modified by the decoders 193, 194 shown in FIGS. 16, 17, and 18. For example, audio signals in two out of five channels are indicated, and a reproduced sound image can be localized by a simulation of loudspeakers in two channels.

Playback channels can be indicated and also the simulation of the type or distance of loudspeakers in the playback channels can be modified by the decoders 193, 194.

In the above embodiment, a plurality of channels for audio signals are modified by the decoder 193. However, the decoder 193 may be replaced with an encoder for increasing playback channels.

The simulation of an arrangement of loudspeakers is carried out as follows: First, as shown in FIG. 19, a sound image is localized such that loudspeakers are positioned in a range A that lies forward of a straight line interconnecting the ears 23L, 23R of a listener 23. Then, a sound image is localized such that loudspeakers are positioned in a range B that lies on the straight line interconnecting the ears 23L, 23R of the listener 23. Furthermore, a sound image is localized such that loudspeakers are positioned in a range C that lies rearward of the straight line interconnecting the ears 23L, 23R of the listener 23.

At this time, the listener 23 presses a reset switch 190 on the headphones 24 to establish a reference position for the rotation of the head of the listener 23. Alternatively, a reset switch 191 may be mounted on an inside surface of the headphones 24, so that the headphones 24 may be reset when the listener 23 wears the headphones 24 on the head.

In this embodiment, the digital angle detector 28 or the analog angle detector 38 has the reset switch 190 and the direction in which the listener 23 faces when the reset switch 190 is turned on is established as the reference direction. Therefore, any direction can be established as a front direction by operating the reset switch 190.

In this embodiment, furthermore, when the listener 23 faces in a predetermined reference direction, the digital angle detector 28 or the analog angle detector 38 establishes that direction as a reference direction. Consequently, the predetermined reference direction can automatically be established as the reference direction.

In this embodiment, moreover, the headphones 24 has the reset switch 190, and when the listener 23 wears the headphones 24 on the head, the digital angle detector 28 or the analog angle detector 38 establishes the direction in which the listener 23 faces as a reference direction. Accordingly, the direction in which the listener 23 faces is always established as a reference direction when the listener 23 wears the headphones 24 on the head.

Figure 20:
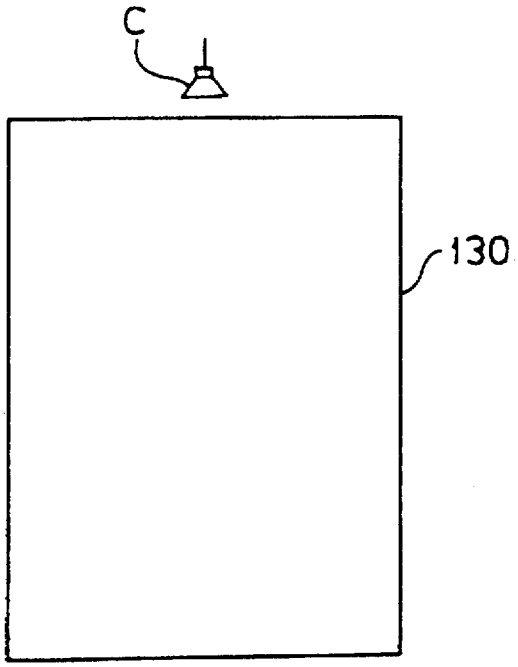
FIG. 20 is a view showing a simulated loudspeaker arrangement for one-channel monaural reproduction for the audio reproduction apparatus.

Specific simulated loudspeaker arrangements are shown in FIGS. 20 through 25. A simulated loudspeaker arrangement for one-channel monaural reproduction is shown in FIG. 20. In FIG. 20, audio signals are reproduced to localize a reproduced sound image such that a central loudspeaker C is positioned in front of the listener 23 at the center of an audience 130.

Figure 21:
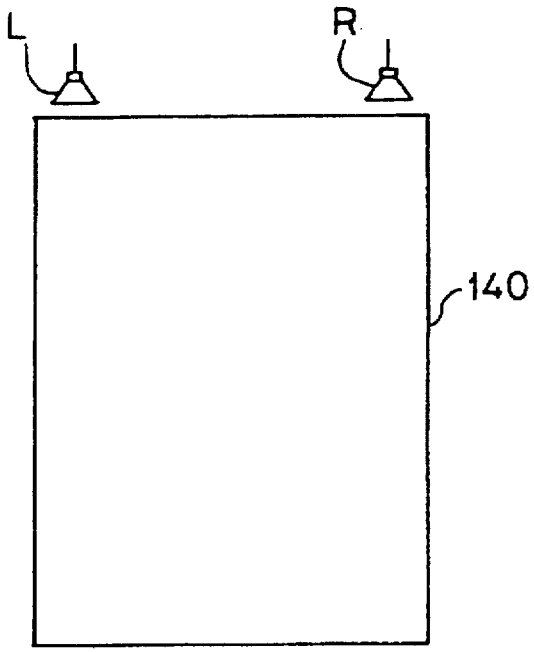
FIG. 21 is a view showing a simulated loudspeaker arrangement for two-channel stereophonic reproduction for the audio reproduction apparatus.

A simulated loudspeaker arrangement for two-channel stereophonic reproduction is shown in FIG. 21. In FIG. 21, audio signals are reproduced to localize reproduced sound images such that left and right loudspeakers L, R are positioned in front of the listener 23 at the left and right of an audience 140.

Figure 22:
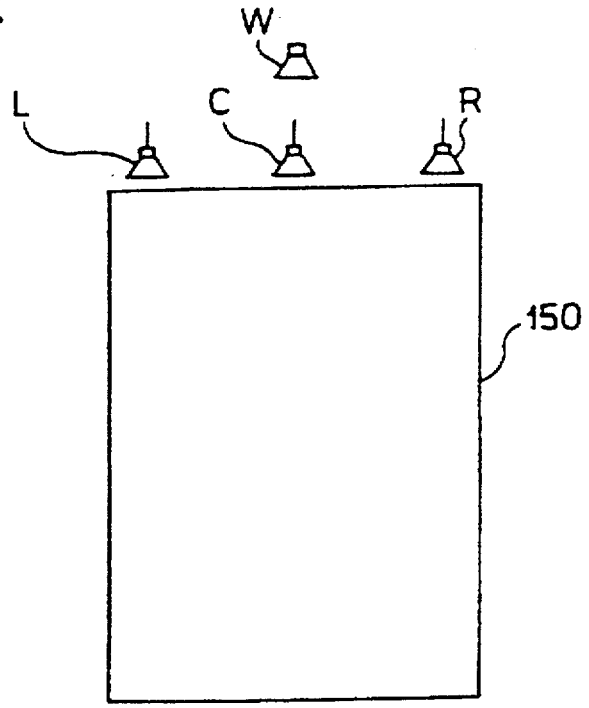
FIG. 22 is a view showing a simulated loudspeaker arrangement for three-channel reproduction for the audio reproduction apparatus.

A simulated loudspeaker arrangement for three-channel reproduction is shown in FIG. 22. In FIG. 22, audio signals are reproduced to localize reproduced sound images such that a central loudspeaker C is positioned in front of the listener 23 at the center of an audience 150, and left and right loudspeakers L, R are positioned at the left and right of a screen 151.

Figure 23:
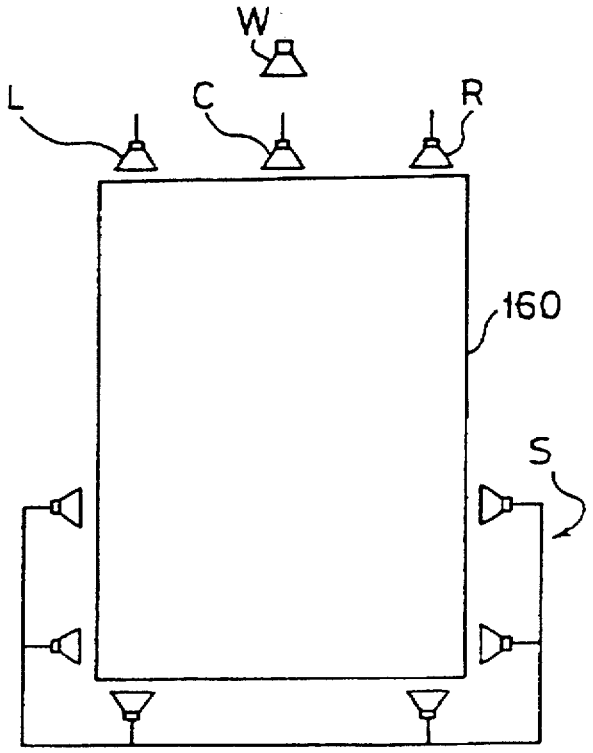
FIG. 23 is a view showing a simulated loudspeaker arrangement for four-channel reproduction for the audio reproduction apparatus.

A simulated loudspeaker arrangement for four-channel reproduction is shown in FIG. 23. In FIG. 23, audio signals are reproduced to localize reproduced sound images such that a central loudspeaker C is positioned in front of the listener 23 at the center of an audience 160, left and right loudspeakers L, R are positioned at the left and right of a screen 161, and surround loudspeakers S are positioned at the left and right of the rear end of the audience 160 and on the rear left and right sides of the audience 160.

Figure 24:
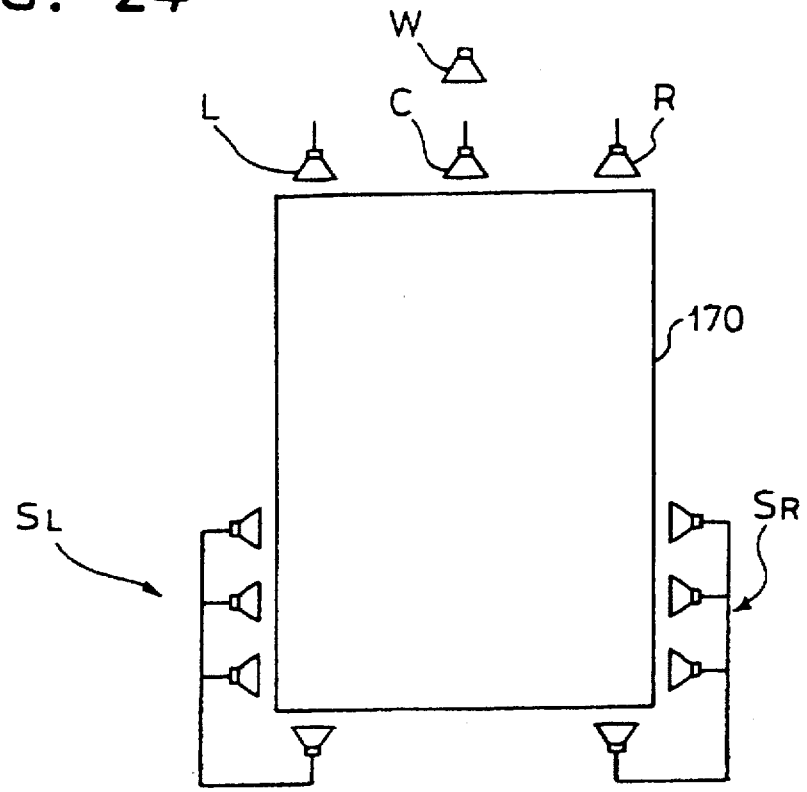
FIG. 24 is a view showing a simulated loudspeaker arrangement for five-channel reproduction for the audio reproduction apparatus.

A simulated loudspeaker arrangement for five-channel reproduction is shown in FIG. 24. In FIG. 24, audio signals are reproduced to localize reproduced sound images such that a central loudspeaker C is positioned at the center in front of the listener 23 located in an audience 160, left and right loudspeakers L, R are positioned at the left and right of a screen 171, surround left loudspeakers $S_L$ are positioned at the left of the rear end of the audience 170 and on the rear left side of the audience 170, and surround right loudspeakers $S_R$ are positioned at the right of the rear end of the audience 170 and on the rear right side of the audience 170.

Figure 25:
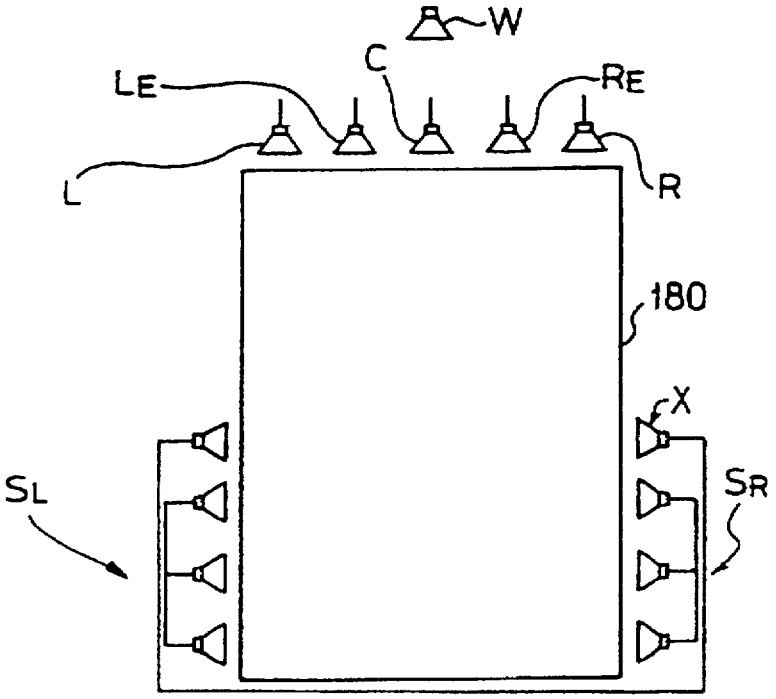
FIG. 25 is a view showing a simulated loudspeaker arrangement for front five-channel, rear two-channel reproduction for the audio reproduction apparatus.

A simulated loudspeaker arrangement for front five-channel, rear two-channel reproduction is shown in FIG. 25. In FIG. 25, audio signals are reproduced to localize reproduced sound images such that a central loudspeaker C is positioned at the center in front of the listener 23 located in an audience 180, left and right loudspeakers L, R are positioned at the left and right of a screen 181, a left extra loudspeaker $L_E$ is positioned between the central loudspeaker C and the left loudspeaker L, a right extra loudspeaker $R_E$ is positioned between the central loudspeaker C and the right loudspeaker R, surround left loudspeakers $S_L$ are positioned on the rear left side of the audience 180, and surround right loudspeakers $S_R$ are positioned on the rear right side of the audience 180. In addition, a subwoofer loudspeaker W for reproducing low-frequency sounds only may be positioned in the vicinity of the central loudspeaker C, for example. Eight-channel speakers X may be provided, and loudspeakers for reproducing eight channels or more may be provided.

In this embodiment, since the decoder 193 as the channel number converting means is a decoder for converting the number of plural channels into the other number of channels smaller than the number of plural channels depending on the number of plural channels for audio signals, reproduced sound images can be localized in a reduced number of channels.

In this embodiment, since the encoder as the channel number converting means is an encoder for converting the number of plural channels into the other number of channels greater than the number of plural channels depending on the number of plural channels for audio signals, reproduced sound images can be localized in an increased number of channels.

In this embodiment, since the decoder 193 as the channel number converting means is a decoder for converting the number of plural channels into the other number of channels smaller than the number of plural channels depending on the number of plural channels for audio signals, the simulation of the type of loudspeakers for reproducing audio signals can be changed depending on the other number of channels. Therefore, the simulation of the type of loudspeakers can be changed to localize the reproduced sound images as if there were reproduced from different loudspeakers.

In this embodiment, since the decoder 193 as the channel number converting means is a decoder for converting the number of plural channels into the other number of channels smaller than the number of plural channels depending on the number of plural channels for audio signals, the simulation of the distance of loudspeakers for reproducing audio signals can be changed depending on the other number of channels. Therefore, the simulation of the distance of loudspeakers can be changed to localize the reproduced sound images as if there were reproduced from a different distance.

In this embodiment, since the encoder as the channel number converting means is an encoder for converting the number of plural channels into the other number of channels greater than the number of plural channels depending on the number of plural channels for audio signals, in a manner to encode the signals corresponding to variations in the playback level added to audio signals according to such a process as disclosed in U.S. Pat. Nos. 3,959,590 or 4,074,083, a reproduced sound image can be localized as if it were reproduced by loudspeakers having a frequency range of large variations in Dolby mode.

In this embodiment, since the encoder as the channel number converting means is an encoder for converting the number of plural channels into the other number of channels greater than the number of plural channels depending on the number of plural channels for audio signals, the encoder having positional information corresponding to the other number of channel for modifying the simulation of the type of loudspeakers for reproducing audio signals with the positional information, a reproduced sound image can be localized in order to simulate a loudspeaker arrangement with the positional information of the encoder.

The above scheme is suitable for an application in which playback channels are changed by positional information to localize a reproduced sound image particularly in a game machine.

Figure 26:
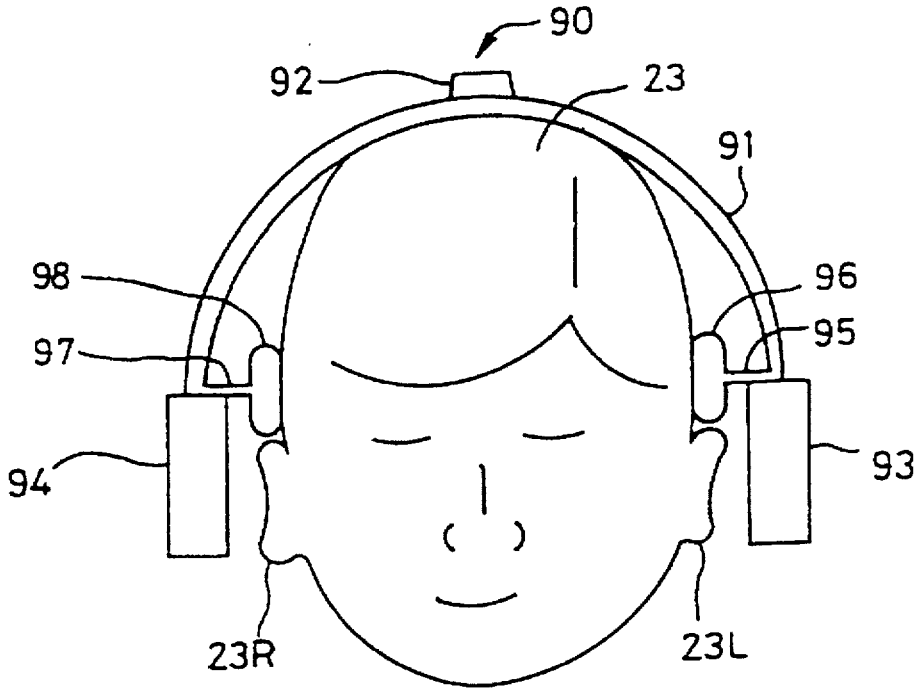
FIG. 26 is a view showing headphones in its entirety for the audio reproduction apparatus.

In FIG. 26, headphones 90 have a head rotation detector 92 and headphone units 93, 94 which are mounted on a head band 91. Supports 96, 98 project from respective support columns 95, 97 on inner sides of the head band 91 closely to the positions where the headphone units 93, 94 are mounted on the head band 91. The headphones 90 are thus worn by the listener 23 such that the headphone units 93, 94 are spaced a certain distance from the ears 23L, 23R of the listener 23. The head rotation detector 92 may be the digital angle detector 28 or the analog angle detector 38.

The headphone units 93, 94 as sound generators are supported so as not to press the ears 23L, 23R of the listener 23 by the support columns 95, 97 and the supports 96, 98 that are mounted on the head band 91 which serves as a head mounting body for mounting the headphones 90 as audio reproducing means on the head of the listener 23. Since the headphone units 93, 94 thus positioned have sound generating characteristics close to sound picking-up characteristics of audio signals, the radiation impedance from the inlets of the external canals to the exterior of the ears is close to the radiation impedance at the time no headphones are worn, making it easy to localize the reproduced sound image for thereby improving the feel that the listener has in wearing the headphones.

Figure 27:
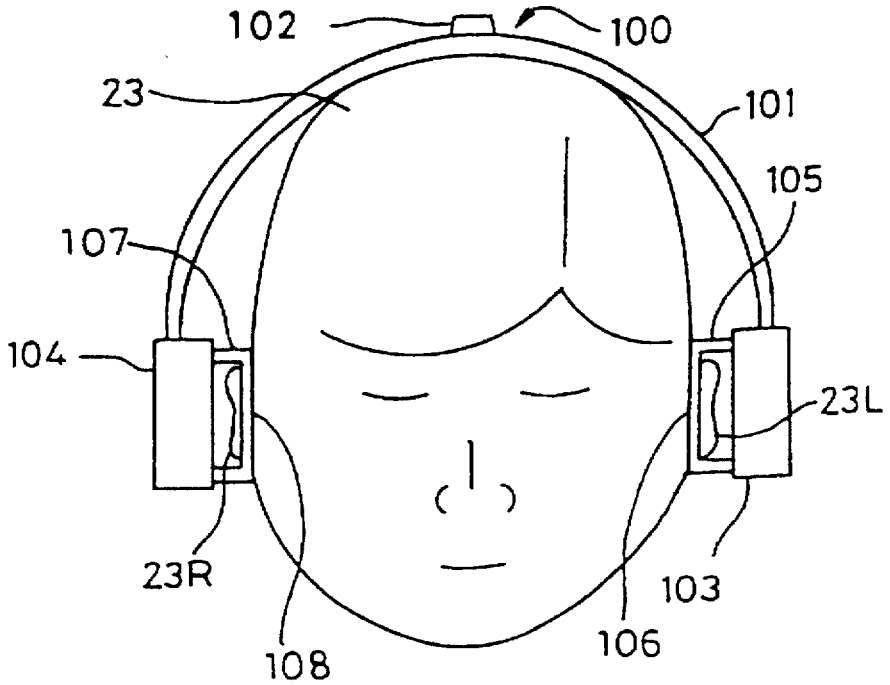
FIG. 27 is a view showing headphones in its entirety for the audio reproduction apparatus.

In FIG. 27, headphones 100 have a head rotation detector 102 and headphone units 103, 104 which are mounted on a head band 101. Contacts 106, 108 project from respective support columns 105, 107 on inner sides of the head band 101. The headphones 100 are thus worn by the listener 23 such that the headphone units 103, 104 are spaced a certain distance from the ears 23L, 23R of the listener 23. The head rotation detector 92 may be the digital angle detector 28 or the analog angle detector 38.

The headphone units 103, 104 as sound generators are supported so as not to press the ears 23L, 23R of the listener 23 by the support columns 105, 107 and the contacts 106, 108 that are mounted on the head band 91 which serves as a head mounting body for mounting the headphones 90 as audio reproducing means on the head of the listener 23. Since the headphone units 93, 94 thus positioned have sound generating characteristics close to sound picking-up characteristics of audio signals, the radiation impedance from the inlets of the external canals to the exterior of the ears is close to the radiation impedance at the time no headphones are worn, making it easy to localize the reproduced sound image for thereby improving the feel that the listener has in wearing the headphones.

In each of the above embodiments, the head rotation detector may comprise a vibratory gyro. The head rotation detector which comprises a vibratory gyro may be small in size and lightweight, have a low power requirement and a long service life, and can be handled with ease and manufactured inexpensively.

Since the vibratory gyro operates not under inertial forces but under the Coriori force, it does not need to be located near the center of rotation of the head of the listener 23, but may be installed anywhere in a rotation detecting device. Therefore, the head rotation detector can be of a simple arrangement and can be assembled with ease.

According to the present invention, based on a signal corresponding to an angle from the angle detecting means, the storage means is addressed by an address signal from the address signal converting means to read stored impulse responses or control signals therefrom, and audio signals are corrected by the impulse responses or control signals in the control means on a real-time basis with respect to the movement of the head of a listener or the heads of plural listeners. The audio signals corrected by the control means are reproduced by the audio reproducing means to localize a sound image in another number of channels different from the number of plural channels converted by the channel number converting means.

Audio reproduction apparatus according to other embodiments of the present invention will be described in detail below with reference to FIGS. 28 through 42. The audio reproduction apparatus according to these embodiments include arrangements that are identical to those shown in FIGS. 2 through 5, and hence those arrangements will not be described below.

The audio reproduction apparatus according to these embodiments reproduce audio signals which have been corrected depending on the movement of the head of a listener, from fixed loudspeakers that are placed in a predetermined positional relationship, and particularly allow the listener to perceive sound images with improved localization, sound field, etc. when the audio signals are reproduced by the loudspeakers located near the head of the listener.

Specifically, the audio reproduction apparatus according to these embodiments are used in a system for reproducing a multichannel audio signal that has been recorded in a stereophonic mode or the like with loudspeakers disposed near the head of the listener. Particularly, the audio reproduction apparatus are used for reproducing digital audio signals recorded or transmitted in respective channels with loudspeakers disposed near the head of the listener in a manner to correct the audio signals depending on the rotation of the head of the listener to reproduce the audio signals for giving the listener a predetermined sense of localization.

Figure 28:
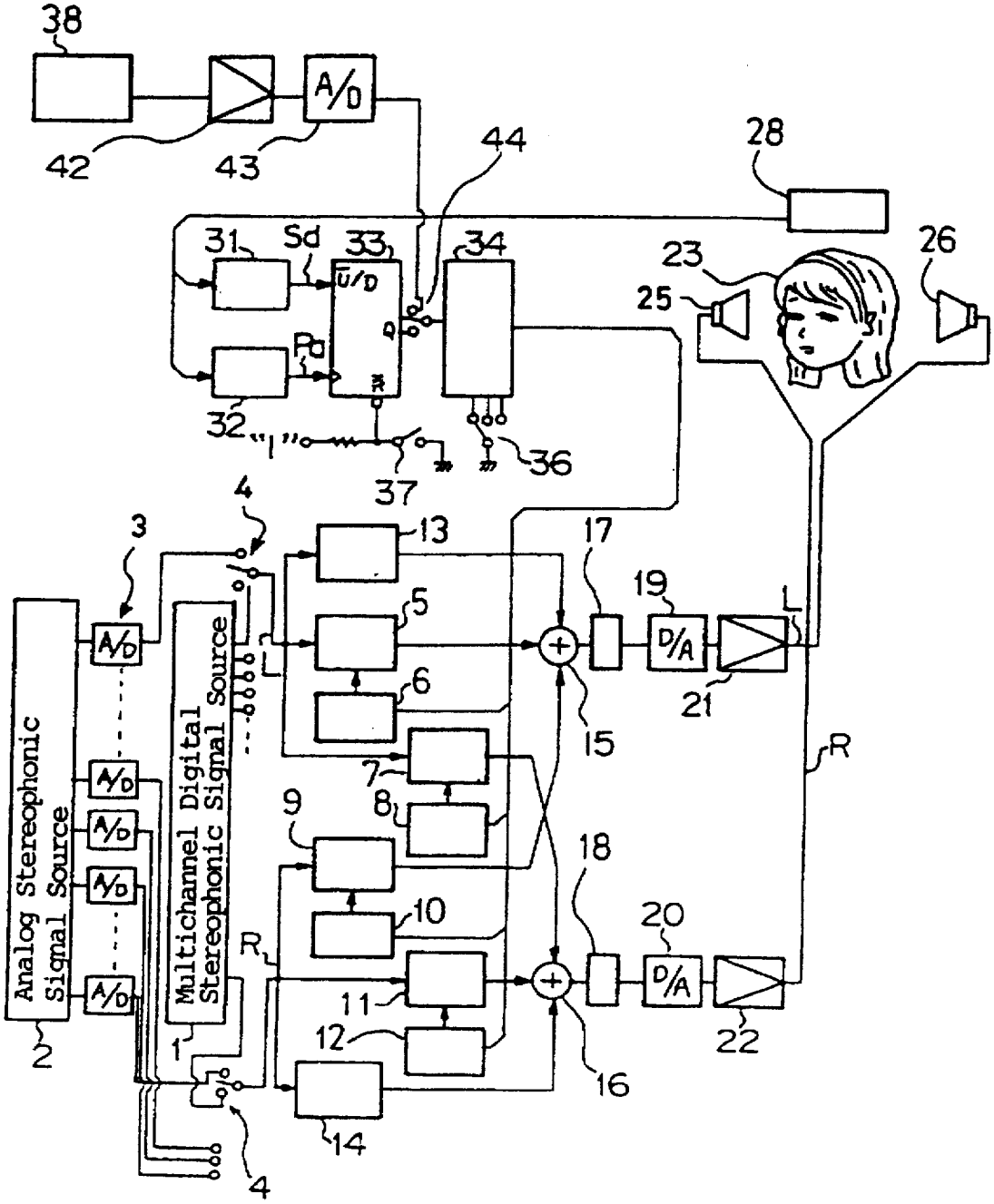
FIG. 28 is a block diagram of an audio reproduction apparatus according to an embodiment of the present invention.

FIG. 28 shows an audio reproduction apparatus according to an embodiment of the present invention. As shown in FIG. 28, a multichannel digital stereophonic signal source 1 may be a digital audio disc (e.g., a compact disc), a digital satellite broadcasting system, and so on. An analog stereophonic signal source 2 may be an analog record, an analog broadcasting system, and so on.

Analog signals from the analog stereophonic signal source 2 are converted into digital signals by as many A/D converters 3 as the number of channels if the analog signals are multichannel analog signals. Selectors 4 select either signals which have been inputted as digital signals or signals which have been inputted as analog signals, as digital signals represented by a constant sampling frequency and a constant number of quantizing bits. While two-channel selectors 4 are shown in FIG. 28, as many selectors 4 may be provided as the number of channels if the supplied signals are multichannel signals.

A left digital signal L of the digital signal series is supplied to a convolutional integrator 5. The convolutional integrator 5 is associated with a memory 6 which stores a set of digitally recorded impulse responses that are represented by a constant sampling frequency and a constant number of quantizing bits from a virtual sound source position to the ears of a listener 23, in the direction in which the head of the listener 23 presently faces with respect to a reference direction of the head. In the convolutional integrator 5, the digital signal series is subjected with the impulse responses read from the memory 6 to convolutional integration on a real-time basis. A convolutional integrator 7 and a memory 8 supply a crosstalk component of a right digital signal R.

The right digital signal R is supplied to a convolutional integrator 11. The convolutional integrator 11 is associated with a memory 12 which stores a set of digitally recorded impulse responses that are represented by a constant sampling frequency and a constant number of quantizing bits from a virtual sound source position to the ears of the listener 23, in the direction in which the head of the listener 23 presently faces with respect to a reference direction of the head. In the convolutional integrator 11, the digital signal series is subjected with the impulse responses read from the memory 12 to convolutional integration on a real-time basis. A convolutional integrator 9 and a memory 10 supply a crosstalk component of the left digital signal L.

The digital signal series is also subjected with impulse responses to convolutional integration in the convolutional integrator 7, the memory 8, the convolutional integrator 11, and the memory 12. The digital signal series which has been subjected with the impulse responses to convolutional integration by the convolutional integrators 5, 7, 9, 11 and the memories 6, 8, 10, 12 is supplied to adders 15, 16. The two-channel digital signals from the adders 15, 16 are corrected by correcting circuits 17, 18 to remove therefrom characteristics inherent in sound sources and headphones which are used, and then converted by respective D/A converters 19, 20 into analog signals, which are amplified by power amplifiers 21, 22 and supplied to loudspeakers 25, 26.

Figure 29:
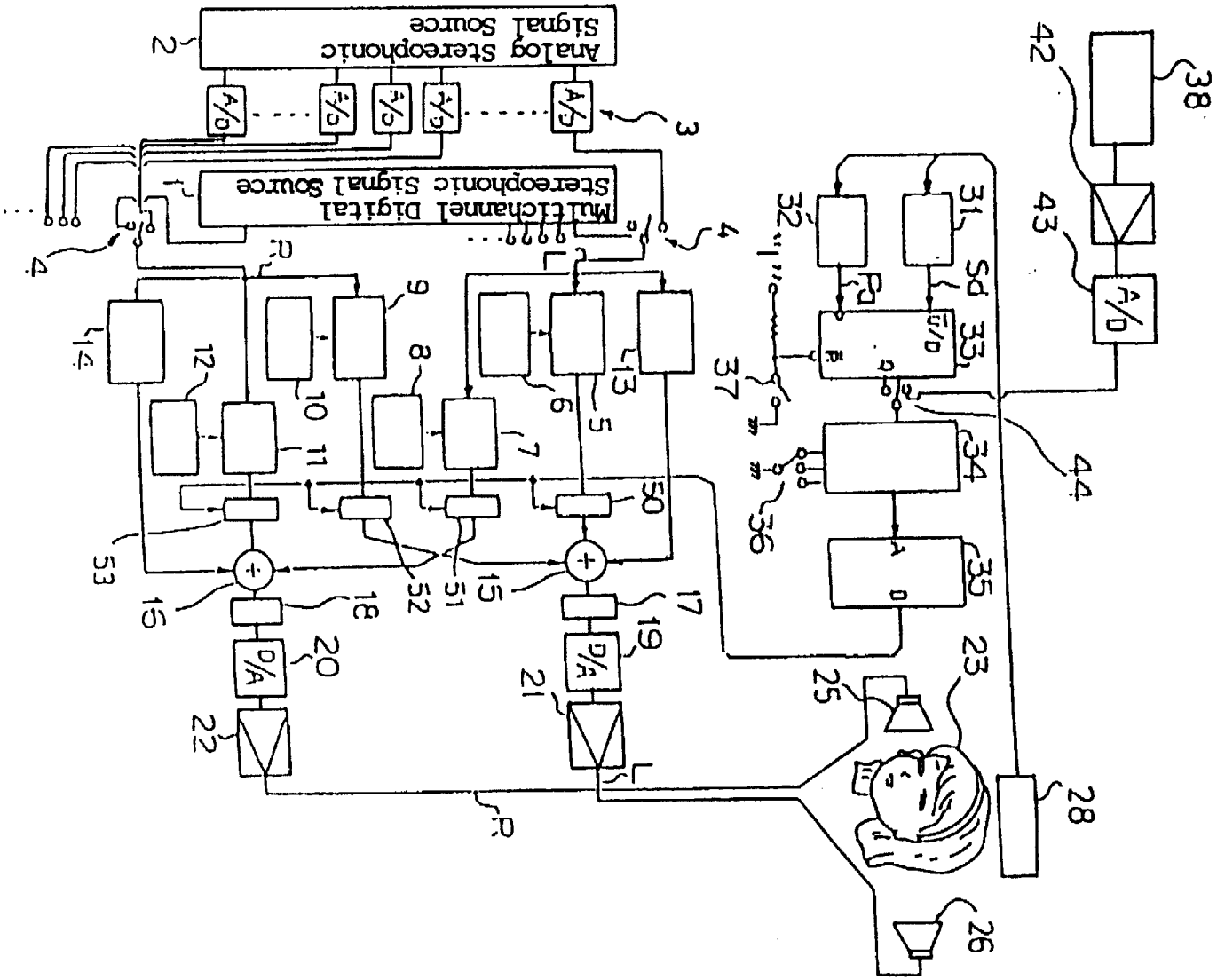
FIG. 29 is a block diagram of an audio reproduction apparatus according to another embodiment of the present invention.

In the above embodiment, the impulse responses are stored in the memories 6, 8, 10, 12, and the digital signals are corrected by only the impulse responses. However, the audio reproduction apparatus may be arranged as shown in FIG. 29. Specifically, the memories 6, 8, 10, 12 associated with the convolutional integrators 5, 7, 9, 11 store a pair of digitally recorded impulse responses from virtual sound source positions to the ears, with respect to the head that is fixed with respect to the reference direction. The digital signal series are subjected with the impulse responses to convolutional integration on a real-time basis. A memory 35 stores control signals representative of time differences and level differences between the ears of the listener 23 from the virtual sound source positions to the ears with respect to the reference direction of the head.

With respect to each of the digital signals subjected to convolutional integration in each of the channels, a detected movement of the head with respect to the reference direction is converted into a digital address signal representing a magnitude of the movement including its direction, through each constant angle or predetermined angle. The address signals are used to read control signals from the memory 35, and the digital signals are corrected and modified on a real-time basis in controllers 50, 51, 52, 53. The corrected signals are then supplied to adders 15, 16.

Figure 30:
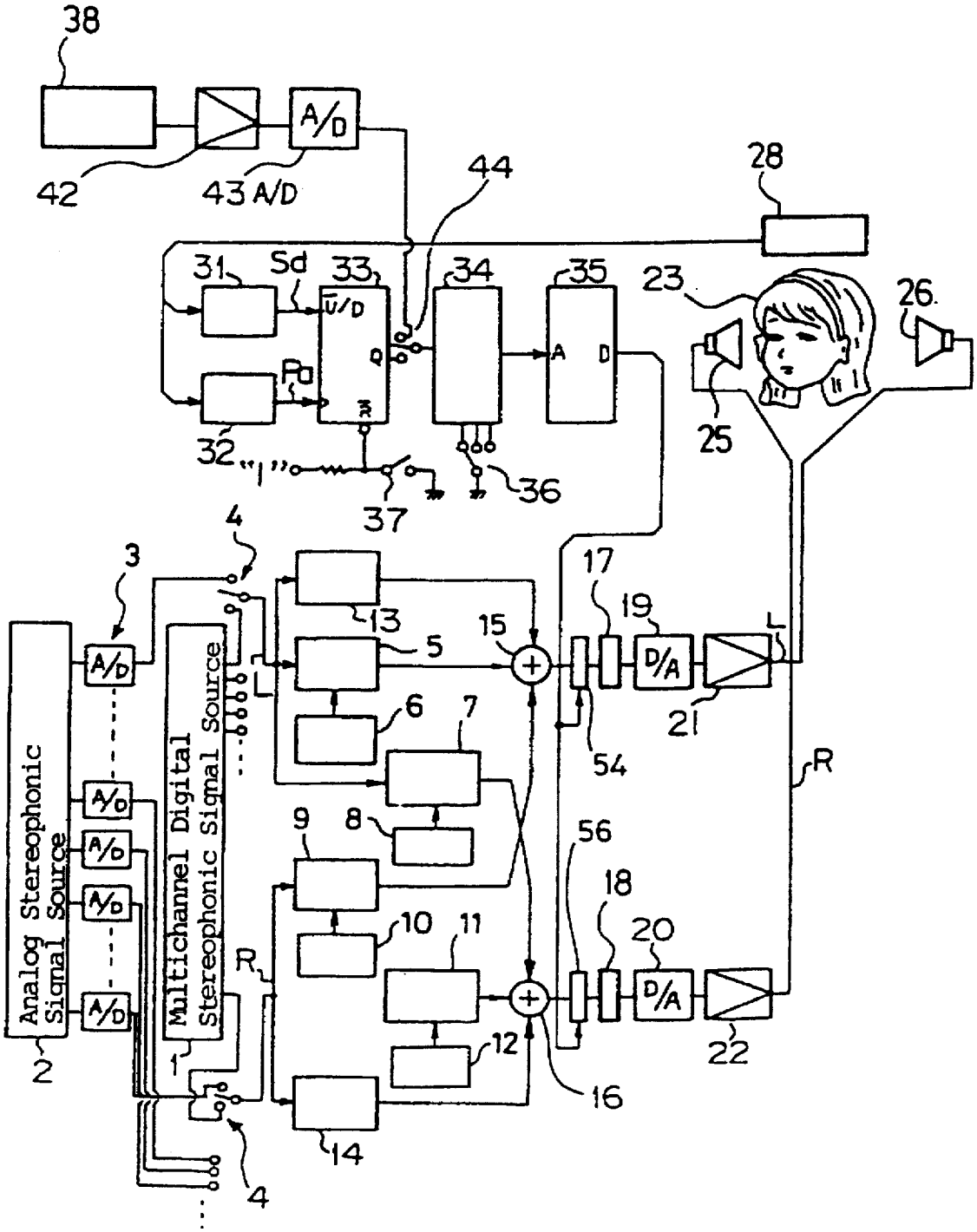
FIG. 30 is a block diagram of an audio reproduction apparatus according to still another embodiment of the present invention.
Figure 31:
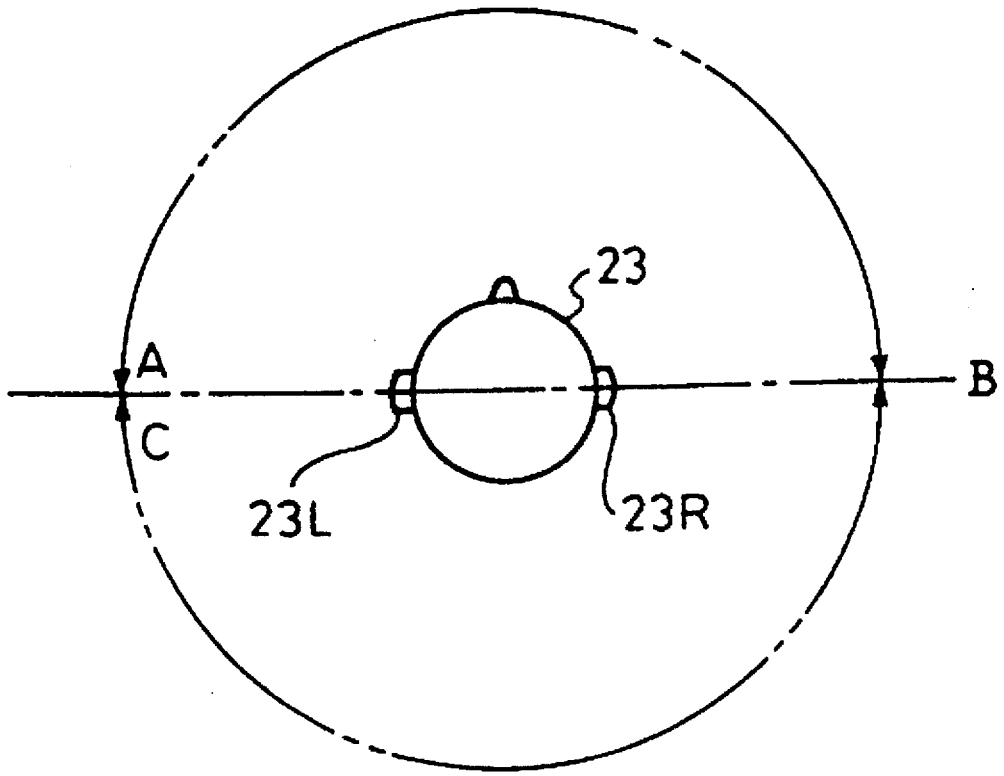
FIG. 31 is a view showing a loudspeaker arrangement for the audio reproduction apparatus.

Alternatively, as shown in FIG. 30, the digital signal series that have been subjected with the impulse responses to convolutional integration on a real-time basis are supplied to the adders 15, 16, and, with respect to each of the two-channel digital signals from the adders 15, 16, a detected movement of the head with respect to the reference direction is converted into a digital address signal representing a magnitude of the movement including its direction, through each constant angle or predetermined angle. The address signals are used to read control signals from the memory 35, and the digital signals are corrected and modified on a real-time basis in the controllers 54, 56.

Each of the controllers 50, 51, 52, 53, 54, 56 may comprise a combination of a variable delay device and a variable level control unit or a level control unit for varying the levels in respective frequency bands, e.g., a graphic equalizer having a number of divided bands. The information stored in the memory 35 may be impulse responses representing a time difference and a level difference between the ears of the listener 23 from the virtual sound source position to the ears in the direction in which the head of the listener 23 presently faces with respect to the reference direction of the head. In this case, each of the controllers 50, 51, 52, 53, 54, 56 may comprise an IIR or FIR variable digital filter.

In this manner, the controllers give spatial information, and the digital signals corrected with respect to the characteristics inherent in the sound sources and headphones which are used by the correcting circuits 17, 18 and varied with respect to the movement of the head are converted by the D/A converters 19, 20 into analog signals. The analog signals are amplified by the power amplifiers 21, 22, and then supplied to the loudspeakers 25, 26.

The correcting circuits 17, 18 for correcting the characteristics inherent in the sound sources and headphones may be circuits for carrying out analog signal processing or digital signal processing, and may be incorporated in the headphones if the headphones are of the wireless type. The correcting circuits 17, 18 may not necessarily be housed in the headphones 24 themselves, but may be disposed in the cords of the headphones 24, or connectors which interconnect the apparatus and the cords of the headphones 24 or a subsequent stage, or the controllers in the apparatus or a subsequent stage.

Figure 32A:
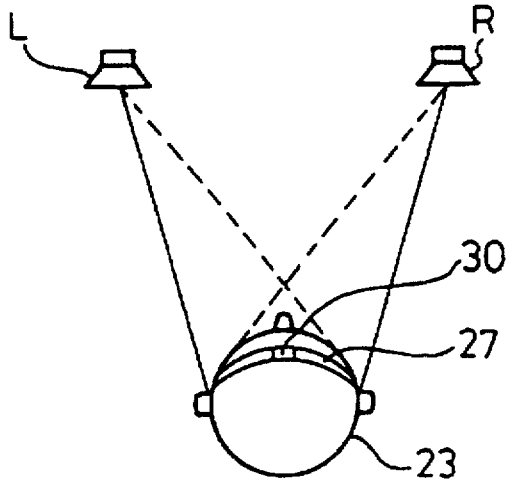
FIGS. 32A and 32B are views showing the detection of rotation of the head of a listener in the audio reproduction apparatus.
Figure 32B:
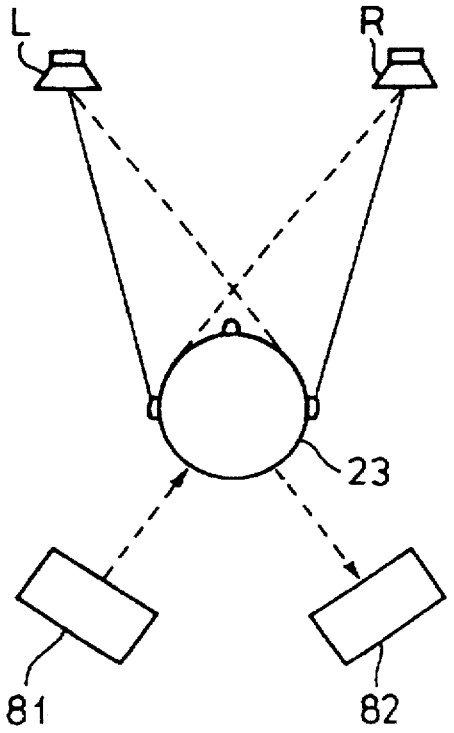

The digital angle detector 28 serves to detect movement of the head of the listener 23. FIG. 32A shows a detailed arrangement for detecting rotation of the head of the listener 23 with the digital angle detector 28. In FIG. 32A, the digital angle detector 28 comprises a rotary encoder 30 mounted on a head band 27 worn on the head of the listener 23 for detecting rotation of the head of the listener 23. In FIG. 32B, a transmitter 81 and a receiver 82 are disposed behind the head of the listener 23 for producing a digital signal indicative of a detected angle. The rotary encoder 30, the transmitter 81, and the receiver 82 may be replaced with a vibratory gyro mounted on the head band 27 as an analog angle detector for producing an analog output signal.

The transmitter 81 and the receiver 82 may specifically be an ultrasonic transmission/reception device or an infrared non-contact rotation sensor or camera. In the ultrasonic transmission/reception device, an ultrasonic wave is transmitted from the transmitter 81 toward the head of the listener 23, and an ultrasonic wave reflected by the head of the listener 23 is received by the receiver 82 for detecting an angle through which the head has been turned. The transmitter 81 and the receiver 82 may be replaced with a camera. The camera recognizes the image of the head of the listener 23 to detect an angle through which the head has been turned. Since either the transmitter 81 and the receiver 82 or the camera can continuously detect rotation of left and right sides of the head, the angle of rotation can reliably be detected.

Since the digital angle detector 28 comprises a non-contact rotation sensor composed of the rotary encoder 30 or the transmitter 81 and the receiver 82, and the analog angle detector 38 comprises a non-contact rotation sensor composed of the vibratory gyro on the head of the listener 23 or the transmitter 81 and the receiver 82, they can produce a signal indicative of a detected angle, and audio signals corrected depending on the rotation of the head of the listener 23 can be reproduced by the right and left loudspeakers 25, 26.

In the above embodiments, since the transmitter 81 and the receiver 82 may be an ultrasonic transmission/reception device disposed in the vicinity of the head of the listener 23, audio signals corrected depending on the rotation of the head of the listener 23 based on a reflected ultrasonic wave can be reproduced by the right and left loudspeakers 25, 26.

In the above embodiments, since the transmitter 81 and the receiver 82 may be a non-contact rotation sensor disposed in the vicinity of the head of the listener 23, audio signals corrected depending on the rotation of the head of the listener 23 based on a reflected infrared radiation can be reproduced by the right and left loudspeakers 25, 26.

In the above embodiments, since the transmitter 81 and the receiver 82 may be a camera disposed in the vicinity of the head of the listener 23, audio signals corrected depending on the rotation of the head of the listener 23 based on image recognition by the camera can be reproduced by the right and left loudspeakers 25, 26.

In FIGS. 32A and 32B, a vibratory gyro may be mounted on the head band 27 for picking up movement of the head of the listener 23 with respect to the reference direction thereof as discrete information through each constant angle or predetermined angle. The vibratory gyro may instead be disposed on an attachment device independent of the head band 27. The vibratory gyro may not necessarily be positioned at the center of the head, but may be hung from an ear of the listener 23. The arrangement employing the transmitter 81 and the receiver 82 operates in the same manner as described below with reference to FIG. 28.

In FIG. 28, an output signal from the rotary encoder 30 of the digital angle detector 28 is supplied to detecting circuits 31, 32. The detecting circuit 31 outputs a directional signal Sd which changes to "0" when the listener 23 turns the head clockwise and to "1" when the listener 23 turns the head counterclockwise. The detecting circuit 32 outputs a number of pulses Pa proportional to the angle through which the listener 23 varies the direction of the head, e.g., outputs a pulse Pa each time the listener 23 varies the direction of the head by 2°.

At the time the signal Sd is supplied to a count direction input terminal U/D of an up/down counter 33, the pulses Pa are supplied to a clock input terminal (count in-put) CK of the up/down counter 33. The up/down counter 33 produces a count output signal that is converted into a digital address signal representative of the direction and the magnitude of turning movement of the head of the listener 23. The digital address signal is supplied through an address control circuit 34 as an address signal to memories 6, 8, 10, 12.

In response to the supplied address signal, the memories 6, 8 10, 12 read, from corresponding addresses of tables therein, digitally recorded impulse responses from the virtual sound source positions with respect to the reference direction to the ears of the listener 23. At the same time, digital audio signals in the respective channels and the impulse responses are subjected to convolutional integration in the convolutional integrators 5, 7, 9, 11, thus correcting the signals with respect to the direction in which the head of the listener 23 is now oriented, on a real-time basis.

An analog angle detector 38 comprises the vibratory gyro or the transmitter 81 and the receiver 82 as shown in FIG. 32B for detecting an angle of rotation as an analog quantity.

The analog output signal from the analog angle detector 38 is amplified by an amplifier 42 and supplied to an A/C converter 43, whose digital output signal is supplied through a switch 44 to an address control circuit 34. The address control circuit 34 generates a digital address signal representing the magnitude of the movement of the head of the listener 23 including the direction through each constant angle or predetermined angle, with respect to the reference direction, and supplies the digital address signal as an address signal to the memories 6, 8, 10, 12.

In FIG. 28, in response to the supplied address signal, the memories 6, 8, 10, 12 read, from corresponding addresses of tables therein, digitally recorded impulse responses from the virtual sound source positions with respect to the reference direction of the head of the listener 23 to the ears of the listener 23. The digital audio signals in the respective channels and the impulse responses are subjected to convolutional integration in the convolutional integrators 5, 7, 9, 11, thus correcting the signals in the direction in which the head of the listener 23 is now oriented, on a real-time basis.

In FIG. 29, in response to the supplied address signal, the memory 35 reads, from corresponding addresses of a table therein, digitally recorded control signals which represent time differences and level differences between the ears of the listener 23 from the virtual sound source positions to the ears with respect to the reference direction of the head. Then, the control signals and digital audio signals in the respective channels which have been subjected with the impulse responses to convolutional integration by the convolutional integrators 5, 7, 9, 11 and the memories 6, 8, 10, 12 associated respectively therewith are corrected on a real-time basis in the direction in which the head of the listener 23 presently faces, by the controllers 50, 51, 52, 53.

In FIG. 30, the digital audio signals which have been subjected with the impulses responses to convolutional integration by the convolutional integrators 5, 7, 9, 11 and the memories 6, 8, 10, 12 associated respectively therewith are processed into right and left digital signals by the adders 15, 16. Thereafter, the memory 35 reads, from corresponding addresses of a table therein, digitally recorded control signals which represent time differences and level differences between the ears of the listener 23 from the virtual sound source positions to the ears with respect to the reference direction of the head. Then, the signals are corrected on a real-time basis in the direction in which the head of the listener 23 presently faces, by the controllers 54, 56. The other structural details and operation are the same as those of the arrangement shown in FIG. 29.

FIG. 30 shows an arrangement of loudspeakers. The loudspeakers are positioned on a straight line B interconnecting the ears 23L, 23R of a listener 23 in confronting relation to the ears 23L, 23R. Alternatively, the loudspeakers are positioned in a range A that lies forward of the straight line B interconnecting the ears 23L, 23R of the listener 23. Alternatively, the loudspeakers are positioned in a range C that lies rearward of the straight line B interconnecting the ears 23L, 23R of the listener 23. Further alternatively, the loudspeakers are positioned in a combination of the above arrangements. In either case, the loudspeakers are positioned closely to the listener 23.

In one of the above arrangements, since the right and left loudspeakers 25, 26 are positioned in confronting relation to the ears 23L, 23R of the listener 23, the right and left loudspeakers 25, 26 can reproduce audio signals that have been corrected on the straight line B interconnecting the ears 23L, 23R of the listener 23 depending on the rotation of the head of the listener 23.

In another one of the above arrangements, since the right and left loudspeakers 25, 26 are positioned forward of the straight line B interconnecting the ears 23L, 23R of the listener 23, the right and left loudspeakers 25, can reproduce audio signals that have been corrected forward of the straight line B interconnecting the ears 23L, 23R of the listener 23 depending on the rotation of the head of the listener 23.

In still another one of the above arrangements, since the right and left loudspeakers 25, 26 are positioned rearward of the straight line B interconnecting the ears 23L, 23R of the listener 23, the right and left loudspeakers 25, 26 can reproduce audio signals that have been corrected rearward of the straight line B interconnecting the ears 23L, 23R of the listener 23 depending on the rotation of the head of the listener 23.

The reproduction of a sound field with fixed loudspeaker is the same as the reproduction of a sound field with headphones as indicated by equations given below. Sound field simulations using headphones and loudspeakers are carried out as follows: First, transfer function representations and impulse response representations are given.

$$H_{LLE}\omega,\theta_E = 1/\left(2\pi_E \int_{-\infty}^{\infty} H^c_{LLE}t,\theta_L \cdot \exp_L{}^c - j\omega t_L dt\right. \tag{35}$$

$$H_{LRE}\omega,\theta_L = 1/\left(2\pi_L \int_{-\infty}^{\infty} H^c_{LRE}t,\theta_L \cdot \exp_L{}^c - j\omega t_L dt\right. \tag{36}$$

-continued $$H_{RLL}\omega,\theta_L = 1/\left(2\pi_L \int_{-\infty}^{\infty} H^c_{RLR}t,\theta_R \cdot \exp_R{}^c - j\omega t_R dt\right. \tag{37}$$

$$H_{RRR}\omega,\theta_R = 1/\left(2\pi_L \int_{-\infty}^{\infty} H^c_{RRR}t,\theta_R \cdot \exp_R{}^c - j\omega t_R dt\right. \tag{38}$$

If the data are fixed with θ=0 (only forward), the equations (35) through (38) can be expressed respectively by:

$$H_{LL}(\omega) = 1/\left(2\pi_R \int_{-\infty}^{\infty} h_{LL}(t) \cdot \exp(-j\omega t)dt\right. \tag{39}$$

$$H_{LR}(\omega) = 1/\left(2\pi_L \int_{-\infty}^{\infty} h_{LR}(t) \cdot \exp(-j\omega t)dt\right. \tag{40}$$

$$H_{RL}(\omega) = 1/\left(2\pi_L \int_{-\infty}^{\infty} h_{RL}(t) \cdot \exp(-j\omega t)dt\right. \tag{41}$$

$$H_{RR}(\omega) = 1/\left(2\pi_R \int_{-\infty}^{\infty} h_{RR}(t) \cdot \exp(-j\omega t)dt\right. \tag{42}$$

Equations with head rotation information added are given below. The equations are approximated by adding changes in amplitude and phase (time delay) of sound waves traveling from the loudspeakers to the ears to the forward fixed data indicated by the equations (39) through (42).

$$\begin{aligned} H_{LL}(\omega,\theta) &\approx H_{LL}(\omega) \cdot S_{LL}(\omega,\theta) \\ &= h_{LL}(t)^* S_{LL}(t,\theta) \end{aligned} \tag{43}$$

$$\begin{aligned} H_{LR}(\omega,\theta) &\approx H_{LR}(\omega) \cdot S_{LR}(\omega,\theta) \\ &= h_{LR}(t)^* S_{LR}(t,\theta) \end{aligned} \tag{44}$$

$$\begin{aligned} H_{RL}(\omega,\theta) &\approx H_{RL}(\omega) \cdot S_{RL}(\omega,\theta) \\ &= h_{RL}(t)^* S_{RL}(t,\theta) \end{aligned} \tag{45}$$

$$\begin{aligned} H_{RR}(\omega,\theta) &\approx H_{RR}(\omega) \cdot S_{RR}(\omega,\theta) \\ &= h_{RR}(t)^* S_{RR}(t,\theta) \end{aligned} \tag{46}$$

Figure 33:
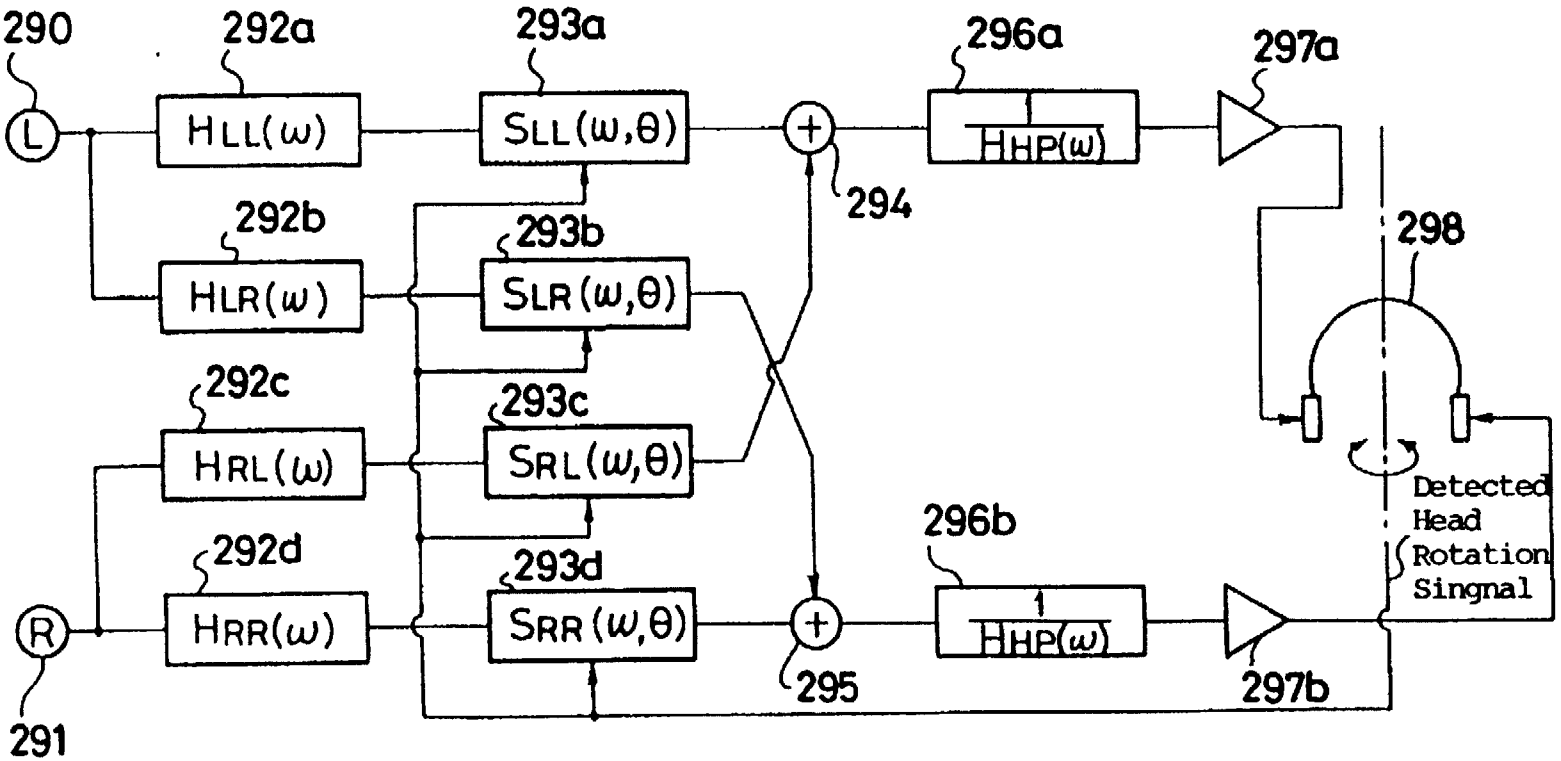
FIG. 33 is a block diagram of an arrangement employing transfer functions and impulse responses in the audio reproduction apparatus.

These equations can be expressed by a block arrangement shown in FIG. 33. FIG. 33 is a block diagram of an arrangement employing transfer functions of a reproduction system using headphones which processes signals independently in four channels. In FIG. 33, a left audio signal supplied to a left input terminal 290 is processed by a transfer function $H_{LL}(\omega)$ 292*a* up to the left ear and an impulse response $H_{LL}(\theta)$ 293*a* up to the left ear. The left audio signal is also processed by a transfer function $H_{LR}(\omega)$ 292*b* of a crosstalk component up to the right ear and an impulse response $H_{LR}(\theta)$ 293*b* of the crosstalk component up to the right ear.

A right left audio signal supplied to a right in-put terminal 291 is processed by a transfer function $H_{RR}(\omega)$ 292*d* up to the right ear and an impulse response $H_{RR}(\theta)$ 293*d* up to the right ear. The right audio signal is also processed by a transfer function $H_{RL}(\omega)$ 292*c* of a crosstalk component up to the left ear and an impulse response $H_{RL}(\theta)$ 293*c* of the crosstalk component up to the left ear.

An adder 294 adds the processed left audio signal and the right crosstalk component. An adder 295 adds the processed right audio signal and the left crosstalk component. Headphone corrective transfer functions 296*a*, 296*b* serve to correct characteristics inherent in the headphones that are used.

The corrected left and right audio signals are amplified respectively by amplifiers 297a, 297b, and then supplied to headphones 298. Transfer functions $S_{LL}(\omega, \theta)$ 293a, $S_{LR}(\omega, \theta)$ 293b, $S_{RL}(\omega, \theta)$ 293c, $S_{RR}(\omega, \theta)$ 293d are supplied with a signal indicative of a detected head rotation for processing the signals with impulse responses depending on the head rotation.

After the characteristics of four paths from the loudspeakers to the ears have been added, i.e., $H_{LL}(\omega)$, $H_{LR}(\omega)$ and $H_{RL}(\omega)$, $H_{LL}(\omega)$ have been added, the signals are processed to add changes in the characteristics upon the head rotation. Now, the equations can be simplified as follows:

$$\begin{aligned} H_L(\omega,\theta) &= \{H_{LL}(\omega) + H_{RL}(\omega)\} \cdot S_L(t,\theta) \\ &= \{h_{LL}(t) + h_{RL}(t)\} * S_L(t,\theta) \end{aligned} \tag{47}$$

$$\begin{aligned} H_R(\omega,\theta) &= \{H_{RR}(\omega) + H_{LR}(\omega)\} \cdot S_R(t,\theta) \\ &= \{h_{RR}(t) + h_{LR}(t)\} * S_R(t,\theta) \end{aligned} \tag{48}$$

Figure 34:
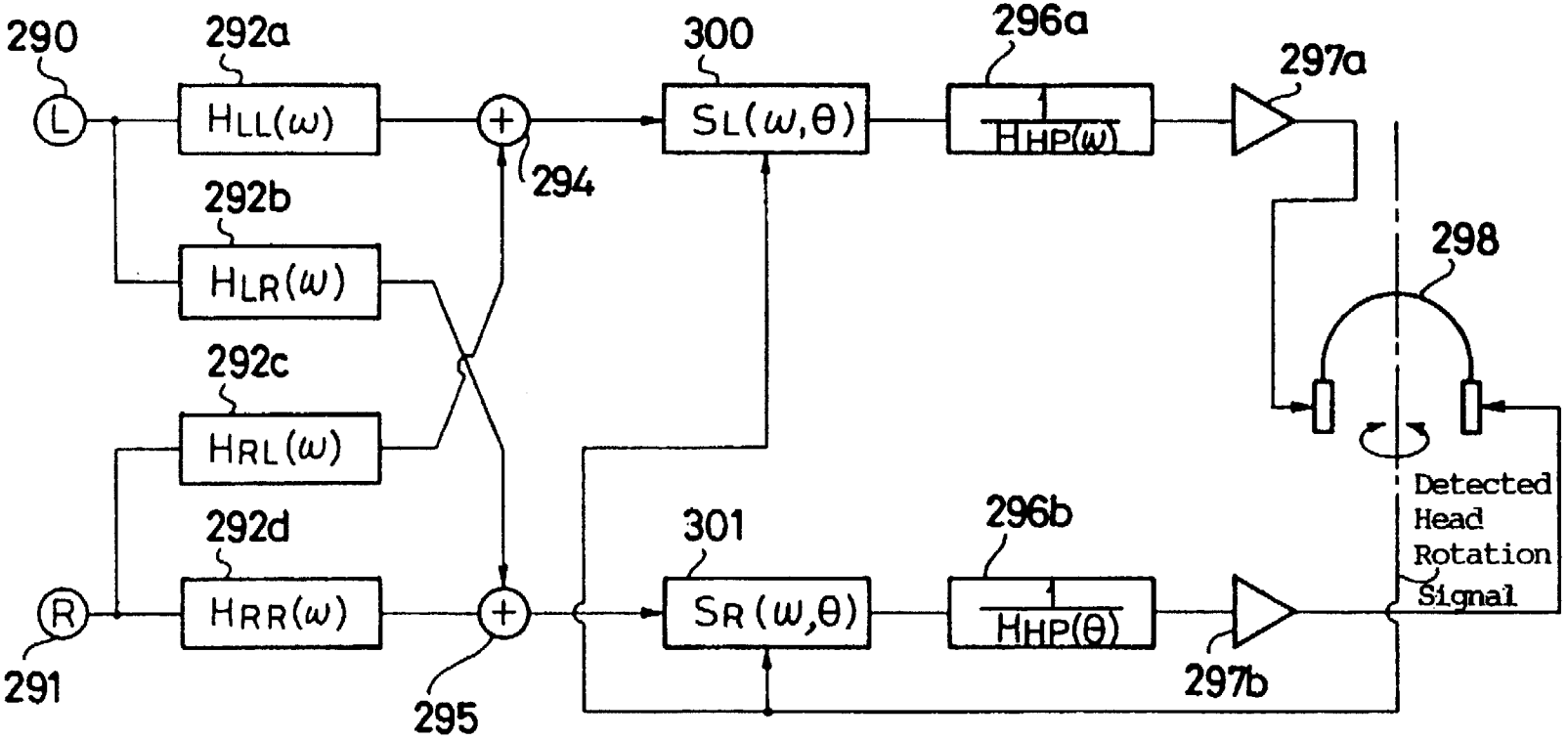
FIG. 34 is a block diagram of an arrangement employing transfer functions and impulse responses in the audio reproduction apparatus.

These equations can be expressed by a block arrangement shown in FIG. 34. In FIG. 34, the transfer functions $H_{LL}(\theta)$ 293a, $H_{LR}(\theta)$ 293b, $H_{RL}(\theta)$ 293c, $H_{RR}(\theta)$ 293d are deleted from the arrangement shown in FIG. 33, and transfer functions $S_L(t, \theta)$ 300, $S_R(t, \theta)$ 301 are added.

If the headphones that are used have characteristics $H_{HP}(\omega)$, then they are corrected using $1/H_{HP}(\omega)$ or $h_{HP}(t)^{-1}$. These are expressed as follows:

$$H_{HP}(\omega) = 1/(2\pi) \int_{-\infty}^{\infty} h_{HP}(t) \cdot \exp(-j\omega t)dt \tag{49}$$

$$1/H^{c}_{HP}\omega = 1/2\left(2\pi \int_{-\infty}^{\infty} H^{c}_{HPH} t_H^{-1} \cdot \exp^{c} - j\omega t dt\right. \tag{50}$$

Therefore, a two-channel signal processing procedure including correction for the headphones is represented by:

$$\begin{aligned} H^{c}_{LL}\omega,\theta_L &= \{H^{c}_{LLL}\omega_L + H^{c}_{RLR}\omega_R\} \cdot S^{c}_{LL}\omega,\theta_L \cdot 1/H^{c}_{HPL}\omega_L \\ &= \{h^{c}_{LLL}t_L + h^{c}_{RLL}t_L\} * S^{c}_{LL}t,\theta_L * h^{c}_{HPH}t_H^{-1} \end{aligned} \tag{51}$$

$$\begin{aligned} H^{c}_{RR}\omega,\theta_R &= \{H^{c}_{RRR}\omega_R + H^{c}_{LRL}\omega_L\} \cdot S^{c}_{RR}\omega,\theta_R \cdot 1/H^{c}_{HPR}\omega_R \\ &= \{h^{c}_{RRR}t_R + h^{c}_{LRR}t_R\} * S^{c}_{RR}t,\theta_R * h^{c}_{HPH}t_H^{-1} \end{aligned} \tag{52}$$

A four-channel signal processing procedure is represented by:

$$\begin{aligned} H^{c}_{LL}\omega,\theta_L &= \{H^{c}_{LLL}\omega_L + S^{c}_{LLL}\omega,\theta_L + H^{c}_{RLR}\omega_R \cdot S^{c}_{RLR}\omega,\theta_R\} \cdot 1/H_{HP}(\omega) \\ &= \{h^{c}_{LLR}t_R * S^{c}_{LLR}t,\theta_R + h^{c}_{RLR}t_R \cdot S^{c}_{RLR}t,\theta_R\} * h^{c}_{HPR}t_R^{-1} \end{aligned} \tag{53}$$

$$\begin{aligned} H^{c}_{RR}\omega,\theta_R &= \{H^{c}_{RRR}\omega_R \cdot S^{c}_{RRR}\theta_R + H^{c}_{LRR}\omega_R \cdot S^{c}_{LRR}\theta\} \cdot 1/H_{HP}(\omega) \\ &= \{h^{c}_{RRR}t_R * S^{c}_{RRR}t,\theta_R + h^{c}_{LRR}t_R * S^{c}_{LRR}t,\theta_R\} * h_{HPR}t_R^{-1} \end{aligned} \tag{54}$$

Simplifying the above equations, the four-channel signal processing procedure is represented by:

$$H^{c}_{LL}\omega,\theta_L = \{h^{c}_{LLL}t_L * S^{c}_{LLL}t,\theta_L + h^{c}_{RLR}t_R * S^{c}_{RLR}\theta_R\} * h_{HPR}t_R^{-1} \tag{55}$$

$$H^{c}_{RR}\omega,\theta_R = \{h^{c}_{RRR}t_R * S^{c}_{RRR}t,\theta_R + h^{c}_{LRL}t_L * S^{c}_{LRL}\theta_L\} * h_{HPL}t_L^{-1} \tag{56}$$

and the two-channel signal processing procedure is represented by:

$$H^{c}_{LL}\omega,\theta_L = \{h^{c}_{LLL}t_L + h^{c}_{RLR}t_R\} * S^{c}_{LL}t,\theta_L * h^{c}_{HPL}t_L^{-1} \tag{57}$$

$$H^{c}_{RR}\omega,\theta_R = \{h^{c}_{RRR}t_R + h^{c}_{LRL}t_L\} * S^{c}_{RR}t,\theta_R * h^{c}_{HPR}t_R^{-1} \tag{58}$$

In the above equations, $h_{HP}(t)^{-1}$ may simply be replaced with $h_{SP}(t)^{-1}$ for loudspeaker reproduction.

Figure 35:
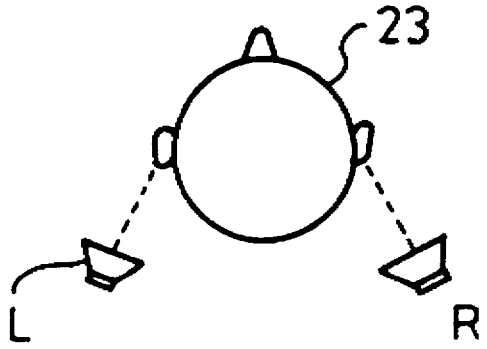
FIG. 35 is a view showing the manner in which the audio reproduction apparatus operates.

Therefore, when a simulation is carried out by loudspeakers, instead of headphones, placed near the ears of the listener 23 in positions other than forward of the listener 23, as shown in FIG. 35, since crosstalk components can be ignored, the equations (55), (56) and the equations (57), (58) can be applied as they are. The correction can also be applied for the loudspeakers.

Figure 36:
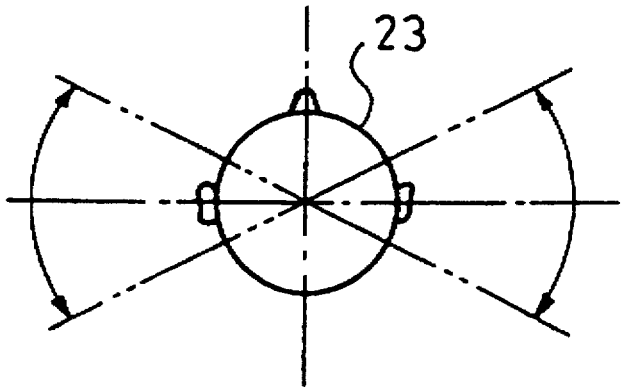
FIG. 36 is a view showing the manner in which the audio reproduction apparatus operates.

If the angle of rotation of the head of the listener 23 is limited to at least a range of acute angles, as shown in FIG. 36, data produced when audio signals are reproduced by the headphones can be used as they are.

In the above equations, $h_{mn}(t)$ indicates the impulse response from a loudspeaker position "m" to an ear "n", $H_{mn}(\omega)$ indicates the transfer function from the loudspeaker position "m" to the ear "n", $\omega$ is the angular frequency $2\pi f$, and f is the frequency.

Figure 37:
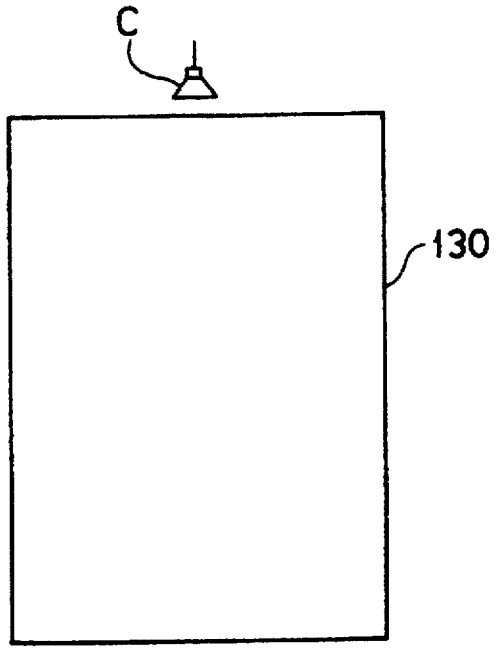
FIG. 37 is a view of a loudspeaker arrangement for one-channel monaural reproduction for the audio reproduction apparatus.
Figure 38:
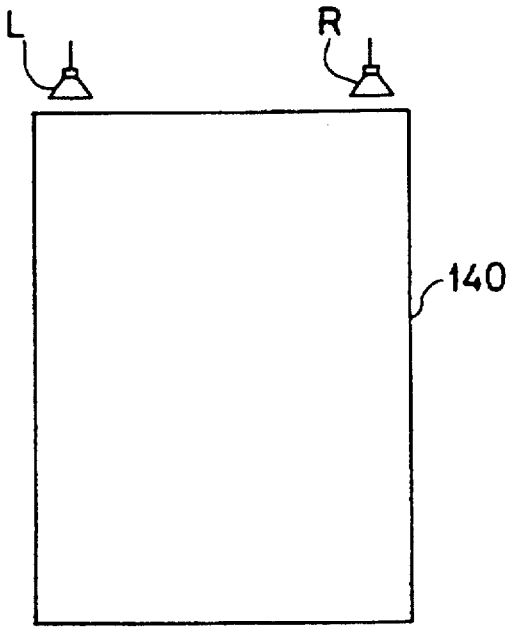
FIG. 38 is a view of a loudspeaker arrangement for two-channel stereophonic reproduction for the audio reproduction apparatus.
Figure 39:
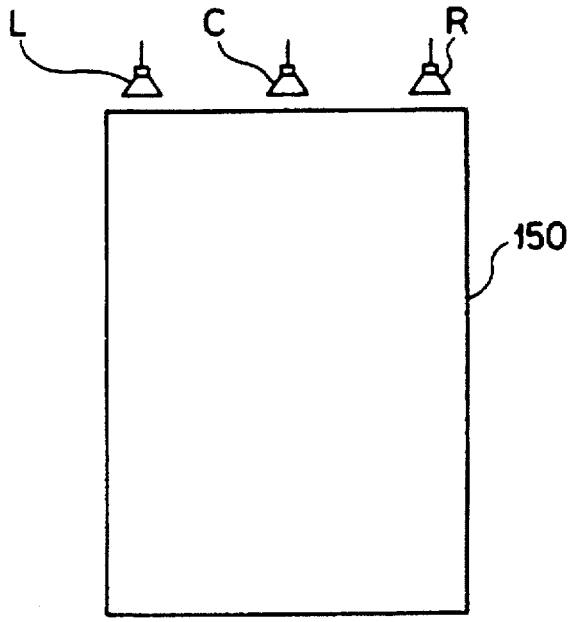
FIG. 39 is a view of a loudspeaker arrangement for three-channel reproduction for the audio reproduction apparatus.

FIGS. 37 through 42 show examples in which the above loudspeaker arrangements are applied to movie reproduction. FIG. 37 shows a loudspeaker arrangement for one-channel channel monaural reproduction. In FIG. 37, only a central loudspeaker C is positioned centrally in front of an audience 130. FIG. 38 shows a loudspeaker arrangement for two-channel stereophonic reproduction. In FIG. 38, left and right loudspeakers L, R are positioned at the left and right in front of an audience 140. FIG. 39 shows a loudspeaker arrangement for three-channel reproduction. In FIG. 39, a central loudspeaker C and left and right loudspeakers L, R are positioned at the center, left, and right in front of an audience 150.

Figure 40:
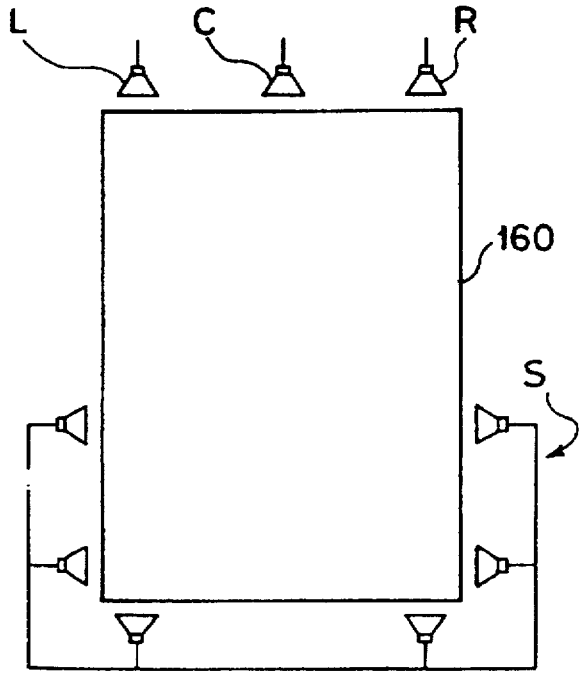
FIG. 40 is a view of a loudspeaker arrangement for four-channel reproduction for the audio reproduction apparatus.
Figure 41:
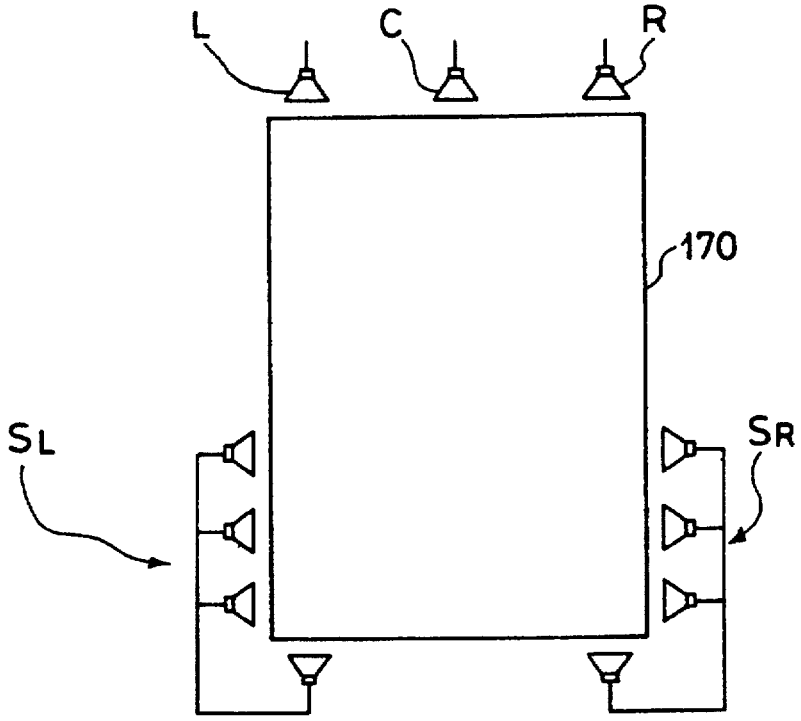
FIG. 41 is a view of a loudspeaker arrangement for five-channel reproduction for the audio reproduction apparatus.

FIG. 40 shows a loudspeaker arrangement for four-channel reproduction. In FIG. 40, a central loudspeaker C and left and right loudspeakers L, R are positioned at the center, left, and right in front of an audience 160, two surround loudspeakers S are positioned at the left and right of the rear end of the audience 160, and two surround loudspeakers S are positioned on each of the rear left and right sides of the audience 160. FIG. 41 shows a loudspeaker arrangement for five-channel reproduction. In FIG. 41, a central loudspeaker C and left and right loudspeakers L, R are positioned at the center, left, and right in front of an audience 170, a surround loudspeaker is positioned at the left of the rear end of the audience 170, three surround loudspeakers $S_L$ are positioned on the rear left side of the audience 170, a surround loudspeaker is positioned at the right of the rear end of the audience 170, and three surround loudspeakers $S_R$ are positioned on the rear right side of the audience 170.

Figure 42:
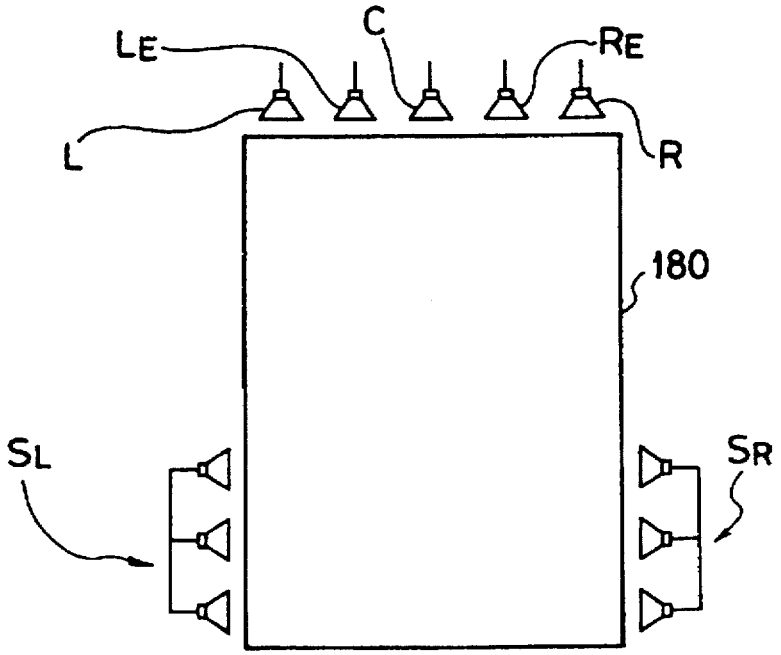
FIG. 42 is a view showing a simulated loudspeaker arrangement for front five-channel, rear two-channel reproduction for the audio reproduction apparatus.

FIG. 42 shows a loudspeaker arrangement for front five-channel, rear two-channel reproduction. In FIG. 42, a central loudspeaker C and left and right loudspeakers L, R are positioned at the center, left, and right in front of an audience 180, a left extra loudspeaker $L_E$ is positioned between the central loudspeaker C and the left loudspeaker L, a right extra loudspeaker $R_E$ is positioned between the central loudspeaker C and the right loudspeaker R, three surround left loudspeakers $S_L$ are positioned on the rear left side of the audience 180, and three surround right loudspeakers $S_R$ are positioned on the rear right side of the audience 180. The loudspeaker arrangement shown in FIG. 42 is most suitable for sound reproduction of 70-mm movies. To this loudspeaker arrangement, there may be added a subwoofer channel for aligning the pictures on the screen with the position of sounds which can be heard.

The audio reproduction apparatus according to the above embodiments are arranged as described above, and operate as follows: Digital audio signals in the respective channels from the multichannel digital stereophonic signal source 1, or digital audio signals in the respective channels which are converted by the A/D converters 3 from analog signals that are inputted to the analog stereophonic signal source 2 are selected by the selectors 4. In FIG. 28, the digital signal series is subjected with the impulse responses read from the memory 35 to convolutional integration by the convolutional integrators 5, 7, 9, 11 and the memories 6, 8, 10, 12 on a real-time basis, and then supplied to the adders 15, 16.

In FIG. 29, the digital audio signals in the respective channels that have been subjected with the impulse responses to convolutional integration by the convolutional integrators 5, 7, 9, 11 and the memories 6, 8, 10, 12 are corrected and modified by control signals read from the memory 35 in the controllers 50, 51, 52, 53, and then supplied to the adders 15, 16.

In FIG. 29, the two-channel digital signals from the adders 15, 16 are corrected and modified by control signals read from the memory 35 in the controllers 54, 56. The two-channel digital signals are converted by the respective D/A converters 19, 20 into analog signals, which are amplified by the power amplifiers 21, 22 and thereafter supplied to the loudspeakers 25, 26.

The listener 23 can thus listen to audio signals reproduced by the left loudspeaker 26 and the right loudspeaker 25. In the digital angle detector 28 or the analog angle detector 38, the movement of the head of the listener 23 with respect to the reference direction is detected through each constant angle or predetermined angle, and converted into a digital address signal representing a magnitude of the movement including its direction by the address control circuit 34.

The address signal is used to read, from the memory 35, digitally recorded impulse responses or control signals from virtual sound source positions with respect to the reference direction of the head to the ears of the listener 23. The impulse responses or control signals and the audio signals are corrected and modified on a real-time basis by the convolutional integrators 5, 7, 9, 11 and the memories 6, 8, 10, 12 or the controllers 50, 51, 52, 53, 54, 56.

The convolutional integrators 5, 7, 9, 11 and the memories 6, 8, 10, 12 or the controllers 50, 51, 52, 53, 54, 56 convert the signals into digital signals in two channels which bear spatial information representative of a sound field. The digital signals are corrected with respect to the characteristics of the sound sources and headphones that are used, by the correcting circuits 17, 18, and then amplified by the power amplifiers 21, 22. Thereafter, the signals are supplied to the left loudspeaker 26 and the right loudspeaker 25. In this manner, the audio reproduction apparatus can produce such a reproducing effect as if reproduced sounds were radiated from loudspeakers located in the virtual sound source positions.

In the above embodiments, the memory 35 is addressed by the address signal from the address control circuit 34 based on a signal proportional to the angular velocity from the digital angle detector 28 or the analog angle detector 38 to read impulse responses or control signals recorded in the memory 35. The audio signals are corrected by the impulse responses or control signals in the convolutional integrators 5, 7, 9, 11 and the memories 6, 8, 10, 12 or the controllers 50, 51, 52, 53, 54, 56 on a real-time basis with respect to the movement of the head of a listener 23 or the heads of plural listeners. Therefore, the audio signals corrected depending on the rotation of the head of the listener or listeners 23 can be reproduced by the right loudspeaker 25 and the left loudspeaker 26.

In FIGS. 28, 29, and 30, only one listener 23 is shown. However, if there are a plurality of listeners 23, then the audio reproduction apparatus may be arranged such that the stages subsequent to the convolutional integrators 5, 7, 9, 11 shown in FIGS. 28 and 29 are branched off by terminals or the stages subsequent to the adders 15, 16 shown in FIG. 30 are branched off by terminals through transmission paths.

In these arrangements, after the signals are converted into digital signals bearing spatial information by the convolutional integrators 5, 7, 9, 11 and the memories 6, 8, 10, 12, the digital signals may be processed depending on the rotation of the head of each listener, without the need for as many sets of expensive D/A converters 3 and convolutional integrators 5, 7, 9, 11 as the number of listeners.

Therefore, only as many sets of the left loudspeaker 26, the right loudspeaker 25, the digital angle detector 28, the angle-detecting signal processing circuits 31~35, the controllers 50~53, 54, 56 as the number of listeners are required, and audio signals can simultaneously be supplied to a plurality of listeners inexpensively.

When the listener 23 moves the head, the digital angle detector 28 or the analog angle detector 38 produce digital or analog signals depending on the orientation of the head of the listener 23, and the signals are of values depending on the orientation of the head of the listener 23. The signals are then supplied through the address control circuit 34 as an address signal to the memory 35.

In the above embodiments, the signals are directly supplied to the left loudspeaker 26 and the right loudspeaker 25 through signal lines. However, signals from the convolutional integrators 5, 7, 9, 11 shown in FIG. 29 may be transmitted by a modulator and transmitter, or signals from the adders 15, 16 may transmitted by a modulator and transmitter, and the transmitted signals may be received by a receiver and a demodulator for wireless signal transmission and reception to reproduce the signals.

According to the present invention, based on a signal corresponding to an angular velocity from the angle detecting means, the storage means is addressed by an address signal from the address signal converting means to read stored impulse responses or control signals therefrom, and audio signals are corrected by the impulse responses or control signals in the control means on a real-time basis with respect to the movement of the head of a listener or the heads of plural listeners. The audio signals corrected depending on the rotation of the head of the listener or the heads of the listeners are reproduced by the audio reproducing means.

INDUSTRIAL APPLICABILITY

As described above, the audio reproduction apparatus according to the present invention is suitable for the reproduction of audio signals with headphones, and particularly suitable for the reproduction of audio signals that have been corrected depending on the rotation of the head of a listener.

We claim:

1. An audio reproduction apparatus comprising:

a digital signal source for supplying digital audio signals in a plurality of channels;

audio reproducing means disposed in the vicinity of the ears of a listener for converting digital audio signals from said digital signal source into analog audio signals with digital/analog converting means and for reproducing the analog signals;

angle detecting means for detecting a movement of the head of the listener through each of a plurality of predetermined angles with respect to a reference direction;

address converting means for converting an angle detected by said angle detecting means into a digital address signal;

storage means for storing impulse responses representing corrective characteristics of at least one of a headphone and a sound source that are convolved with measured impulse responses from at least one of said headphone and said sound source, said at least one of said headphone and said sound source being used to measure impulse responses from virtual sound source positions to the ears of the listener with respect to a direction of the head of the listener through each angle which can be recognized by the listener; and integrating means for performing convolutional integration on the digital audio signals from said digital signal source and the impulse responses stored by said storage means;

the arrangement being such that said storage means is addressed by the digital address signal produced by said address converting means to provide the impulse responses containing the convolved corrective characteristics to correct the digital audio signals with respect to the movement of the head of the listener on a real-time basis.

2. An audio reproduction apparatus according to claim 1, further comprising:

a headphone device for mounting on the head of the listener, said headphone device having at least said audio reproducing means and said angle detecting means;

a main apparatus section having at least said address converting means, said storage means, and said integrating means; and transmission means for transmitting signals between said main apparatus section and said headphone device.

3. An audio reproduction apparatus comprising:

a digital signal source for supplying digital audio signals in a plurality of channels;

audio reproducing means disposed in the vicinity of the ears of a listener for converting digital audio signals from said digital signal source into analog audio signals with digital/analog converting means and for reproducing the signals;

angle detecting means for detecting a movement of the head of the listener through each of a plurality of predetermined angles with respect to a reference direction;

address signal converting means for converting an angle detected by said angle detecting means into a digital address signal;

first storage means for storing impulse responses measured from virtual sound source positions to the ears of the listener which are fixed with respect to a reference direction of the head of the listener;

integrating means for performing convolutional integration on the digital audio signals in the respective channels from said digital signal source and the impulse responses stored by said first storage means;

second storage means for storing control signals representative of measured time differences and level differences of the audio signals from the virtual sound source positions to the ears of the listener with respect to the reference direction of the head of the listener through each angle which can be recognized by the listener; and control means for correcting the digital audio signals in the respective channels which have been convolved with the impulse responses by said integrating means using the control signals stored by said second storage means and for supplying the corrected digital audio signals to said audio reproducing means;

the arrangement being such that said second storage means is addressed by the digital address signal produced by said address signal converting means to provide the control signals stored by said second storage means to the control means to correct the digital audio signals which have been convolved with the impulse responses by said integrating means to thereby correct the digital audio signals in the respective channels with respect to the movement of the head of the listener on a real-time basis.

4. An audio reproduction apparatus according to claim 3, further comprising adding means for adding the digital audio signals in the respective channels which have been subjected with the impulse responses to convolutional integration by said integrating means, as right and left digital audio signals in respective two channels, the arrangement being such that said right and left digital audio signals in respective two channels which are added by said adding means are corrected with the control signals stored by said second storage means by said control means, and supplied to said audio reproducing means.

5. An audio reproduction apparatus according to claim 3, further comprising a headphone device for being mounted on the head of the listener, said headphone device having at least said audio reproducing means and said angle detecting means, an main apparatus section having at least said address converting means, said storage means, and said integrating means, and transmission means for transmitting signals between said main apparatus section and said headphone device.

6. An audio reproduction apparatus according to claim 5, wherein said transmission means comprises transmitting means for transmitting as radio signals said right and left digital audio signals in respective two channels which are added by said adding means, and receiving means for receiving the right and left digital audio signals in respective two channels which are transmitted by said transmitting means, the arrangement being such that the digital audio signals outputted from said receiving means are corrected by said control means.

7. An audio reproduction apparatus according to claim 5, wherein said transmission means comprises digital/analog converting means for converting said right and left digital audio signals in respective two channels which are added by said adding means into analog audio signals, transmitting means for being supplied with the analog audio signals from said digital/analog converting means and transmitting the supplied analog audio signals as radio signals, receiving means for receiving said analog audio signals transmitted by said transmitting means, the arrangement being such that digital audio signals outputted from said receiving means are corrected by said control means.

8. An audio reproduction apparatus according to claim 5, wherein said transmission means comprises:

first radio means having a first receiving device and a first transmitting device for transmitting as radio signals said right and left digital audio signals in respective two channels which are added by said adding means; and second radio means having a second receiving device for receiving the right and left digital audio signals in respective two channels which are transmitted by said first transmitting device of said first radio means and a second transmitting device for transmitting a signal processing control signal to said first receiving device, the arrangement being such that the right and left digital audio signals in respective two channels which are received by said second radio means are corrected by said control means, and the content of signal processing of the digital audio signals in the two channels which are transmitted by said first transmitting device of said first radio means is modified based upon the signal processing control signal transmitted by the second transmitting device and received by the first receiving device.

9. An audio reproduction apparatus according to claim 3, further comprising correcting means, connected to an output of said control means, for compensating for audio reproduction characteristics of said audio reproducing means, the arrangement being such that the audio reproduction characteristics of said audio reproducing means are compensated for by said correcting means to correct the audio signals with respect to a movement of the head of the listener on a real-time basis.

10. An audio reproduction apparatus according to claim 3, further comprising resetting means, connected to an output of said control means, for resetting a signal representative of a movement of the head of the listener with respect to a reference direction, which movement is detected through each predetermined angle by said angle detecting means, to a signal in a forward direction with respect to the reference direction.

11. An audio reproduction apparatus according to claim 3, further comprising adding means, connected to an output of said control means, for selecting a sound field and/or a reverberation in which to reproduce the audio signals and adding the selected sound field and/or reverberation to the audio signals.

12. An audio reproduction apparatus according to claim 3, further comprising adjusting means, connected to an output of said control means, for adjusting a sound intensity and/or a balance at the time the audio signals are reproduced.

13. An audio reproduction apparatus comprising:

a digital signal source for supplying digital audio signals in a plurality of channels;

audio reproducing means disposed in the vicinity of the ears of a listener for converting digital audio signals from said digital signal source into analog audio signals with digital/analog converting means and for reproducing the signals;

angle detecting means for detecting a movement of the head of the listener through each of a plurality of predetermined angles with respect to a reference direction;

address signal converting means for converting an angle detected by said angle detecting means into a digital address signal;

first storage means for storing impulse responses measured from virtual sound source positions to the ears of a listener that are fixed with respect to a reference direction of the head of the listener;

integrating means for performing convolutional integration on the digital audio signals in the respective channels from said digital signal source and the impulse responses stored by said first storage means;

second storage means for storing control signals representative of measured time differences and level differences of the audio signals from the virtual sound source positions to the ears of a plurality of listeners with respect to the direction of the heads of the plurality of listeners through each angle which can be recognized by the listeners;

a plurality of control means for correcting the digital audio signals using the control signals stored by said second storage means and for supplying the corrected digital audio signals to said audio reproducing means; and a plurality of adding means for adding the digital audio signals in the respective channels which have been convolved with the impulse responses by said integrating means as right and left digital audio signals in respective two channels;

the arrangement being such that said second storage means is addressed by the digital address signal produced by said address signal converting means to provide the control signals stored by said second storage means to the control means to correct the digital audio signals which have been convolved with the impulse responses by said integrating means and the corrected digital audio signals are added as right and left digital audio signals in respective two channels by said plurality of adding means to thereby correct the right and left digital audio signals in respective two channels with respect to the movement of the head of each of the listeners on a real-time basis.

14. An audio reproduction apparatus comprising:

a digital signal source for supplying digital audio signals in a plurality of channels;

audio reproducing means disposed in the vicinity of the ears of a listener for converting digital audio signals from said digital signal source into analog signals with digital/analog converting means and for reproducing the signals;

angle detecting means for detecting a movement of the head of the listener through each of a plurality of predetermined angles with respect to a reference direction;

address signal converting means for converting an angle detected by said angle detecting means into a digital address signal;

first storage means for storing impulse responses measured from virtual sound source positions to the ears of the listener that are fixed with respect to a direction of the head of the listener;

integrating means for performing convolutional integration on the digital audio signals in the respective channels from said digital signal source and the impulse responses stored by said first storage means;

adding means for adding the digital audio signals in the respective channels which have been subjected with the impulse responses to convolutional integration by said integrating means, as right and left digital audio signals in respective two channels;

second storage means for storing control signals representative of measured time differences and level differences of the audio signals from the virtual sound source positions to the ears of a plurality of listeners with respect to the reference direction of the heads of the plurality of listeners through each angle which can be recognized by the listeners; and a plurality of control means for correcting the right and left digital audio signals in respective two channels which have been added by said adding means using the control signals stored by said second storage means and for supplying the corrected digital audio signals to said audio reproducing means;

the arrangement being such that said second storage means is addressed by the digital address signal produced by said address signal converting means to provide the control signals stored by said second storage means to the control means to correct the right and left digital audio signals in respective two channels which have been added by said adding means to thereby correct the right and left digital audio signals in respective two channels with respect to the movement of the head of each of the listeners on a real-time basis.

15. An audio reproduction apparatus comprising:

a signal source for supplying audio signals in a plurality of channels;

storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener;

angle detecting means for detecting a movement of the head of the listener with respect to the reference direction through each predetermined angle;

address signal converting means for converting an angle detected by said angle detecting means into an address signal;

control means for correcting the audio signals in the respective channels from said signal source based on the impulse responses or control signals stored by said storage means;

audio reproducing means for reproducing the audio signals corrected by said control means; and setting means disposed as at least a stage subsequent to said control means, for setting playback characteristics at the time the corrected audio signals are reproduced by said audio reproducing means;

the arrangement being such that said storage means is addressed by the address signal produced by said address signal converting means to read the impulse responses or control signals stored by said storage means to correct the audio signals with the impulse responses or control signals in said control means, and the corrected audio signals are reproduced with the playback characteristics set by said setting means and are corrected with respect to the movement of the head of the listener on a real-time basis.

16. An audio reproduction apparatus according to claim 15, wherein said setting means comprises correcting means for compensating for audio reproduction characteristics of said audio reproducing means, the arrangement being such that the corrected audio signals are corrected with respect to the audio reproduction characteristics of said audio reproducing means by said correcting means.

17. An audio reproduction apparatus according to claim 15, wherein said setting means comprises resetting means for resetting a signal representative of a movement of the head of the listener with respect to the reference direction, which movement is detected through each predetermined angle by said angle detecting means, to a signal in a forward direction with respect to the reference direction, the arrangement being such that a signal representative of a movement of the head of the listener with respect to the reference direction, which movement is detected through each predetermined angle by said angle detecting means, is reset to a signal in the forward direction with respect to the reference direction.

18. An audio reproduction apparatus according to claim 15, wherein said setting means comprises adding means for selecting a sound field and/or a reverberation in which to reproduce the audio signals and for adding the selected sound field and/or reverberation to the audio signals, the arrangement being such that a sound field and/or reverberation in which to reproduce the audio signals is selected and added to said audio signals by said adding means.

19. An audio reproduction apparatus according to claim 15, wherein said setting means comprises adjusting means for adjusting a sound intensity and/or a balance at the time the audio signals are reproduced, the arrangement being such that a sound intensity and/or a balance at the time the audio signals are reproduced is adjusted by said adjusting means.

20. An audio reproduction apparatus comprising:

a signal source for supplying audio signals in a plurality of channels;

first radio means for transmitting said audio signals as radio signals and for receiving an audio processing control signal;

storage means for storing impulse responses measured from virtual sound source positions to the ears of a listener with respect to a reference direction of the head of the listener, or control signals representative of measured time differences and level differences of the audio signals from the virtual sound source positions to the ears of the listener with respect to the reference direction of the head of the listener through each of a plurality of predetermined angles which can be recognized by the listener;

angle detecting means for detecting a movement of the head of the listener with respect to the reference direction through each predetermined angle;

address signal converting means for converting an angle detected by said angle detecting means into an address signal;

second radio means for receiving the audio signals from said first radio means and for transmitting the audio processing control signal;

control means for correcting the audio signals in the respective channels received by said second radio means based on the impulse responses or control signals stored by said storage means; and audio reproducing means for reproducing the audio signals corrected by said storage means;

the arrangement being such that said storage means is addressed by the address signal produced by said address signal converting means to provide the impulse responses or control signals stored by said storage means to the control means to correct the audio signals with the impulse responses or control signals and the audio signals are corrected with respect to the movement of the head of the listener on a real-time basis by way of hi-directional wireless communication.

21. An audio reproduction apparatus according to claim 20, further comprising correcting means for compensating for audio reproduction characteristics of said audio reproducing means, the arrangement being such that the corrected audio signals are compensated with respect to the audio reproduction characteristics of said audio reproducing means by said correcting means.

22. An audio reproduction apparatus according to claim 20, further comprising resetting means for resetting a signal representative of a movement of the head of the listener with respect to the reference direction, which movement is detected through each predetermined angle by said angle detecting means, to a signal in a forward direction with respect to the reference direction, the arrangement being such that a signal representative of a movement of the head of the listener with respect to the reference direction, which movement is detected through each predetermined angle by said angle detecting means, is reset to a signal in the forward direction with respect to the reference direction.

23. An audio reproduction apparatus according to claim 20, further comprising adding means for selecting a sound field and/or a reverberation in which to reproduce the audio signals and for adding the selected sound field and/or reverberation to the audio signals, the arrangement being such that a sound field and/or a reverberation in which to reproduce the audio signals is selected and added to said audio signals by said adding means.

24. An audio reproduction apparatus according to claim 20, further comprising adjusting means for adjusting a sound intensity and/or a balance at the time the audio signals are reproduced, the arrangement being such that a sound intensity and/or a balance at the time the audio signals are reproduced is adjusted by said adjusting means.

25. An audio reproduction apparatus according to claim 20, further comprising:

correcting means, connected to said control means, for compensating for audio reproduction characteristics of said audio reproducing means;

resetting means disposed, connected to said correcting means, for resetting a signal representative of a movement of the head of the listener with respect to the reference direction, which movement is detected through each predetermined angle by said angle detecting means, to a signal in a forward direction with respect to the reference direction;

adding means, connected to said resetting means, for selecting a sound field and/or a reverberation in which to reproduce the audio signals and for adding the selected sound field and/or reverberation to the audio signals; and adjusting means, connected to said adding means, for adjusting a sound intensity and/or a balance at the time the audio signals are reproduced, the arrangement being such that the corrected audio signals are compensated with respect to the audio reproduction characteristics of said audio reproducing means by said correcting means, a signal representative of a movement of the head of the listener with respect to the reference direction, which movement is detected through each predetermined angle by said angle detecting means, is reset to a signal in the forward direction with respect to the reference direction, a sound field and/or a reverberation in which to reproduce the audio signals is selected and added to said audio signals by said adding means, and a sound intensity and/or a balance at the time the audio signals are reproduced is adjusted by said adjusting means.

26. An audio reproduction apparatus according to claim 20, further comprising signal switching means, connected to said control means, for switching said signal source between a digital signal source and an analog signal source and for selecting an optional number of channels, the arrangement being such that said signal source is switched between the digital signal source and the analog signal source and an optional number of channels are selected by said switching means.

27. An audio reproduction apparatus according to claim 26, wherein said signal source comprises an analog signal source and first converting means for converting the audio signals outputted from said analog signal source into digital audio signals, wherein said angle detecting means comprises analog angle detecting means and second converting means for converting a detected angle signal outputted from said analog angle detecting means into a detected digital angle signal, and wherein said storage means stores said impulse responses or control signals which have been converted into digital signals, and said audio reproducing means comprises third converting means for converting said digital audio signals into analog audio signals.

28. An audio reproduction apparatus according to claim 26, wherein said signal source comprises a digital signal source, and said angle detecting means comprises digital angle detecting means, and wherein said storage means digitally stores said impulse responses or control signals which have been converted into digital signals.

29. An audio reproduction apparatus comprising:

a digital signal source for supplying digital audio signals in a plurality of channels;

first storage means for storing impulse responses measured from virtual sound source positions to the ears of a listener that are fixed with respect to a reference direction of the head of the listener;

integrating means for performing convolutional integration on the digital audio signals in the respective channels from said digital signal source and the impulse responses stored by said first storage means;

adding means for adding the digital audio signals in the respective channels which have been convolved with the impulse responses by said integrating means as right and left digital audio signals in respective two channels;

transmitting means for transmitting as radio signals the right and left digital audio signals in respective two channels which have been added by said adding means;

receiving means for receiving the digital audio signals in respective two channels which are transmitted by said transmitting means;

audio reproducing means disposed in the vicinity of the ears of the listener for converting digital audio signals from said digital signal source into analog audio signals with digital/analog converting means and for reproducing the signals;

angle detecting means for detecting a movement of the head of the listener with respect to the reference direction through each predetermined angle;

address signal converting means for converting an angle detected by said angle detecting means into a digital address signal;

second storage means for storing control signals representative of measured time differences and level differences of the audio signals from the virtual sound source positions to the ears of the listener with respect to the reference direction of the head of the listener through each angle which can be recognized by the listener; and control means for correcting the digital audio signals in respective two channels which are received by said receiving means using the control signals stored by said second storage means and for supplying the corrected digital audio signals to said audio reproducing means;

the arrangement being such that said second storage means is addressed by the digital address signal produced by said address signal converting means to provide the control signals stored by said second storage means to said control means for correcting the digital audio signals in respective two channels with respect to the movement of the head of the listener on a real-time basis by way of wireless communication.

30. An audio reproduction apparatus according to claim 29, further comprising digital/analog converting means for converting said digital audio signals in respective two channels which are added by said adding means into analog audio signals, the arrangement being such that the analog audio signals outputted by said digital/analog converting means are supplied to said transmitting means, the analog audio signals transmitted by said transmitting means are received by said receiving means, and the analog audio signals received by said receiving means are corrected by said control means.

31. An audio reproduction apparatus comprising:

a digital signal source for supplying digital audio signals in a plurality of channels;

first storage means for storing impulse responses measured from virtual sound source positions to the ears of a listener that are fixed with respect to a reference direction of the head of the listener;

integrating means for performing convolutional integration on the digital audio signals in the respective channels from said digital signal source and the impulse responses stored by said first storage means;

adding means for adding the digital audio signals in the respective channels which have been convolved with the impulse responses by said integrating means as right and left digital audio signals in respective two channels;

first radio means having a first receiving device and a first transmitting device for transmitting as radio signals the right and left digital audio signals in respective two channels which have been added by said adding means;

second radio means having a second receiving device for receiving the digital audio signals in respective two channels which are transmitted by said first transmitting device of said first radio means and a second transmitting device for transmitting a signal processing control signal to said first receiving device;

audio reproducing means disposed in the vicinity of the ears of the listener, for converting digital audio signals from said digital signal source into analog audio signals with digital/analog converting means and for reproducing the signals;

angle detecting means for detecting a movement of the head of the listener through each of a plurality of predetermined angles with respect to a reference direction;

address signal converting means for converting an angle detected by said angle detecting means into a digital address signal;

second storage means for storing control signals representative of measured time differences and level differences of the audio signals from the virtual sound source positions to the ears of the listener with respect to the reference direction of the head of listener through each angle which can be recognized by the listener; and control means for correcting the digital audio signals in respective two channels which are received by the receiving device of said second radio means using the control signals stored by said second storage means and for supplying the corrected digital audio signals to said audio reproducing means;

the arrangement being such that said second storage means is addressed by the digital address signal produced by said address signal converting means to provide the control signals stored by said second storage means to said control means and a signal processing control signal is transmitted from the transmitting device of said first radio means to the receiving device of said second radio means to vary the signal processing of the digital audio signals in respective two channels which are transmitted by the transmitting device of said first radio means, to thereby correct the digital audio signals in respective two channels with respect to the movement of the head of the listener on a real-time basis by way of bi-directional wireless communication.

32. An audio reproduction apparatus comprising:

a signal source for supplying audio signals in a plurality of channels;

storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener;

one or plural angle detecting means for detecting a movement of the head of the listener or the heads of plural listeners with respect to the reference direction through each predetermined angle;

address signal converting means for converting an angle detected by said angle detecting means into an address signal;

control means for correcting the audio signals in the respective channels from said signal source based on the impulse responses or control signals stored by said storage means; and audio reproducing means disposed in the vicinity of the head of the listener or each of the listeners and directed to the head, for reproducing the audio signals corrected by said control means;

the arrangement being such that said storage means is addressed by the address signal produced by said address signal converting means based on a signal depending on the angle from said angle detecting means to read the impulse responses or control signals stored by said storage means to correct the audio signals with the impulse responses or control signals in said control means, the audio signals are corrected with respect to the movement of the head of the listener or each of the listeners on a real-time basis, and the corrected audio signals are reproduced by said audio reproducing means.

33. An audio reproduction apparatus according to claim 32, wherein said audio reproducing means comprises a plurality of loudspeakers disposed in confronting relation to the ears of the listener.

34. An audio reproduction apparatus according to claim 32, wherein said audio reproducing means comprises a plurality of loudspeakers disposed forward of a straight line interconnecting the ears of the listener.

35. An audio reproduction apparatus according to claim 32, wherein said audio reproducing means comprises a plurality of loudspeakers disposed rearward of a straight line interconnecting the ears of the listener.

36. An audio reproduction apparatus according to claim 32, wherein said angle detecting means comprises a vibratory gyro mounted on the head of the listener.

37. An audio reproduction apparatus according to claim 32, wherein said angle detecting means comprises an ultrasonic transmission/reception device disposed in the vicinity of the head of the listener.

38. An audio reproduction apparatus according to claim 32, wherein said angle detecting means comprises a non-contact rotation sensor disposed in the vicinity of the head of the listener.

39. An audio reproduction apparatus according to claim 32, wherein said angle detecting means comprises a camera disposed in the vicinity of the head of the listener.

40. An audio reproduction apparatus comprising:

a signal source for supplying audio signals in a plurality of channels;

channel number converting means for converting the number of channels into another number of channel different from said number of channels depending on the number of channels for the audio signals;

storage means for storing impulse responses measured from virtual sound source positions with respect to a reference direction of the head of a listener to the ears of the listener depending on a movement of the head of the listener, or control signals representative of measured time differences and level differences of the audio signals from the virtual sound source positions with respect to the reference direction of the head of the listener to the ears of the listener through each angle which can be recognized by the listener;

one or plural angle detecting means for detecting a movement of the head of the listener or the heads of plural listeners with respect to the reference direction through each predetermined angle;

address signal converting means for converting an angle detected by said angle detecting means into an address signal;

control means for correcting the audio signals in the respective channels from said signal source based on the impulse responses or control signals stored by said storage means; and audio reproducing means mountable on the head of the listener or each of the listeners for reproducing the audio signals corrected by said control means;

the arrangement being such that said storage means is addressed by the address signal produced by said address signal converting means based on a signal depending on the angle from said angle detecting means to read the impulse responses or control signals stored by said storage means to correct the audio signals in the other number of channel different from said number of channels which has been converted by said channel number converting means, with the impulse responses or control signals in said control means, the audio signals are corrected with respect to the movement of the head of the listener or each of the listeners on a real-time basis, and the corrected audio signals are reproduced by said audio reproducing means.

41. An audio reproduction apparatus according to claim 40, wherein said channel number converting means comprises a decoder for converting the number of channels into another number of channels smaller than the number of channels depending on the number of channels for the audio signals.

42. An audio reproduction apparatus according to claim 40, wherein said channel number converting means comprises a decoder for converting the number of channels into another number of channels smaller than the number of channels depending on the number of channels for the audio signals to modify a simulation of the type of loudspeakers for reproducing the audio signals, depending on the other number of channels.

43. An audio reproduction apparatus according to claim 40, wherein said channel number converting means comprises a decoder for converting the number of channels into another number of channels smaller than the number of channels depending on the number of channels for the audio signals to modify a simulation of the distance of loudspeakers for reproducing the audio signals, depending on the other number of channels.

44. An audio reproduction apparatus according to claim 40, wherein said channel number converting means comprises an encoder for converting the number of channels into another number of channels greater than the number of channels depending on the number of channels for the audio signals.

45. An audio reproduction apparatus according to claim 40, wherein said channel number converting means comprises an encoder for converting the number of channels into another number of channels greater than the number of channels depending on the number of channels for the audio signals, said encoder having positional information corresponding to the other number of channels for modifying a simulation of the type of loudspeakers for reproducing the audio signals.

* * * * *

UNITED STATES PATENT AND TRADEMARK OFFICE

CERTIFICATE OF CORRECTION

PATENT NO. : 5,687,239

DATED : November 11, 1997

INVENTOR(S) : Kiyofumi Inanaga and Yuji Yamada

It is certified that error appears in the above-identified patent and that said Letters Patent is hereby corrected as shown below:

Col.6, line 13, after "loud" insert -- - --
Col.17, line 56, change "loud-speakers" to --loudspeakers--
Col.28, line 20, after "of" first occurrence, delete "-"
Col.29, line 8, change "since" to --Since--
Col.33, line 13, change "up/downcounter" to --up/down counter-- , both occurrences
Col.35, line 62, change "8" to --θ--
Col.55, line 25, change "Stages" to --stages--
Col.65, line 38, after "25," insert --26--
Col.66, line 6, change "($2\pi_L$" to --($2\pi_R$--
line 55, change "in-put" to --input--
Col.67, line 33, change "1/2" to --1/--
Col.68, line 28, delete "channel" second occurrence Col.76, line 67, change "hi-" to --bi--

Signed and Sealed this

First Day of September, 1998

Bruce Lehman

*Attest:*

BRUCE LEHMAN

*Attesting Officer*

*Commissioner of Patents and Trademarks*